US006738035B1

(12) United States Patent
Fan

(10) Patent No.: US 6,738,035 B1
(45) Date of Patent: May 18, 2004

(54) ACTIVE MATRIX LCD BASED ON DIODE SWITCHES AND METHODS OF IMPROVING DISPLAY UNIFORMITY OF SAME

(76) Inventor: Nongqiang Fan, P.O. Box 1511, Issaquah, WA (US) 98027

( * ) Notice: Subject to any disclaimer, the term of this patent is extended or adjusted under 35 U.S.C. 154(b) by 0 days.

(21) Appl. No.: 09/584,951

(22) Filed: Jun. 1, 2000

Related U.S. Application Data

(63) Continuation-in-part of application No. 09/085,190, filed on May 27, 1998, now abandoned.
(60) Provisional application No. 60/059,679, filed on Sep. 22, 1997.

(51) Int. Cl.[7] ..... G09G 3/36
(52) U.S. Cl. ..... 345/87; 345/88; 345/89; 345/90; 345/91; 345/92; 345/205; 315/169.1; 315/169.2; 315/169.3
(58) Field of Search ..... 345/87, 88, 89, 345/90, 91, 92, 205, 206; 315/169.1, 169.2, 169.3

(56) References Cited

U.S. PATENT DOCUMENTS

| | | | | | |
|---|---|---|---|---|---|
| 4,825,201 | A | * | 4/1989 | Watanabe et al. | 340/71 |
| 4,994,796 | A | * | 2/1991 | Kuijk | 340/784 |
| 5,151,691 | A | * | 9/1992 | Kuijk | 340/784 |
| 5,262,698 | A | | 11/1993 | Dunham | 315/169.1 |
| 5,708,451 | A | | 1/1998 | Baldi | 345/75 |
| 5,760,760 | A | * | 6/1998 | Helms | 345/102 |
| 6,097,356 | A | | 8/2000 | Fan | 345/60 |
| 6,229,508 | B1 | | 5/2001 | Kane | 345/82 |

FOREIGN PATENT DOCUMENTS

| | | | | |
|---|---|---|---|---|
| EP | 0 434 627 A2 | | 6/1991 | G09G/3/36 |
| EP | 0 447 077 A2 | | 9/1991 | G09G/3/36 |
| EP | 0 475 770 A2 | | 3/1992 | G09G/3/36 |
| EP | 0 755 042 A1 | | 1/1997 | G09G/3/22 |
| GB | 91/15843 | * | 10/1991 | 3/20 |
| WO | WO 93/19453 | | 9/1993 | |

* cited by examiner

*Primary Examiner*—Richard Hjerpe
*Assistant Examiner*—Jean Lesperance

(57) ABSTRACT

An active matrix LCD using two-terminal non-linear elements as switching elements is disclosed. This new kind of active matrix LCD comprises a matrix of pixel elements, and each pixel element comprises a first two-terminal non-linear element (5), a second two-terminal non-linear element (5'), and a capacitor (8) for holding the voltage on the LCD cell. When both the first and the second two-terminal non-linear elements are in the conducting state, the voltage on the capacitor (8) can be changed. When both the first and the second two-terminal non-linear elements are in the non-conducting state, the voltage on the capacitor (8) can be maintained. To improve the display uniformity of an active matrix LCD based on two-terminal non-linear elements, the display characteristics of each pixel is measured and stored in a calibration memory (70), and the correct driving parameters for each pixel are calculated based on the display characteristics of the pixel fetched from the calibration memory (70). Finally, the correct driving parameters for each pixel is used to drive the active matrix LCD. The correct driving parameters for each pixel can be stored in a video memory (80).

19 Claims, 34 Drawing Sheets

(Priori Art)

Charging-on

Charging-off

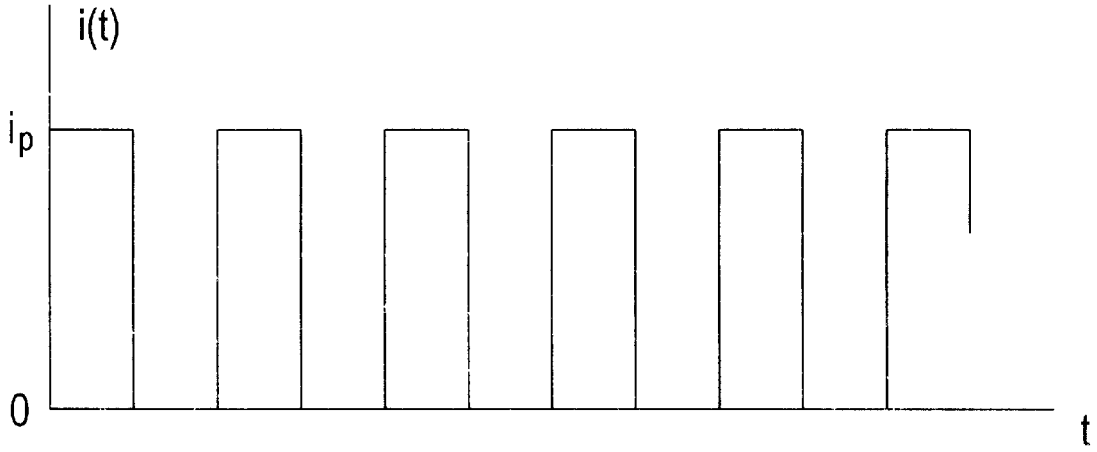
Figure 8b'
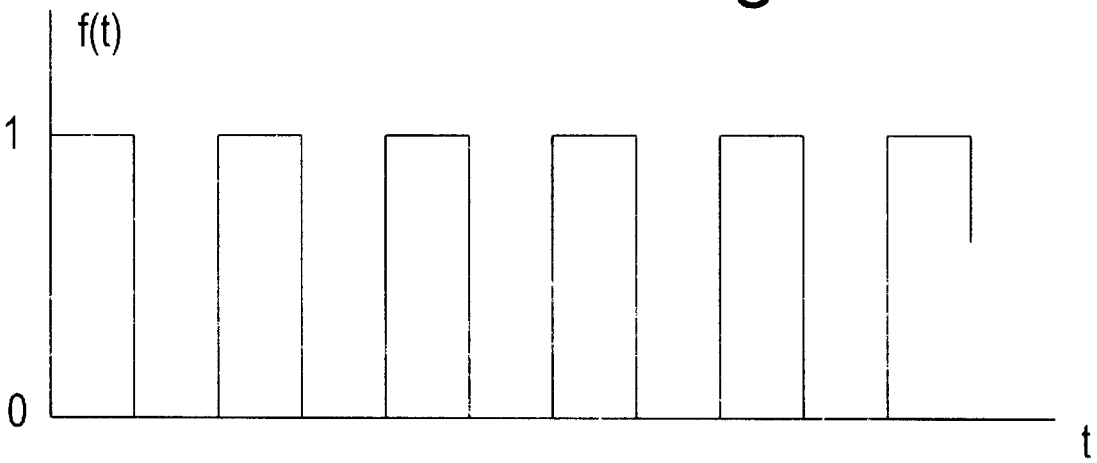
Figure 8b"

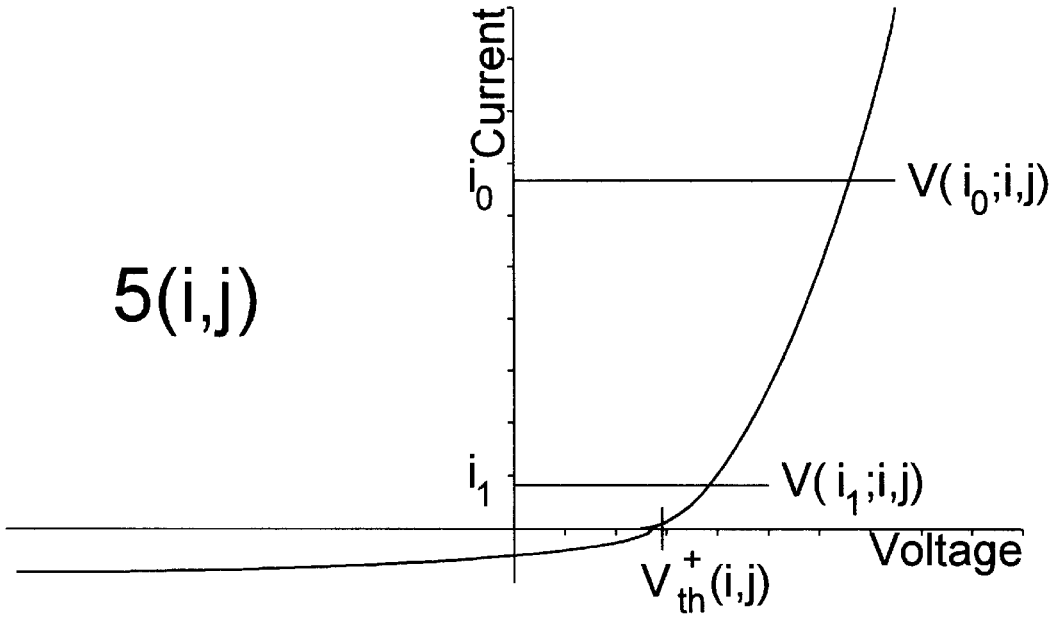
Figure 11b'
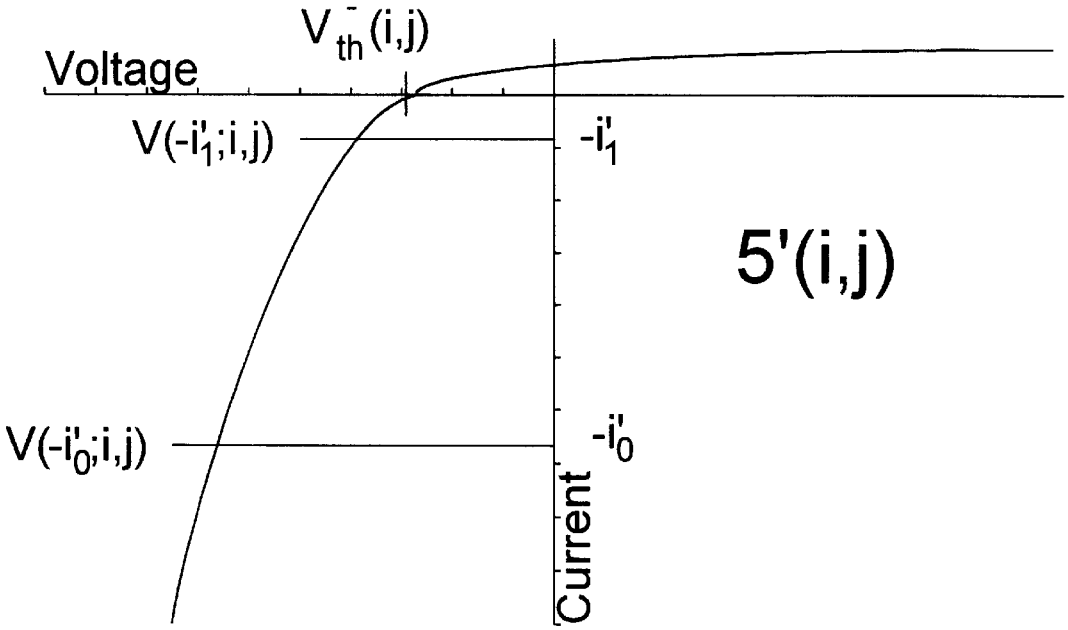
Figure 11b"

Charging-on

Charging-off i- = i-1 i+ = i+1 j- = j-1 j+ = j+1

ACTIVE MATRIX LCD BASED ON DIODE SWITCHES AND METHODS OF IMPROVING DISPLAY UNIFORMITY OF SAME

CROSS REFERENCE OF RELATED INVENTION

This application is a Continuation-In-Part of application Ser. No. 09/085,190 filed May 27, 1998, now abandoned. This application claims priority date of provisional application No. 60/059,679, filed on Sep. 22, 1997.

FIELD OF THE INVENTION

This invention is related to active matrix Liquid Crystal Displays (AM-LCDs), and specially to a method for making active matrix LCDs based on non-linear diodes and a method of improving the display uniformity of these diode based AM-LCDs by calibrating individual pixels.

BACKGROUND OF THE INVENTION

Active matrix Liquid Crystal Displays (AM-LCDs) are one of the major type of flat panel displays that can offer high resolution, high contrast; and fast response time suitable for video applications. Even though active matrix LCDs have better display quality than other kinds of passive matrix LCDs, active matrix LCDs are usually more difficult to manufacture and therefore more expansive. There are generally two broad categories of active matrix displays: one category use three-terminal thin film transistors (TFT) as the switching elements and the other category use two-terminal diodes as the switching elements. Typical two-terminal diodes used in active matrix LCDs are thin film diodes (TFD) and metal-insulator-metal (MIM) diodes Since two-terminal diodes are much easier to manufacture than three-terminal transistors, active matrix LCDs based on two-terminal diodes should be cheaper than active matrix LCDs based on three-terminal transistors, especially for large area displays. At present, however, in market place, active matrix LCDs based on two-terminal diodes have not been as successful as active matrix based on three-terminal transistors, because the display quality of LCDs based on two-terminal diodes have not been as good as the display quality of LCDs based on three-terminal transistors. The major reason for the poor display quality of LCDs based on two-terminal diodes is that, with present known driving techniques, display uniformity of LCDs based on two-terminal diodes usually depend on the uniformity of the characteristics of those two-terminal diodes. Because the characteristics of the two-terminal diodes in a LCD are inevitably non-uniform, correspondingly, the display uniformity of LCDs based on two-terminal diodes are usually not good. Different driving methods have been invented, but they have only achieved very limited success. For example, the driving methods described in U.S. Pat. No. 5,159,325 have only partially solved the problem, and these driving methods have also caused other technical problems, such as the burn-in of images, which are addressed in U.S. Pat. No. 5,648,794.

In this document, the applicant present a new method, which uses diodes to perform the switching function for isolating different pixels. With this method, both terminals of the capacitor for each pixel are used in synchronize for charging the capacitor to a desired voltage level. Terminal one of the capacitor is connected to two diodes. This terminal of the capacitor will effectively connect to the ground with low impedance if the two diodes are switched on with a driving current passing though both of them, and effectively connect to the ground with high impedance if no driving current is passing though them. When this terminal of the capacitor is effectively connected to the ground with low impedance, the second terminal of the capacitor will be set to a voltage level by driver electronics, and this voltage is used to charge the capacitor. With this method, the uniformity problem of the LCD matrix can be easily solved by measuring the reference voltage level of the terminal one of the capacitor once it is effectively connected to the ground with low impedance, and the voltage level on terminal two is set to equal to the sum of two voltages: the reference voltage of the terminal one and the desired charging voltage across the capacitor. This new method provides almost perfectly uniform display properties for active matrix LCDs based on two-terminal diodes regardless the inevitable variations of those diodes. In real operation, the measured reference voltages level of the terminal one of all capacitors can be stored in a calibration memory. When the main processor want to store a pixel's desired light intensity word to a video memory, it will first fetch the reference voltage of the terminal one of that pixel from the calibration memory, then, calculate what voltage level on terminal two will provide the desired voltage level across the capacitor of that pixel, and finally write the compensated voltage level into the video memory.

In this document, the applicant also demonstrate that present disclosed method of improving display uniformity by storing each pixel's display characteristics can also be applied to other driving methods for LCDs. In general, present disclosed method of improving display uniformity can be performed in three steps. In the first step, the display characteristics of all pixel element are measured, and the measured characteristics of all pixel element are stored in a calibration memory. In the second step, instead of having the main processor store a pixel's desired light intensity word directly to a video memory, the main processor will send the desired light intensity word to a register of a microprocessor; the microprocessor will then fetch the display characteristics of the pixel element from the calibration memory to a register or registers; the microprocessor will calculate the compensated light intensity in real time based on the desired light intensity and the display characteristics of the pixel element; the microprocessor finally store the compensated light intensity in a video memory. And in the third step, the compensated light intensities in the video memory are used by the driver electronics to drive the display that can achieve error-free images. Either a stand along special microprocessor or the main microprocessor can be used for the calculation.

SUMMARY OF THE INVENTION

It is an object of the invention to provide a method that can provide almost perfectly uniform display properties for active matrix LCDs based on two-terminal diodes regardless the inevitable variations of these diodes.

It is an object of the invention to use two serially connected two-terminal non-linear element as the switching element for each pixel, and such switching element is used to change the effective impedance connecting the capacitor of each pixel to a common ground.

It is an object of the invention to measure the display characteristics of each individual pixel element, store these measured display characteristics into a calibration memory, use the stored display characteristics in the calibration memory to calculate the correct driving parameters for each pixel element, store those corrected driving parameters in a video memory, and use the correct driving parameters in the video memory to drive the active matrix LCD.

It is an object of the invention to measure the display characteristics of each individual pixel element, store those measured display characteristics into a calibration memory, use the stored display characteristics in the calibration memory in combination with the uncompensated driving parameters in a video memory to calculate the correct driving parameters for each pixel, and use the correct driving parameters to drive the active matrix LCD.

It is an object of the invention to provide a method that can provide almost perfectly uniform display properties for active matrix LCDs based on two-terminal diodes of modest quality, regardless the inevitable variations of these diodes, even if these diodes have non-negligible leakage current while in the off-state.

Additional advantages and novel features of the invention will be set forth in the description which follows, and in part will become apparent to those skilled in the art upon examination of the following, or may be learned by practice of the invention. The objects and advantages of the invention maybe realized and attained by means of the instrumentality and combinations particularly pointed out,in the appended claims.

To achieve the foregoing and other objects and in accordance with the present invention, as described and broadly claimed herein, for each pixel, two non-linear elements are provided to connected to terminal one of the capacitor for that pixel; a driving method is provided to switch the impedance of that terminal to the ground between a high value and a low value; a method is provided to measure the reference voltage of terminal one when it is connected to the ground with low impedance; a calibration memory is provided to store the measured reference voltages of all pixels; a microprocessor is provided to use the stored reference voltages in the calibration memory to calculate the correct driving voltage for each pixel; a method is provided to charge the capacitor to the target voltage by setting the terminal two of the capacitor to the correct driving voltage which is already compensated for the variations among those non-linear element. For non-linear element based on diodes of modest quality, a third non-linear element is provided to isolate the terminal two of the capacitor when the voltage on the capacitor need to be maintained.

For any kinds of diode-based AM-LCDs in general, to achieve the foregoing and other objects and in accordance with the present invention, as described and broadly claimed herein, a method is provided to measure the display characteristics of every pixel element in the display; a calibration memory is provided to store the measured display characteristic of every pixel element in the display, a microprocessor is provided to use the stored display characteristics of each pixel element in the calibration memory to calculate the correct driving parameters for the corresponding pixel element, and finally driver electronics are provided to use the correct driving parameters to drive the active matrix display. A diode-based active matrix LCD driven by driver electronics using the correct driving parameters will provide images free of intensity distortions caused by each diode's property variations.

BRIEF DESCRIPTION OF THE DRAWINGS

The accompany drawings, which are incorporated in and form a part of the invention and, together with the description, serve to explain the principles of the invention. In the drawings, closely related figures have the same number but different alphabetic suffixes.

FIGS. 8*b*' and 8*b*" shows the wave form of current i(t) and function f(t) respectively.

FIGS. 11*b*' and 11*b*" shows the current-voltage characteristic of diode 5(i,j) and 5'(i,j) respectively.

DESCRIPTION OF THE INVENTION

Figure 1A:
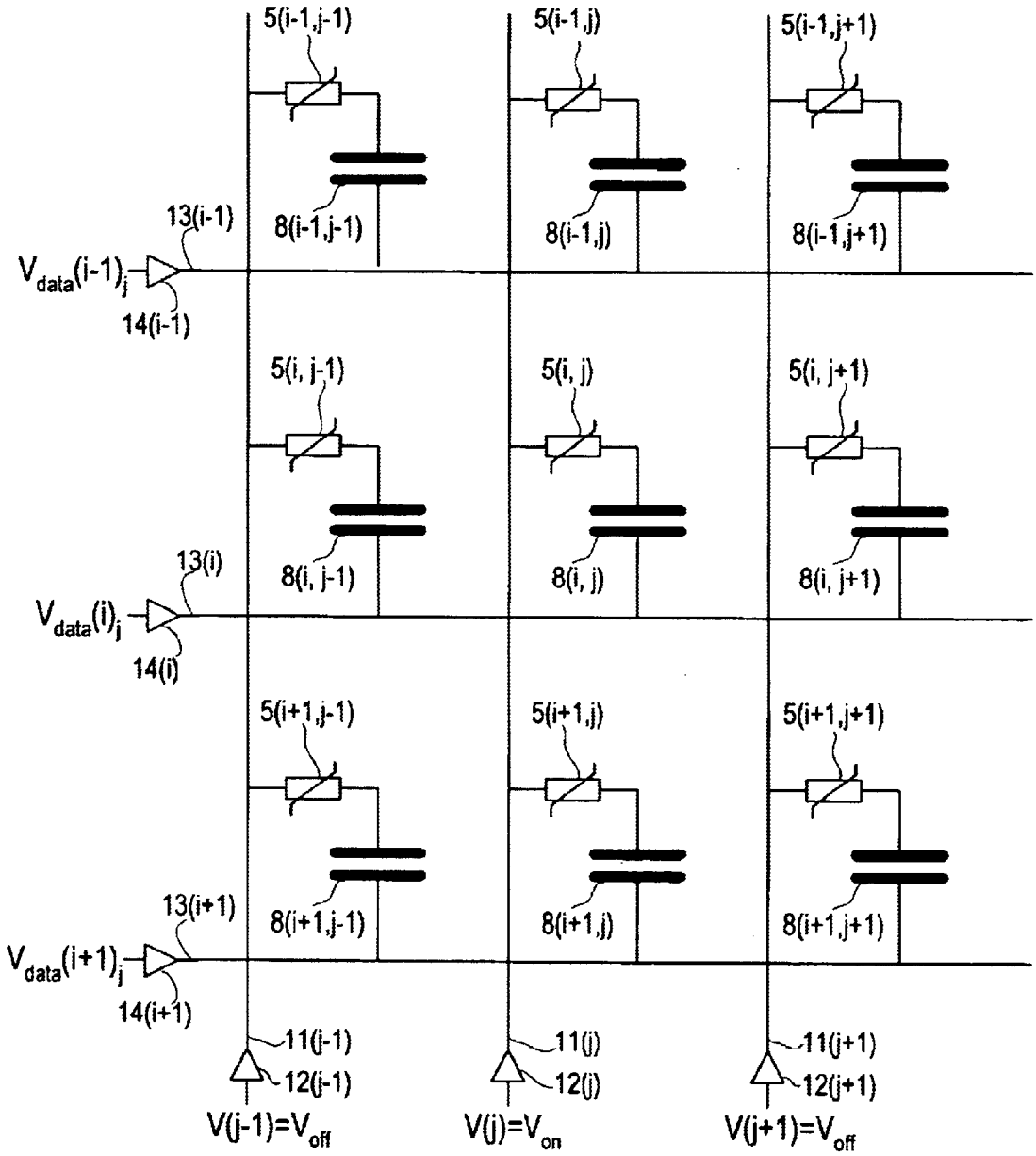
FIG. 1*a* shows one of the most common embodiment of active matrix LCDs based on two-terminal non-linear element.
Figure 1B:
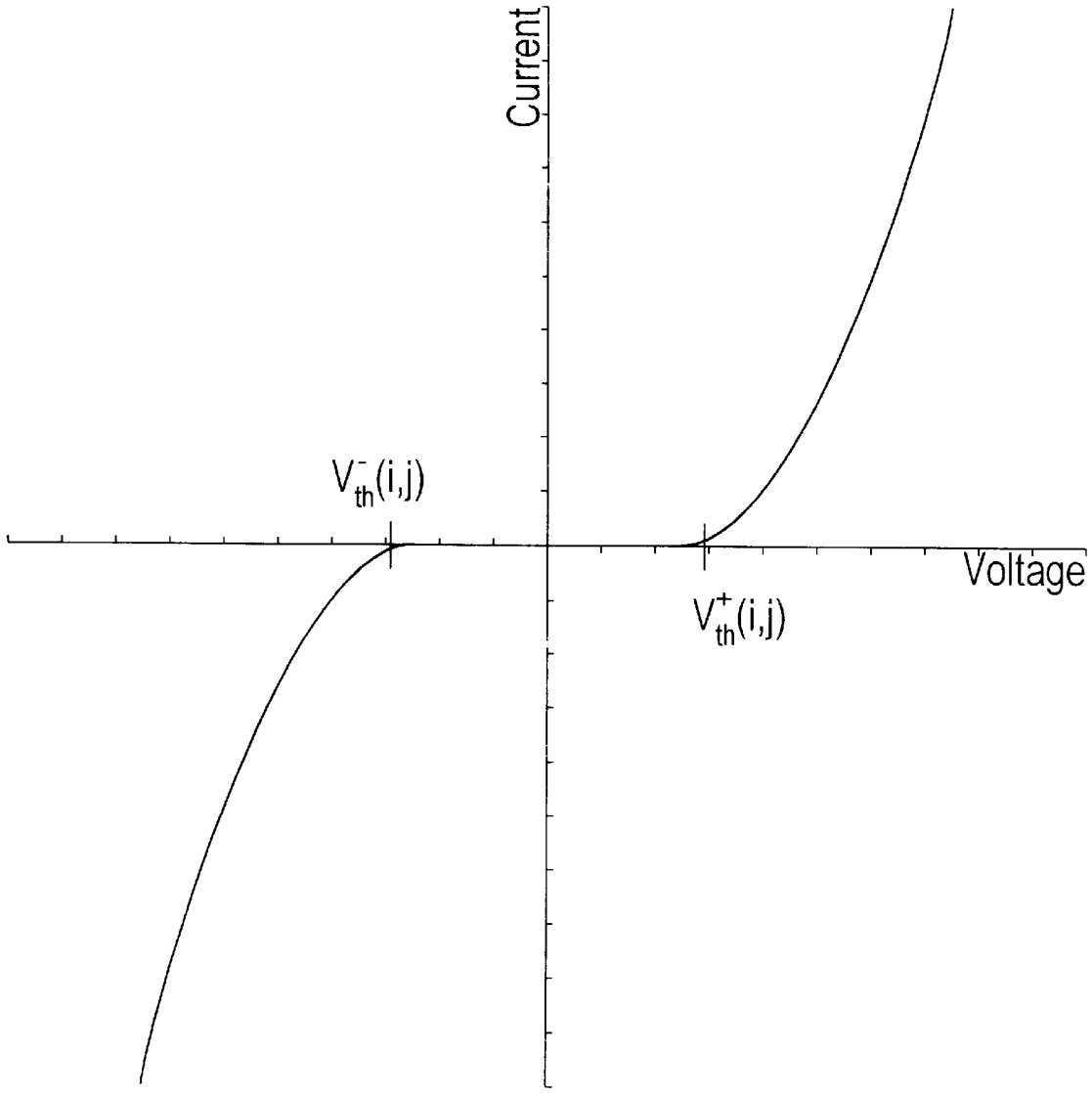
FIG. 1*b* shows the voltage-current characteristic of the two-terminal non-linear element at i'th row and j'th column.

FIG. 1*a* shows one of the priori art embodiment of active matrix LCDs based on two-terminal non-linear element. In FIG. 1*a*, the LCD consists of an array of column driving lines 11(*j*) and an array of row driving lines 13(*i*), and these two arrays of driving lines form a matrix structure. The cross position between each column driving line and each row driving line defines a pixel by connecting a non-linear diode 5(*i,j*) and a LCD cell 8(*i,j*) in series at that cross position. Each column driving line 11(*j*) is connected to a voltage driver 12(*j*), and each row driving line 13(*i*) is connected to a voltage driver 14(*i*). If the driver voltage for the i'th row is $V_i$ and the driver voltage for the j'th column is $V_j$, then, the voltage applied to the serially connected non-linear diode 5(*i,j*) and LCD cell 8(*i,j*) is $V_j-V_i$. The real voltage applied to the LCD cell 8(*i,j*) at the i'th row and the j'th column V(i,j) depends on the voltage-current characteristic of the non-linear diode at that position. FIG. 1*b* shows the voltage-current characteristic of the non-linear diode at i'th row and j'th column, and the threshold voltage for forward bias and reverse bias is respectively $V_{th}^+(i,j)$ and $V_{th}^-(i,j)$. In the case that the LCD cell 8(*i,j*) is charged until the charging current is zero, the real voltage applied to the LCD cell 8(*i,j*) at the i'th row and the j'th column V(i,j) will depend on the threshold voltages of the diode, and for forward bias, $V(i,j)=V_j-V_i-V_{th}^+(i,j)$, and for reverse bias—$V(i,j)=V_i-V_j-V_{th}^-(i,j)$. In all prior art driving methods, if a targeted voltage $V_{target}(i,j)$ is to be applied to the LCD cell 8(*i,j*) at the i'th row and the j'th column, then, the driving voltages V, and V, are designed such that $V_j-V_i=V_{target}(i,j)+\overline{V}_{th}^+$, where $\overline{V}_{th}^+$ is the nominal forward threshold voltage for all the non-linear diodes. With these prior art driving methods, the real voltage V(i,j) is different from the targeted voltage $V_{target}(i,j)$, such that, $V(i,j)-V_{target}(i,j)=-[V_{th}^+(i,j)-\overline{V}_{th}^-]$. This means that unless the current-voltage characteristic variations of all non-linear diodes are negligible, the display uniformity of the LCDs will certainly be determined by the uniformity of the current-voltage characteristics of all the non-linear diodes. It is very difficult and expansive to make all the current-voltage characteristics to be very uniform, and such an approach is not really practical for large area displays. The purpose of the current invention is to find a method which will provide nearly perfect display uniformity for active matrix LCDs even the LCDs are based on practically non-uniform switching diodes.

In this patent disclosure, methods of constructing active matrix LCDs (AM-LCDs) with non-linear diodes, methods of driving these diodes based AM-LCDs and methods of improving the display uniformity of these AM-LCDs are described. Among these disclosed methods, the actual embodiment might be somewhat different, the type of diodes used for the construction might be somewhat different, and the driving schemes might also be somewhat different. But, all these methods are based on one basic principle, which is the main subject of the current disclosure, and all these described methods are used as concrete examples to teach more effectively that basic principle.

The basic principle described in this disclosure actually consists of three parts. The first part is how to construct an AM-LCD with non-linear diodes, the second part is how to drive such a AM-LCD, and the third part is how to improve the display uniformity of this AM-LCD. The central idea of the current invention is to measure and store in a calibration memory the display characteristics of all pixel elements, and to use the display characteristics stored in the calibration memory to calculate the correct driving parameters for each pixel element. LCDs driven by these correct driving parameters will have almost perfect display uniformity.

Figure 2:
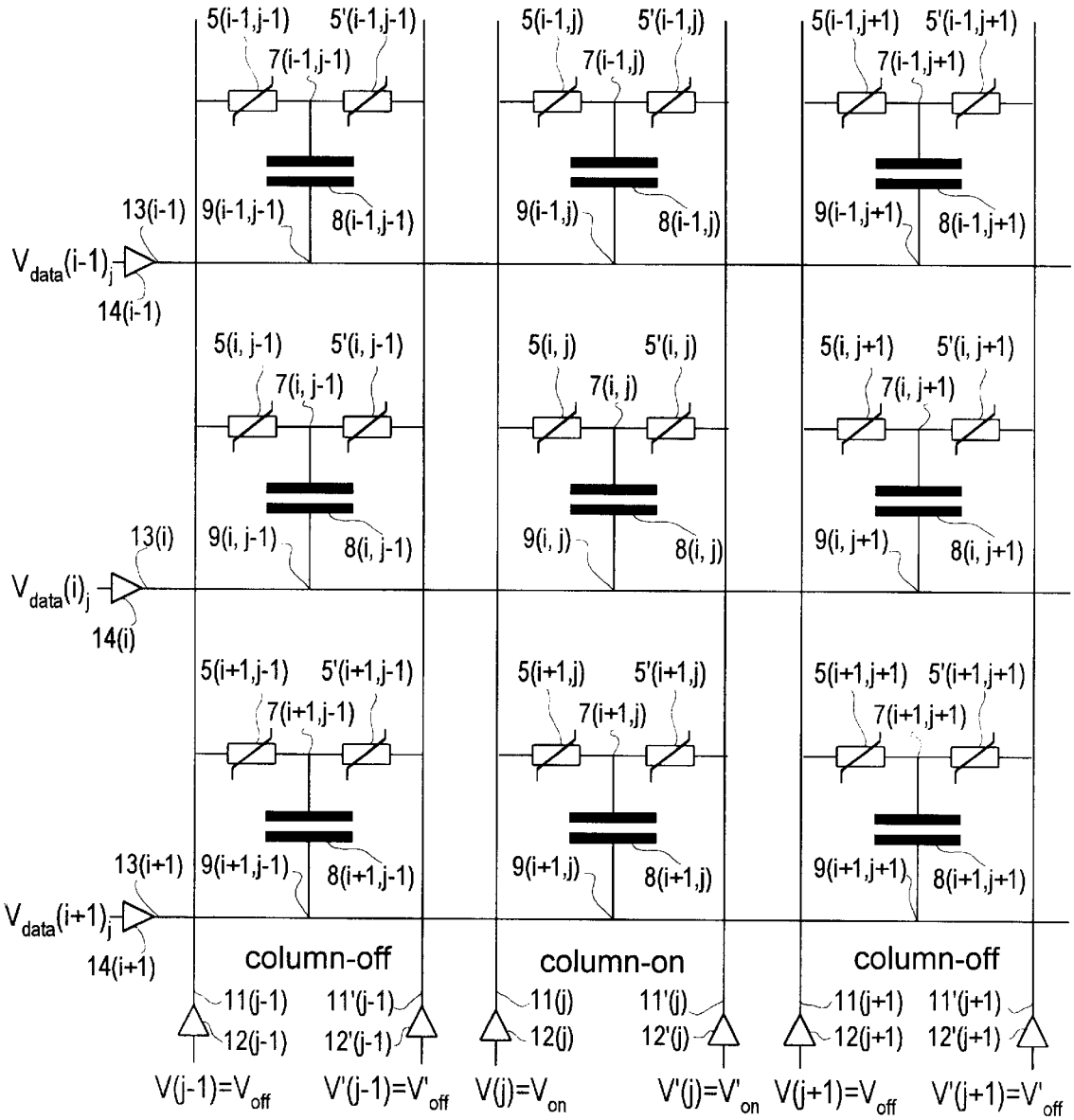
FIG. 2 shows a new method to construct an AM-LCD with two-terminal non-linear elements, and it also shows how to drive such an AM-LCD.

FIG. 2 shows a new method on how to construct an AM-LCD with non-linear diodes. As shown in FIG. 2, the LCD consists of an array of row driving lines 13(*i*) and two array of column driving lines 11(*j*) and 11'(*j*), and row driving lines and column driving lines form a matrix structure. The driving line for the i'th row is 13(*i*), and driving lines for the j'th column are 11(*j*) and 11'(*j*). The cross position between the driving line for the i'th row and driving lines for the j'th column defines a pixel element (i,j). Associated with each pixel element (i,j), there is a storage capacitor 8(*i,j*) with terminal one 7(*i,j*) and terminal two 9(*i,j*). One terminal of diode 5(*i,j*) is connected to terminal one 7(*i,j*) of capacitor 8(*i,j*), and the other terminal of diode 5(*i,j*) is connected to the first driving line 11(*j*). One terminal of diode 5'(*i,j*) is also connected to terminal one 7(*i,j*) of capacitor 8(*i,j*), and the other terminal of diode 5(*i,j*) is connected the second driving line 11'(*j*). The terminal two 9(*i,j*) of capacitor 8(*i,j*) is connected to the driving line 13(*i*) for the i'th row. Each column driving line 11(*j*) is connected to a voltage driver 12(*j*), each column driving line 11'(*j*) is connected to a voltage driver 12'(*j*), and each row driving line 13(*i*) is connected to a voltage driver 14(*i*). The purpose of diode 5(*i,j*) and 5'(*i,j*) is to effectively connect the terminal one 7(*i,j*) to the ground with low impedance when that terminal is selected with driving line 11(*j*) and 11'(*j*), and isolate that terminal to the ground with high impedance when that terminal is not selected.

Any pixel element can be either in charging-on mode or charging-off mode. For all the pixel elements in a column, the two driving lines for that column controls which of the two modes will be for those pixel elements in that column. When a pixel element is in charging-on mode, the capacitor of that pixel element can be charged by the voltage on the row's driving line connected to that pixel element. When a pixel element is in charging-off mode, the voltage on the capacitor of that pixel element is maintained, and that voltage is hardly influenced by the voltage on the row's driving line connected to that pixel element.

Figure 3A:
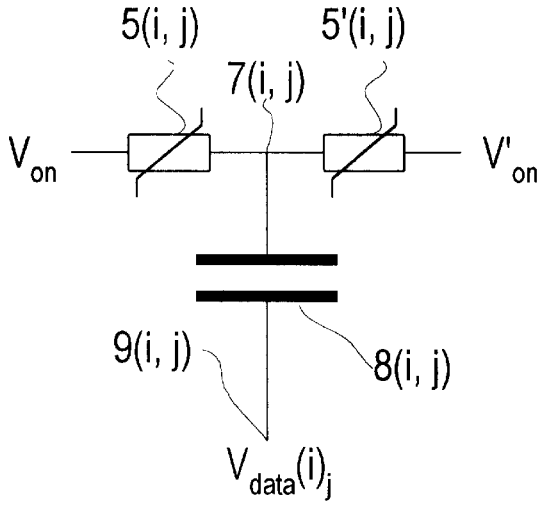
FIG. 3*a* shows the equivalent circuit of a pixel element in FIG. 2 when that pixel element is in charging-on mode.
Figure 3A:
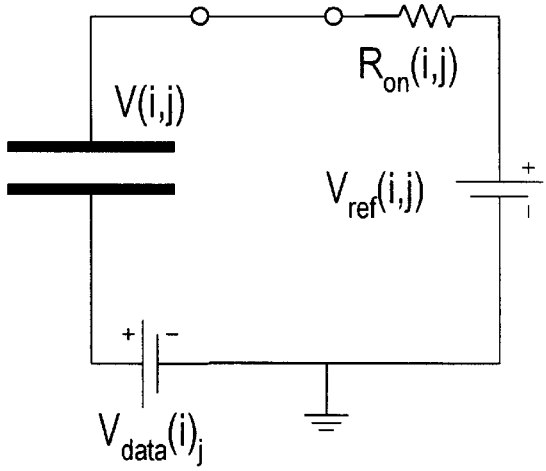

FIG. 3*a* shows the equivalent circuit of a pixel element (i,j) when that pixel element is in charging-on mode. In FIG. 3*a*, when on-voltages $V_{on}$ and $V'_{on}$ are applied to the terminals of diode 5(*i,j*) and diode 5'(*i,j*) respectively to drive both diodes 5(*i,j*) and 5'(*i,j*) into the conducting state, the terminal one 7(*i,j*) of the capacitor 8(*i,j*) is equivalently connecting to a reference voltage $V_{ref}$(i,j) though a low impedance $R_{on}$(i,j); and at the same time if a voltage $V_{data}$(i), is set on the terminal two 9(*i,j*) of capacitor 8(*i,j*), that capacitor 8(*i,j*) will be charged to a voltage $V(i,j)=V_{data}(i)_j-V_{ref}(i,j)$ exponentially with a time constant $R_{on}(i,j)C$.

Figure 3B:
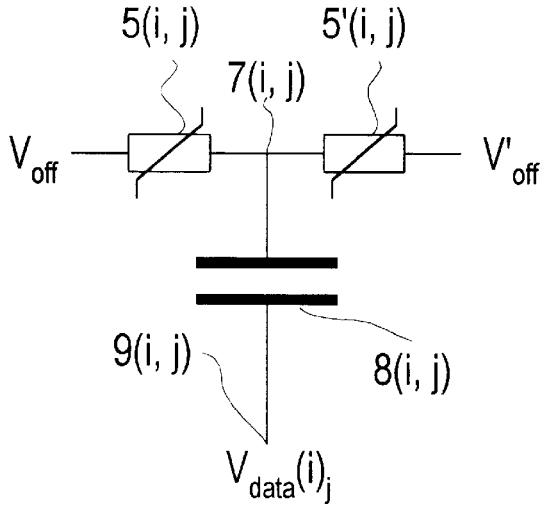
FIG. 3*b* shows the equivalent circuit of a pixel element in FIG. 2 when that pixel element is in charging-off mode.
Figure 3B:
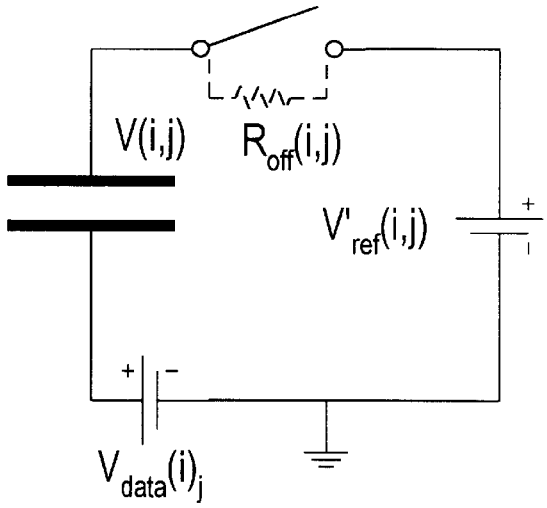

FIG. 3*b* shows the equivalent circuit of a pixel element (i,j) when that pixel element is in charging-off mode. In FIG. 3*b*. when off-voltages $V_{off}$ and $V'_{off}$ are applied to the terminals of diode 5(*i,j*) and diode 5'(*i,j*) respectively to drive both diodes 5(*i,j*) and 5'(*i,j*) into the non-conducting state, the terminal one 7(*i,j*) of the capacitor 8(*i,j*) is equivalently connecting to a reference voltage $V'_{ref}$(i,j) though a very high impedance $R_{off}$(i,j), and no mater what voltage $V_{data}(i)_j$ is set on the terminal two 9(*i,j*) of capacitor 8(*i,j*), the voltage across that capacitor 8(*i,j*) will hardly change at all. And in fact, the voltage across that capacitor 8(*i,j*) can only change very little by a very small leakage current $I_{leak}(i,j)=[V_{data}(i)_j-V'_{ref}(i,j)]/R_{off}(i,j)$, and for good quality diodes with very large $R_{off}$(i,j), such small voltage changes across capacitor 8(*i,j*) can be practically neglected.

FIG. 2 also shows how to drive the above described AM-LCD. As shown in FIG. 2, at any instance, the driving lines of only one column (for example, column j) are set to on-voltages $V_{on}$ and $V'_{on}$, with $V_{on}$ for the first driving line and $V'_{on}$ for the second, and the driving lines for all remaining columns are set to off-voltages $V_{off}$ and $V'_{off}$, with $V_{off}$ for the first driving lines and $V'_{off}$ for the second. Because only one column has the corresponding driving lines in on-voltages $V_{on}$ and $V'_{on}$, only pixel elements in that selected column is in charging-on mode and pixel elements in all the other columns is in charging-off mode. When a pixel element (i,j) in the selected column j is in charging-on mode, the voltage $V_{data}(i)_j$ on driving line for the i'th row will charge capacitor 8(*i,j*) to a voltage $V(i,j)=V_{data}(i)_j-V_{ref}(i,j)$, where $V_{ref}$(i,j) is the reference voltage at the terminal one 7(*i,j*) of capacitor 8(*i,j*) when terminal one 7(*i,j*) is connected to the ground though low impedance. After all the capacitors in column j is charged to the desired voltage value, column j will be set to charging-off mode and column j+1 will be set to charging-on mode to charge all the capacitors in column j+1. After column j+1, column j+2 is in charging-on mode, then column j+3, . . . and so on. All the columns are in charging-on mode progressively one by one until all the capacitors in the display matrix is charged to the desired values.

A voltage on driving line $V_{data}$(i) and a voltage V'(i,j) on capacitor 8(*i,j*) will set the voltage level on terminal one 7(*i,j*) to be $V_{data}(i)_j-V'(i,j)$. The voltages $V_{on}$, $V'_{on}$, $V_{off}$ and $V'_{off}$ are chosen to satisfy two conditions. Condition one is that no matter what voltage V'(i,j) preexists at capacitor 8(*i,j*), if pixel element (i,j) is selected for charging-on mode and a data-voltage $V_{data}(i)_j$ is set on terminal two 9(*i,j*), the voltage V(i,j) on capacitor 8(*i,j*) can always be able to quickly reach its new equilibrium value $V(i,j)=V_{data}(i)_j-V_{ref}(i,j)$. And condition two is that no matter what voltage V'(i,j) preexists at capacitor 8(*i,j*) and no matter what data-voltage $V_{data}(i)_j$ is set on terminal two 9(*i,j*), if pixel element (i,j) is not selected, diodes 5(*i,j*) and 5'(*i,j*) can remain in the non-conducting state despite the fact that a voltage $V_{data}(i)_j-V'(i,j)$ on terminal one 7(*i,j*) is present.

The value of voltage $V_{data}(i)_j$ on the driving line for the i'th row when the j'th column is in charging-on mode, can be taken from a video memory. In the video memory, $V_{data}(i)_j$ is set to be equal to $V_{data}(i)_j=V_{target}(i,j)+V_{ref}(i,j)$, where $V_{target}$(i,j) is the desired voltage to be charged across capacitor 8(*i,j*).

In the ideal case that the electronic characteristics of the two diodes in each pixel are identical, if the same current is passing though the two diodes, then, the voltage drop across the two diodes are also the same. And in this ideal case, the reference voltage $V_{ref}$(i,j) will equal to the middle voltage $(V_{on}+V'_{on})/2$, which is the same for all pixel elements. In this case, for pixel element (i,j), if a voltage $V_{target}$(i,j) is needed to set across capacitor 8(*i,j*) to give a specific light intensity, the microprocessor can simply write $V_{data}(i)_j=V_{target}(i,j)+(V_{on}+V'_{on})/2$ into the video memory. The diver electronics will use $V_{data}(i)_j$ to drive the display matrix. Or alternatively, the microprocessor can simply put $V_{target}$(i,j) into the video memory, and the driver electronics will sum up $V_{target}$(i,j) with $(V_{on}+V'_{on})/2$ directly and use $V_{data}(i)_j=V_{target}(i,j)+(V_{on}+V'_{on})/2$ to drive the display matrix.

In the non-ideal case that the electronic characteristics of the two diodes in each pixel element are not identical, the reference voltage $V_{ref}$(i,j) will be differ from $(V_{on}+V'_{on})/2$ by an amount which depend on the difference between the two diodes. And in this case, the reference voltage $V_{ref}$(i,j) is different for different pixel elements. In this non-ideal case, if the driver electronics use $V_{data}(i)_j=V_{target}(i,j)+(V_{on}+V'_{on})/2$ to drive the display matrix, the voltage V(i,j) charged to capacitor 8(*i,j*) will differ from the desired target voltage $V_{target}$(i,j) by an amount $V(i,j)-V_{target}(i,j)=-[V_{ref}(i,j)-(V_{on}+V'_{on})/2]$. This difference from the target voltage will cause display non-uniformity for current disclosed AM-LCDs. And, of course, this display non-uniformity will be there, no matter whether $V_{data}(i)_j$ is taken from the video memory directly or created by the driver electronics by fetching $V_{target}$(i,j) from the video memory, as long as formula $V_{data}(i)_j=V_{target}(i,j)+(V_{on}+V'_{on})/2$ is used for pixel element (i,j) and $V_{ref}$(i,j) is different from $(V_{on}+V'_{on})/2$.

Figure 4:
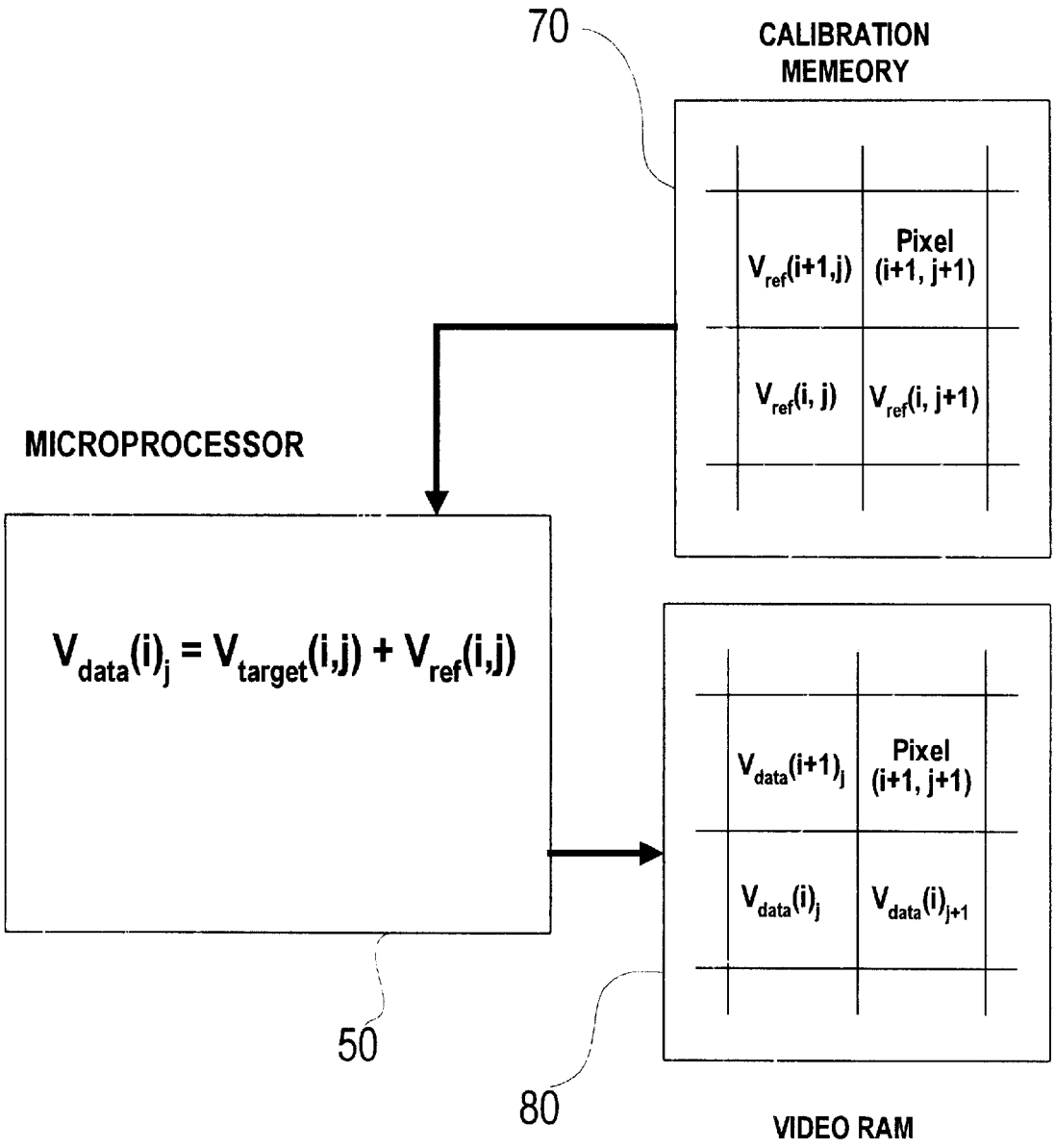
FIG. 4 illustrate the principle of creating displays with good uniformity by storing reference voltage $V_{ref}(i,j)$ in a calibration memory and using the calibration memory to calculate the correct driving voltage.

To create displays with good display uniformity for a real display which usually is built from diodes with inevitable variations of electronic characteristics, the correct reference voltage $V_{ref}$(i,j) need to be measured, and the correct voltage $V_{data}(i)_j=V_{target}(i,j)+V_{ref}(i,j)$ need to be used to charge the corresponding pixel (i,j). FIG. 4 illustrate the principle of creating displays with good uniformity by storing reference voltage $V_{ref}$(i,j) in a calibration memory 70 and using the calibration memory 70 in combination with a video memory 80 to provide the correct driving voltage.

To improve the display uniformity of the above described AM-LCD, the reference voltage $V_{ref}$(i,j) of the terminal one 7(*i,j*) of capacitor 8(*i,j*) of any selected pixel element (i,j) need to be measured at least once, and the measured reference voltages $V_{ref}$(i,j) need to be stored in calibration memory 70, as shown in FIG. 4. In the operation of a conventional AM-LCD, say, TFT AM-LCD, a microprocessor usually write the light intensity word directly to a video memory, and the driver electronics for a AM-LCD will use that light intensity word to set the voltage on the data line. In the operation of current disclosed diode based AM-LCD, unless all the diodes have very uniform characteristics, the voltage on the data line $V_{data}(i)_j$ should have certain corrections for each pixel element. The voltage on the data line $V_{data}(i)_j$ should be equal to the sum of two voltages: the desired voltage $V_{target}(i,j)$ to be set on capacitor 8(*i,j*) of pixel element (i,j) and the reference voltage $V_{ref}(i,j)$ at the terminal one 7(*i,j*) of that capacitor 8(*i,j*) when that terminal is connected to the ground with low impedance. In the operation of current disclosed diode based AM-LCD, if a desired voltage $V_{target}(i,j)$—which can be considered to be the light intensity word—is needed to set across capacitor 8(*i,j*) to give a specific light intensity, microprocessor 50 will not write the light intensity word directly into video memory 80, but instead, microprocessor 50 will first fetch the reference voltage $V_{ref}(i,j)$ of the corresponding pixel element (i,j) from calibration memory 70 and sum up that reference voltage $V_{ref}(i,j)$ with the desired voltage $V_{target}(i,j)$ to be charged to capacitor 8(*i,j*) of the corresponding pixel element (i,j); then, microprocessor 50 will write that voltage sum $V_{data}(i)_j=V_{target}(i,j)+V_{ref}(i,j)$ into video memory 80. The driver electronics will use the voltages $V_{data}(i)_j$ in video memory 80 to drive the display matrix. Or alternatively, the microprocessor can simply put $V_{target}(i,j)$ into video memory 80, the driver electronics will fetch $V_{ref}(i,j)$ from calibration memory 70 itself, sum up $V_{target}(i,j)$ with $V_{ref}(i,j)$ itself, and again use $V_{data}(i)_j=V_{target}(i,j)+V_{ref}(i,j)$ to drive the display matrix. Of the above two alternatives, the first method of writing $V_{data}(i)_j=V_{target}(i,j)+V_{ref}(i,j)$ into video memory 80 is the preferred method.

Figure 5A:
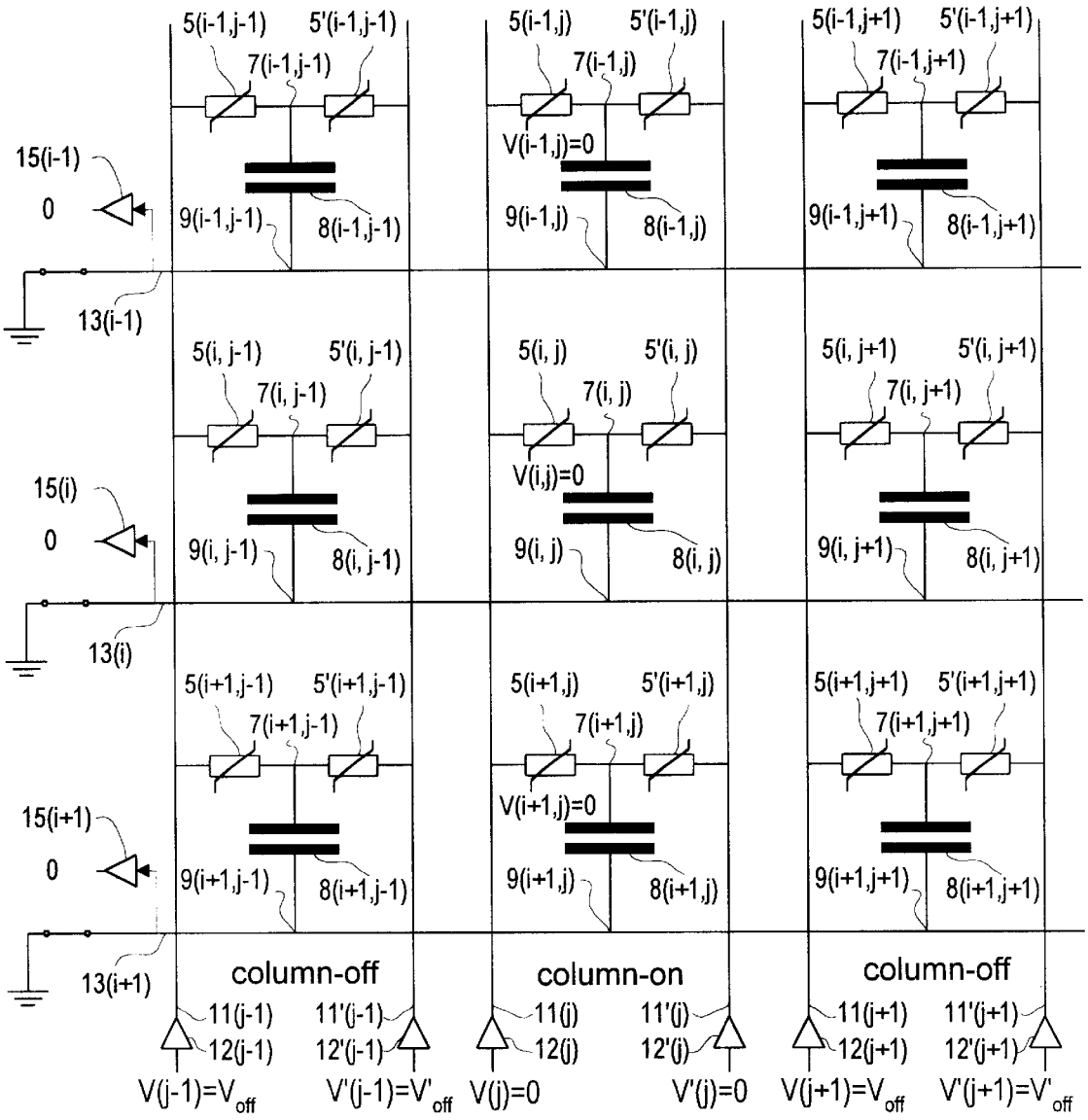
FIG. 5*a* shows the driver settings at the preparation stage for measuring the reference voltage $V_{ref}(i,j)$ of each pixel in j'th column.
Figure 5B:
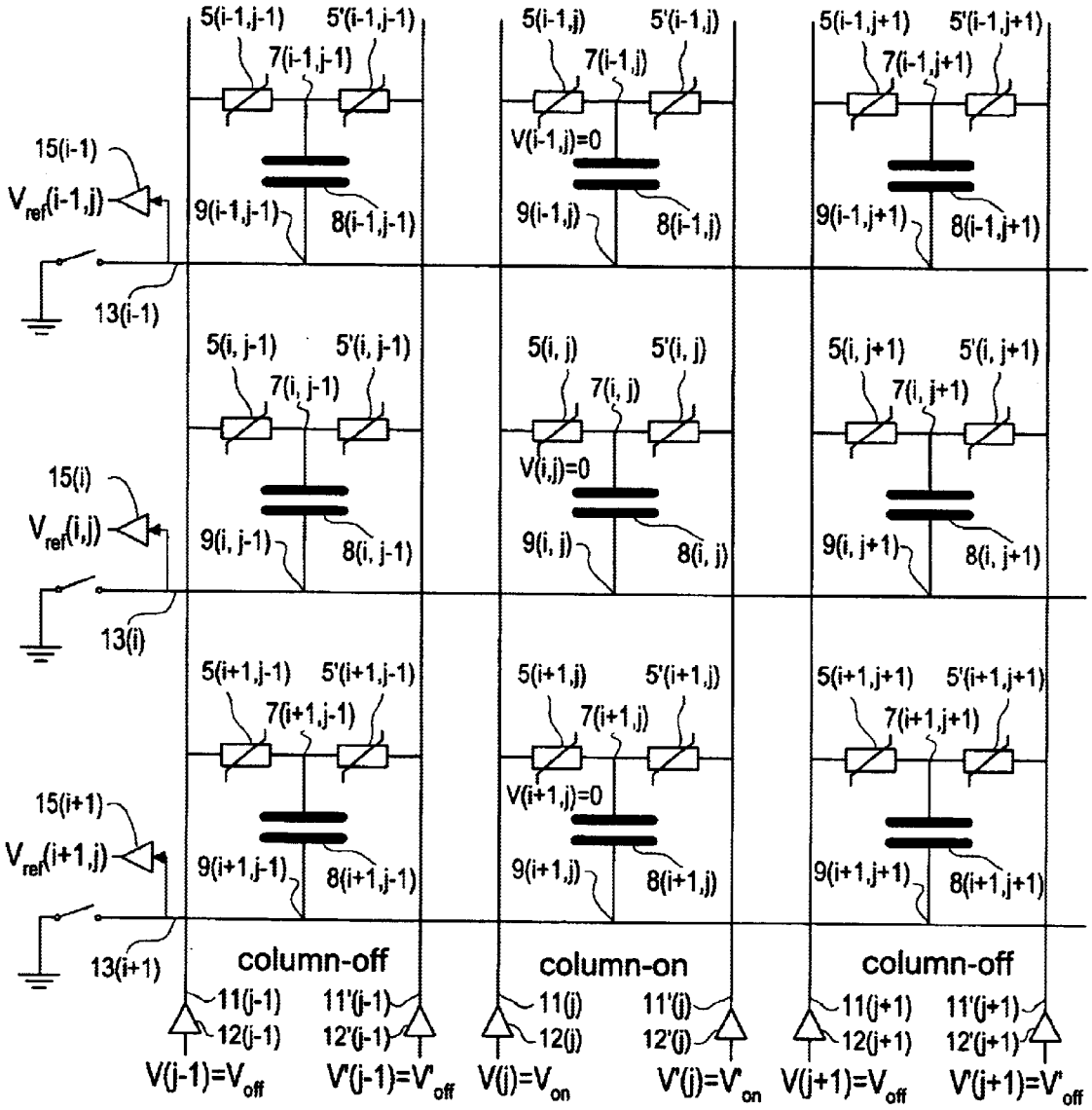
FIG. 5*b* shows the driver settings at the measurement stage for measuring the reference voltage $V_{ref}(i,j)$ of each pixel in j'th column.

We next turn to the disclosure on how to measure $V_{ref}(i,j)$ of all pixel elements. As shown in FIG. 5*a*, to measure $V_{ref}(i,j)$ of a pixel element at the i'th row and the j'th column, first, the voltages on driving lines 11(*j*) and 11'(*j*) for the column j are set to be equal to the ground and the voltages on the driving lines for all other columns are set to $V_{off}$ or $V'_{off}$ correspondingly to make sure all these other columns are in charging-off mode, the voltage on the i'th row is set to the ground as well. With all these voltages set, the voltage on capacitor 8(*i,j*) will start to discharge towards zero, and after a time period long enough, the voltage on capacitor 8(*i,j*) will reach exponentially to zero. After the voltage on capacitor 8(*i,j*) reach to (near) zero, the driving line for the i'th row is set to a high impedance or set to be open to the ground, and the voltage on this driving line is monitored with a voltage detector or amplifier 15(*i*), as shown in FIG. 5*b*. When all these is set, the voltage on the driving line 11(*j*) and 11'(*j*) for the j'th column are quickly switched to $V_{on}$ and $V'_{on}$ respectively. the same voltages used to set column j in charging-on mode; and at this instant, the voltage on the driving line 13(*i*) of the i'th row is measured again with voltage detector 15(*i*), and this voltage at this instant is just equal to $V_{ref}(i,j)$. In fact, if the voltage on the driving lines of all rows are set to ground when the j'th column is set to ground, and if the voltage on the driving lines of all rows are monitored when the j'th column is switching to charging-on mode, the reference voltages $V_{ref}(i,j)$ of all pixel elements in the j'th column can be measured simultaneously. After the reference voltages $V_{ref}(i,j)$ of all pixel elements in one column are measured, the reference voltages $V_{ref}(i,j)$ of all pixel elements in next column can be measured. In this way, column by column, the reference voltages $V_{ref}(i,j)$ of all pixel elements in the display matrix can be measured, and all these reference voltages can be stored in calibration memory 70 for later use.

The above method—on how to construct an AM-LCD with non-linear diodes, how to drive such a AM-LCD, and how to improve the display uniformity of this AM-LCD—is described in general for any kinds of non-linear diodes, as long as the non-linear diode can be switched between a conducting state and a non-conducting state. The kinds of diodes can be used include, but not limited to, thin film pn junctions, thin film Metal-Insulator-Metal (MIM) junctions, and some combinations of multiple diodes in serial or in parallel. Depend on the kinds of diodes used for diode 5(*i,j*) and diode 5'(*i,j*) in FIG. 2, the values of on-voltages ($V_{on}$ and $V'_{on}$) and off-voltages ($V_{off}$ and $V'_{off}$) can be different.

Figure 6A:
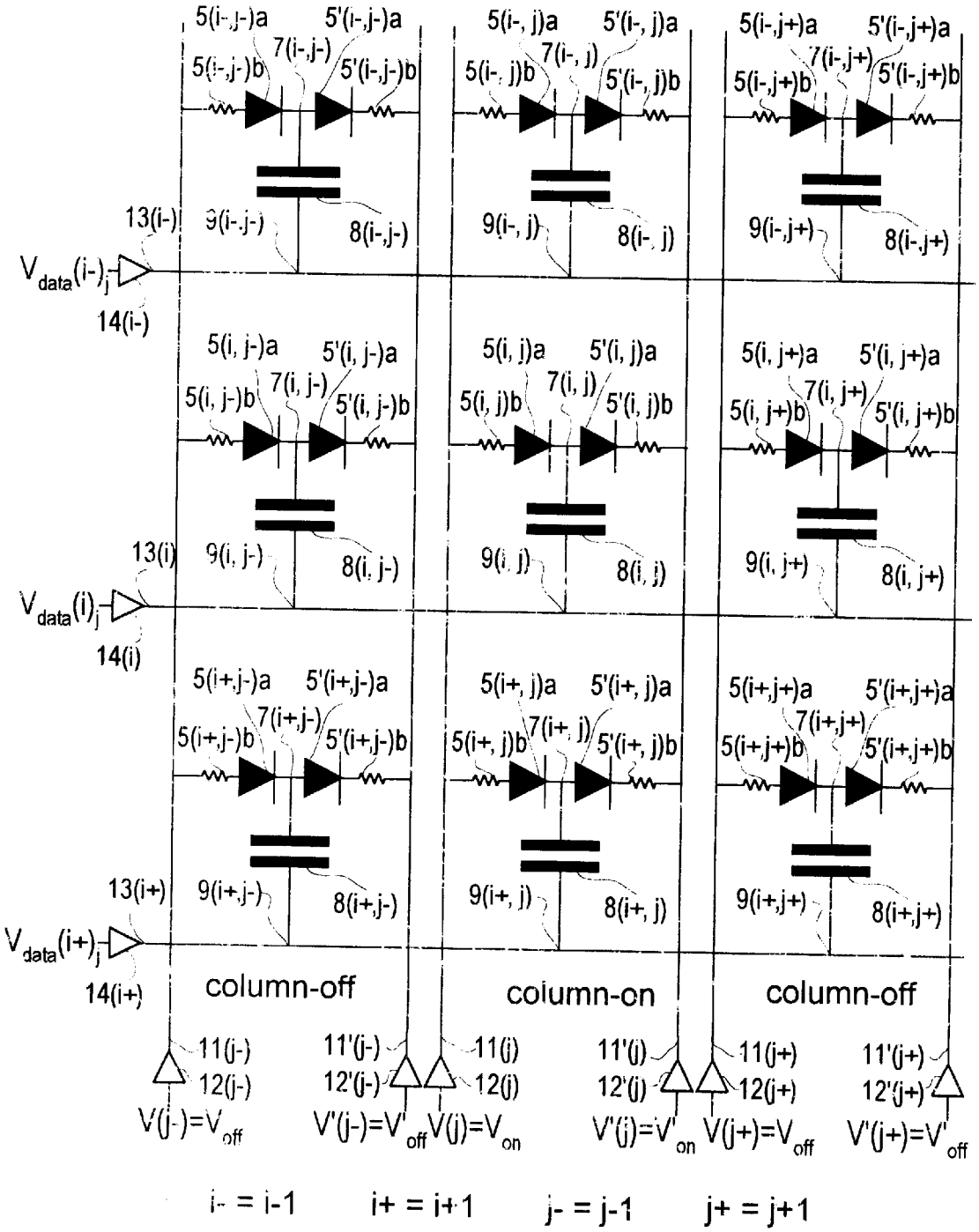
FIG. 6*a* shows an embodiment based on thin film pn diodes.

FIG. 6*a* shows an embodiment, based on thin film pn diodes, which, uses the forward biased state as the conducting state—driven by a positive on-voltage $V_{on}>0$ and another negative on-voltage $V'_{on}<0$, and uses the reverse biased state as the non-conducting state—driven by a negative off-voltage $V_{off}<0$ and another positive off-voltage $V_{off}>0$. In FIG. 6*a*, diode 5(*i,j*) is actually constructed from a thin film pn diode 5(*i,j*)*a* and a resistor 5(*i,j*)*b*, and similarly diode 5'(*i,j*) from a pn diode 5'(*i,j*)*a* and a resistor 5'(*i,j*)*b*. Resistor 5(*i,j*)*b* and resistor 5'(*i,j*)*b* are used to limit the current passing though the diodes. In a sample implantation, $V_{on}$ can be chosen to be +10V, $V'_{on}$ to be −10V, $V_{off}$ to be −10V and $V'_{off}$ to be +10V. Assume the voltage to be charged on capacitor 8(*i,j*) is between −2V to +2V, a data-voltage in the range between −2V to +2V is needed to set the capacitor voltage in that range, if $V_{ref}(i,j)$ is uniformly 0V. If we assume that the spread of $V_{ref}(i,j)$ is between −1V to +1V, then, a data-voltage in the range between −3V to 3V is needed to set voltages across the capacitors in that range between −2V to 2V. With data-voltages in the range between −3V to 3V and capacitor voltages in the range between −2V to 2V, the voltages on the terminal one 7(*i,j*) can spread in the range between −5V to 5V. If a pixel (i,j) is set to charging-off mode by voltages $V_{off}=-10V$ and $V'_{off}=+10V$, a voltage on terminal one 7(*i,j*) in the range between −5V to 5V can not drive either diode 5(*i,j*) or diode 5'(*i,j*) into the conducting state. Therefore the voltage values selected for $V_{on}$, $V'_{on}$, $V_{off}$ and $V'_{off}$ in the above are adequate for both charging-on and charging-off modes.

To increase the yield or reliability, multiple pn diodes (for example two diodes) can be connected in series or in parallel to substitute for diode 5(*i,j*)*a* or 5'(*i,j*)*a*.

Figure 6B:
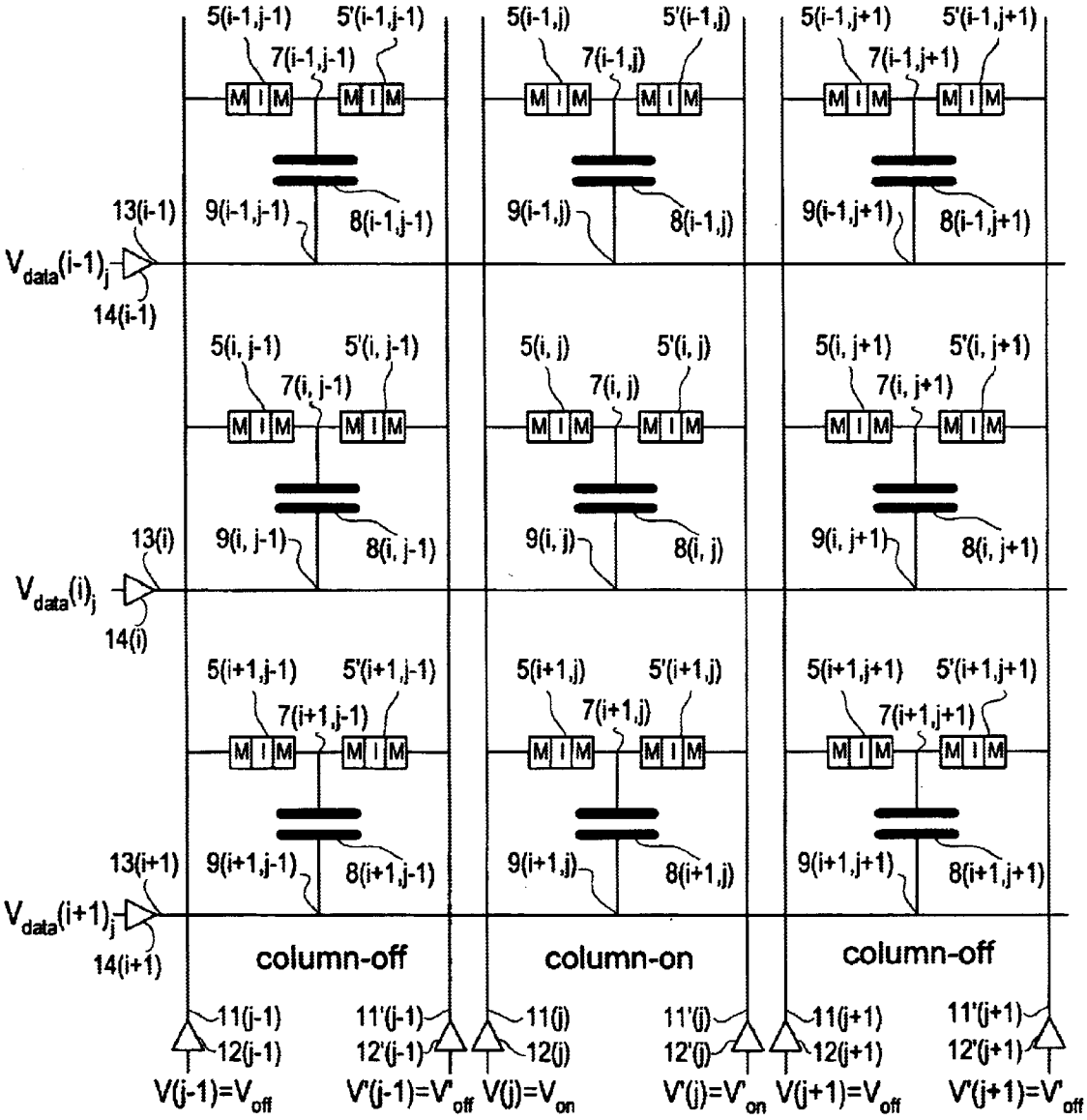
FIG. 6*b* shows an embodiment based on thin film metal-insulator-mental (M-I-M) diodes.

FIG. 6*b* shows an embodiment, based on thin film Metal-Insulator-Mental (M-I-M) diodes, which, uses a positive on-voltage $V_{on}$ and another negative on-voltage $V'_{on}$ to drive the two diodes into the conducting states—with the sum $|V_{on}|+|V'_{on}|$ larger than the total threshold voltage of the two diodes 5(*i,j*) and 5'(*i,j*), and uses one off-voltage $V_{off}=0$ and another off-voltage $V'_{off}=0$ to keep the diodes in the non-conducting states. In a sample implantation, $V_{on}$ can be chosen to be +10V, and $V'_{on}$ to be −10V. Assume the voltage to be charged on capacitor 8(*i,j*) is between −2V to 2V, a data-voltage in the range between −2V to +2V is needed to set the capacitor voltage in that range, if $V_{ref}(i,j)$ is uniformly 0V. If we assume that the spread of $V_{ref}(i,j)$ is between −1V to +1V, then, a data-voltage in the range between −3V to 3V is needed to set the voltages across the capacitors in that range between −2V to 2V. With data-voltages in the range between −3V to 3V and capacitor voltages in the range between −2V to 2V, the voltages on the terminal one 7(*i,j*) can spread in the range between −5V to 5V. If a pixel (i,j) is set to charging-off mode by voltages $V_{off}=0$ and $V'_{off}=0$, a voltage on terminal one in the range between −5V to 5V can not drive either diode 5(*i,j*) or diode 5'(*i,j*) into the conducting state if diode 5(*i,j*) or diode 5'(*i,j*) have threshold much larger than 5V. This high level of threshold voltage can be achieved by using multiple m-I-m diodes connected in series.

Figure 6C:
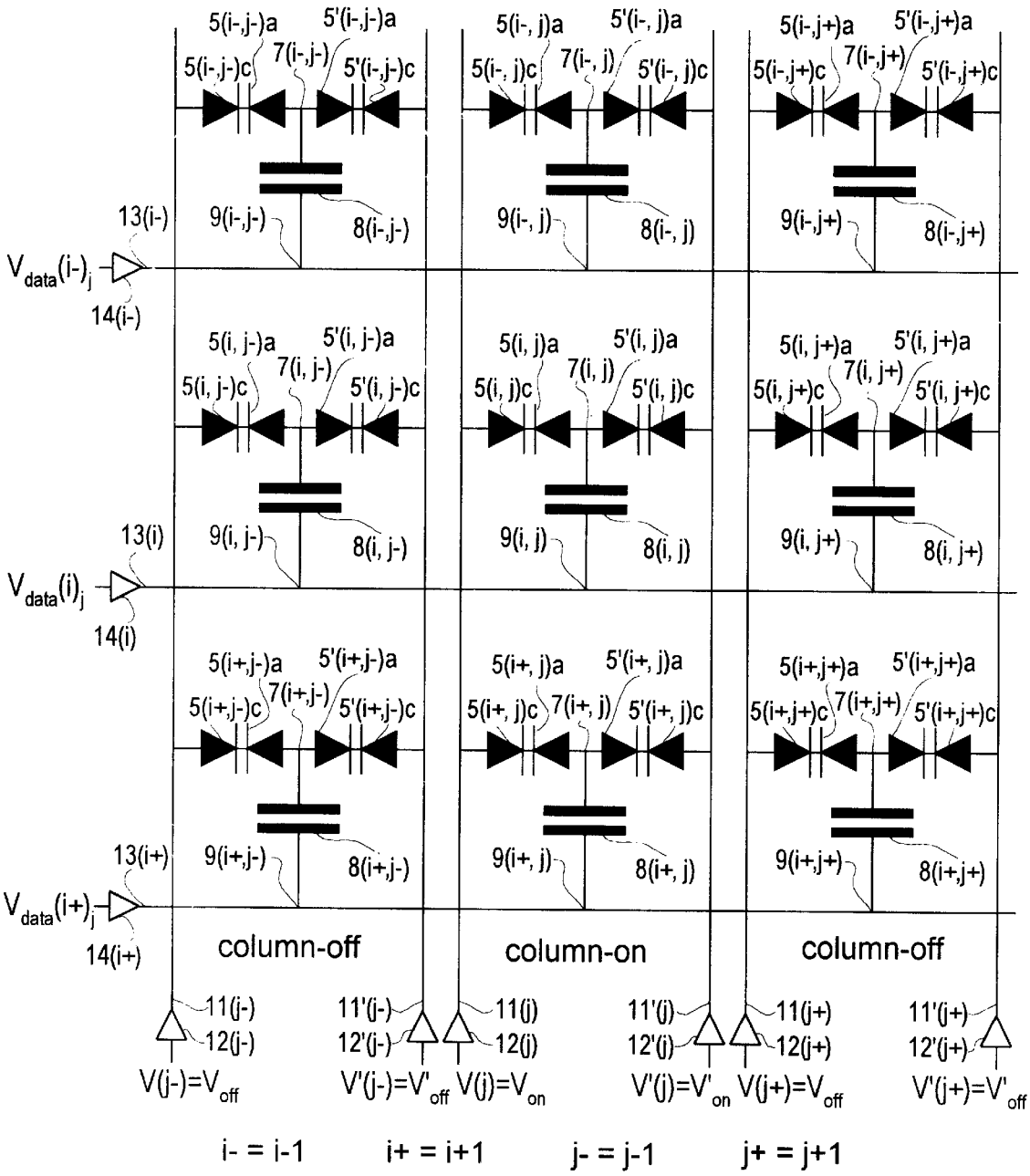
FIG. 6*c* shows an embodiment based on avalanche break down of pn diodes.

In FIG. 6*c*, it is shown that one pn diode connected in series with another reversed pn diode can be used to substitute for diodes 5(*i,j*) or 5'(*i,j*), provided that reverse break down voltages of the two diodes are properly designed, such that, when the reverse breakdown voltages are used as the threshold voltages, the total voltage applied to the two diodes $V_{on}-V'_{on}$ can drive the two diodes into the conducting states.

In the above, a new method of constructing active matrix LCDs are disclosed, a new method of driving such kinds of active matrix LCDs are disclosed. For the newly disclosed constructing method and newly disclosed driving method, a new method of improving the display uniformity of diode based AM-LCDs is also disclosed. In fact, the above described method of improving display uniformity of diode-based AM-LCDs can be applied in general to any kinds of diode-based AM-LCDs, since the problem of display uniformity is universal for every kind of diode-based AM-LCDs. Present disclosed method of improving display uniformity by calibrating individual pixels can solve this universal display uniformity problem once for all.

To teach more effectively the principles of current invention, in the following, present method of improving display uniformity by calibrating individual pixels are applied to another kind of diode-based AM-LCDs, the kind of diode-based AM-LCDs as shown in FIG. 1*a*. The matrix structure in FIG. 1*a* is a priori art embodiment. Several specific implementation of the present method of improving display uniformity of AM-LCD in FIG. 1*a* are described, and they are severed as examples for teaching the principles of the present method, which generally involves how to measure the display characteristics of each pixel element and how to use those measured display characteristics to provide the correct driving parameters. Based on these examples and teachings, people skilled in the art should be above to apply present method to any kinds of diode-based AM-LCDs.

Figure 7A:
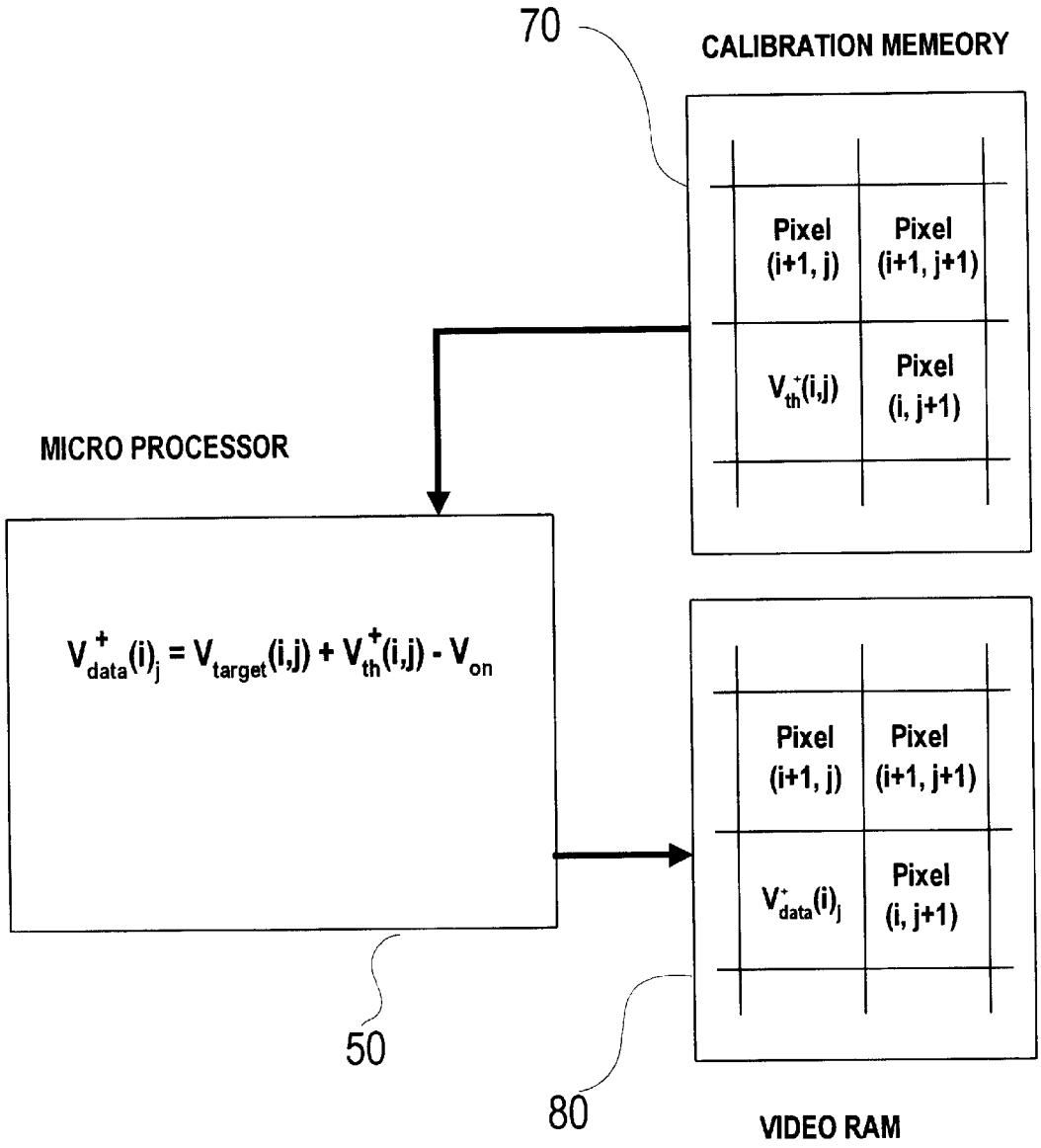
FIGS. 7*a* and 7*b* show that a microprocessor is used to calculate the correct driving voltages based on the display characteristics stored in a calibration memory.

The simplest implementation of the present invention as applied to the embodiment in FIG. 1*a* comprises two steps. In this implementation, each LCD cell is applied with voltage only in one polarity, say, positive polarity. In the first step of this implementation, the positive threshold voltages $V_{th}^{+}(i,j)$ of all switching diodes are measured and stored in a calibration memory 70, as shown in FIG. 7*a*. And in the second step of this implementation, if a target voltage $V_{target}(i,j)$ is to be applied to the LCD cell at the i'th row and the j'th column, the correct driving voltage $V_{data}^{+}(i)_j$ is calculated based on equation $V_{data}(i)_j=V_{target}(i,j)+V_{th}^{+}(i,j)-V_{on}$, and the correct driving voltage $V_{data}^{+}(i)_j$ is stored in a video memory 80 for pixel element (i,j). Here we assumed that the column driving voltage $-V_{on}$ is used for selecting the j'th column of LCD cells to write into and is not used to code luminosity information. If the correct driving voltage $V_{data}^{+}(i)_j$ is fetched from video memory 80 to drive the LCD cell for pixel element (i,j), the luminosity of pixel element (i,j) will be independent of the characteristics of the non-linear diode at that position, and therefore LCDs with almost perfect display uniformity can be obtained. In real implementations, the voltage on each LCD cell need to be preset to a certain voltage (e.g. a zero or a negative bias voltage) before the real positive driving voltage is applied.

For a real AM-LCD, the above implementation is preferred to be modified such that voltages with positive polarity and negative polarity are alternatively applied to each LCD cell. In the first step of this modified embodiment, both the positive and negative threshold voltages ($V_{th}^{+}(i,j)$ and $V_{th}^{-}(i,j)$ respectively) of all non-linear diodes are measured and stored in calibration memory 70. And in the second step of this modified implementation, if a target voltage $V_{target}(i,j)$ is to be applied to the LCD cell at the i'th row and the j'th column, the correct positive driving voltage $V_{data}^{+}(i)_j$ and negative driving voltage $V_{data}^{-}(i)_j$ are calculated based on equation $V_{data}^{+}(i)_j=V_{target}(i,j)+V_{th}^{+}(i,j)-V_{on}$ and $V_{data}^{-}(i)_j=V_{target}(i,j)-V_{th}^{-}(i,j)+V'_{on}$, and the correct driving voltages $V_{data}^{+}(i)_j$ and $V_{data}^{-}(i)_j$ are stored in video memory 80 for pixel element (i,j). Here we assumed that the column driving voltages $-V_{on}$ and $+V'_{on}$ are used for selecting the j'th column of LCD cells to write into and is not used to code luminosity information. When driving voltages $V_{data}^{+}(i)_j$ and $V_{data}^{-}(i)_j$ are fetched from video memory 80 to drive the LCD, nearly perfect display uniformity can be obtained.

Figure 7B:
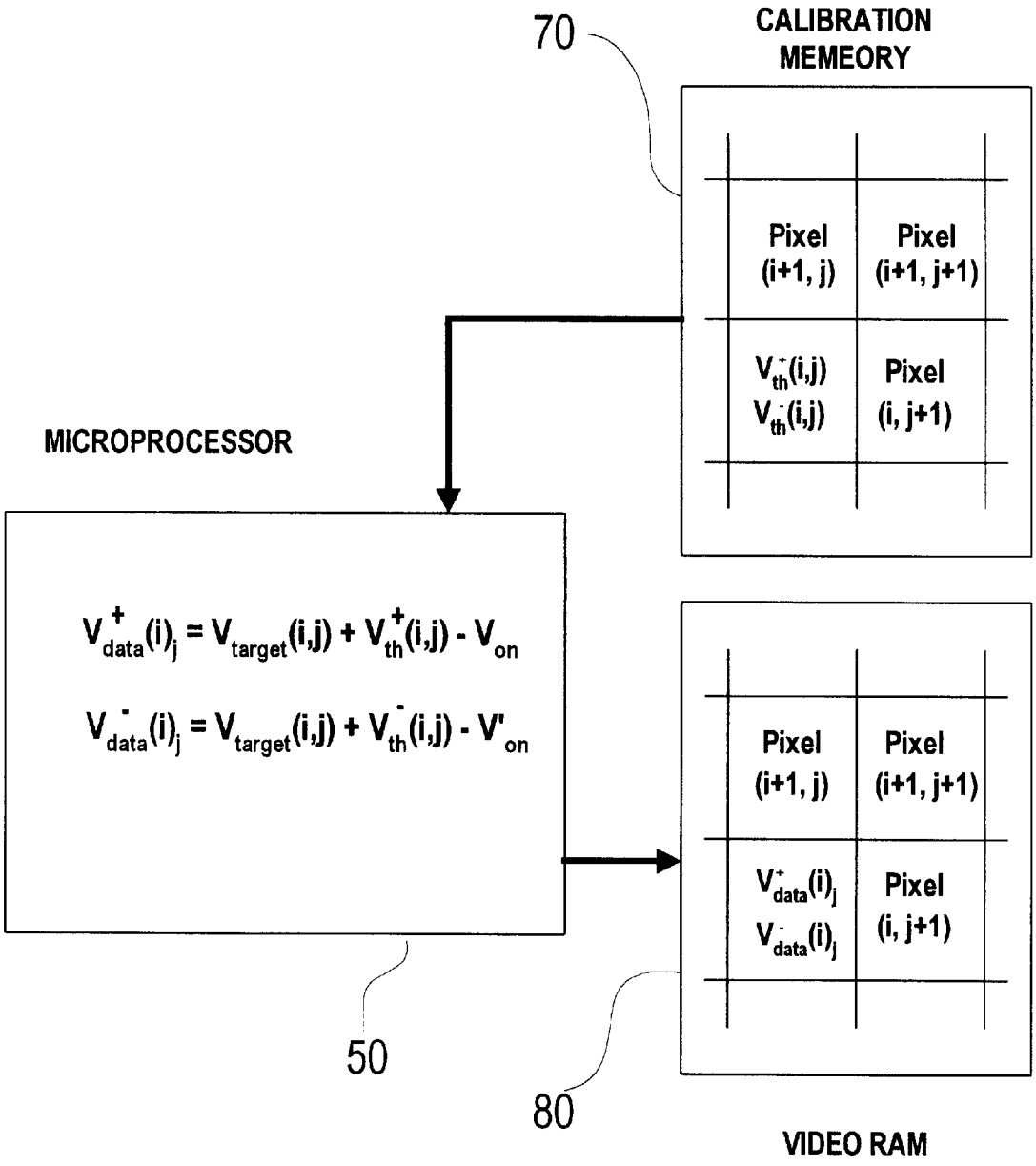

FIGS. 7*a* and 7*b* show that a microprocessor 50 can be used to calculate the correct driving voltages. In FIG. 7*a*, the positive threshold voltages $V_{th}^{+}(i,j)$ of all switching diodes are measured and stored in a calibration memory 70. When a computer want to apply a target voltage $V_{target}(i,j)$ to the LCD cell at pixel (i,j), microprocessor 50 will fetch the positive threshold voltages $V_{th}^{+}(i,j)$ from calibration memory 70, calculate the correct driving voltage $V_{data}^{+}(i)_j$ and store the correct driving voltage in video memory 80. The LCD driver electronics will use the correct driving voltages in video memory 80 to drive the LCD. In FIG. 7*b*, both the positive and negative threshold voltages ($V_{th}^{+}(i,j)$ and $V_{th}^{-}(i,j)$ respectively) of all non-linear diodes are measured and stored in calibration memory 70. When a computer want to apply target voltage $V_{target}(i,j)$ to the LCD cell at pixel (i,j), microprocessor 50 will fetch the positive threshold voltage $V_{th}^{+}(i,j)$ from calibration memory 70, calculate the correct positive driving voltage $V_{data}^{+}(i)_j$ and store the correct positive driving voltage in video memory 80; then, microprocessor 50 will fetch the negative threshold voltage $V_{th}^{-}(i,j)$ from calibration memory 70, calculate the correct negative driving voltage $V_{data}^{-}(i)_j$ and store the correct negative driving voltage in video memory 80. The LCD driver electronics will use the correct positive and negative driving voltages in video memory 80 to drive the LCD. Microprocessor 50 can be the main microprocessor for the computer or a special dedicated microprocessor.

An alternative method to that described in FIG. 7*a* is to store the target voltage $V_{target}(i,j)$ in video memory 80, use the driver electronics itself to calculate the correct driving voltage $V_{data}^{+}(i)_j=V_{target}(i,j)+V_{th}^{+}(i,j)-V_{on}$, and use this correct driving voltage $V_{data}^{+}(i)_j$ to drive the LCD. Similarly, An alternative method to that described in FIG. 7*b* is to store the target voltage $V_{target}(i,j)$ in video memory 80, use the driver electronics itself to calculate the correct driving voltage $V_{data}^{+}(i)_j=V_{target}(i,j)+V_{th}^{+}(i,j)-V_{on}$ and $V_{data}^{-}(i)_j=V_{target}(i,j)-V_{th}^{-}(i,j)+V'_{on}$, and use this correct driving voltages $V_{data}^{+}(i)_j$ and $V_{data}^{-}(i)_j$ to drive the LCD.

Figure 8A:
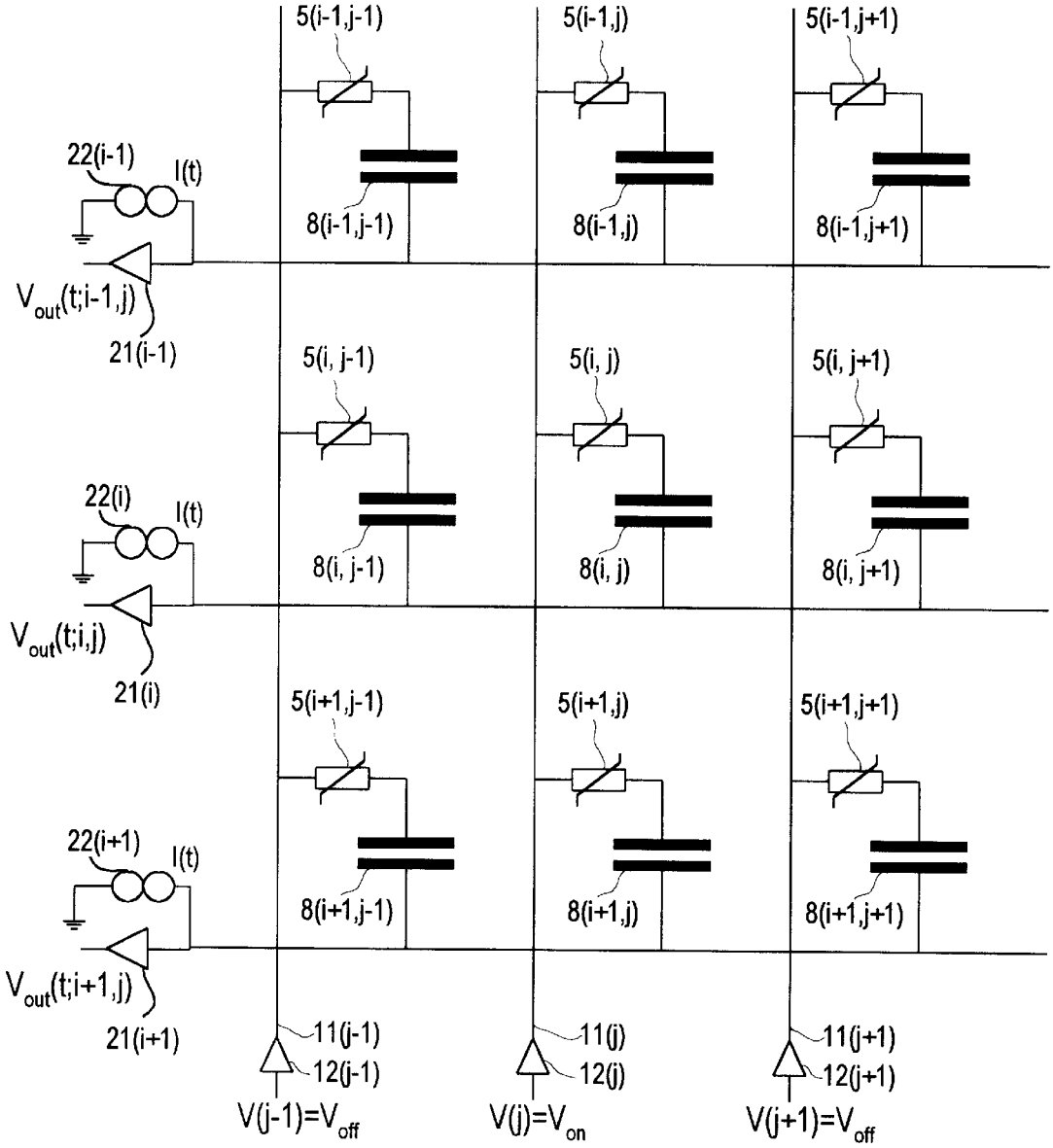
FIG. 8*a* shows a method to measure the threshold voltages of each switching diode in the matrix.
Figure 8C:
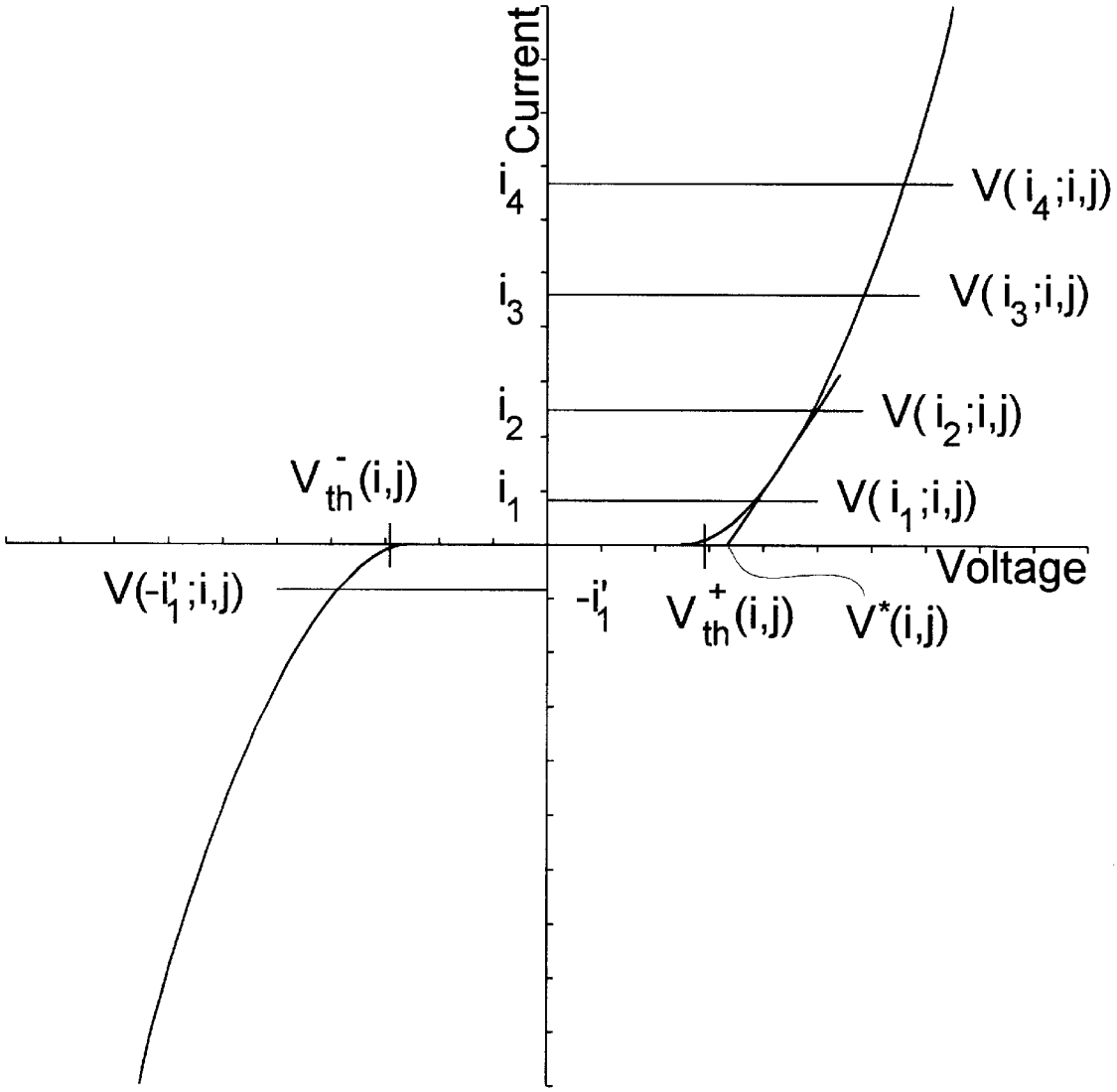
FIG. 8*c* shows the definition of $V_{th}^{+}(i,j)$, $V^{*}(i,j)$, $V(i_1;i,j)$ and several other related parameters.

We now turn to the discussion on how to measure the positive threshold voltage of a non-linear diode. The measurement of the negative threshold voltage follows the same principle. As shown in FIG. 8*a*, to measure the positive threshold voltage of the non-linear diode at pixel (i,j), a square wave current source i(t) is applied to the driving line for the i'th row, the driving line for the j'th column is applied with a negative voltage $-V_{on}$ which is negative enough to make the non-linear diodes at the i'th row and j'th column conducting, and all the rest column driving lines are applied to voltage $V_{off}$. A voltage preamplifier 21(*i*) is used to measure the voltage $V_{out}(t, i_p j)$ on the driving line for the i'th row. Assume that the square wave have a fundamental frequency $\omega_1$, and $i(t)=i_p f(t)$, where $f(t)=1$ if $n2\pi/\omega_1<t<(n+½)2\pi/\omega_1$ and $f(t)=0$ if $(n+½)2\pi/\omega_1<t<(n+1)2\pi/\omega_1$ (n is an integer). The wave form of i(t) and f(t) are indicated in FIG. 8*b*. If a Fourier transform is performed on the voltage $V_{out}(t;i,j)$ on the driving line for the i'th row, then, the real part and imaginary part of frequency component at $\omega_1$ is respectively given by:

$$Re[\tilde{V}_{out}(\omega_1;i,j)]=Re[\tilde{f}(\omega_1)]V(i_1;i,j)+Im[\tilde{f}(\omega_1)]_p/\omega_1 C(i,j)$$

$$Im[\tilde{V}_{out}(\omega_1;i,j)]=Im[\tilde{f}(\omega_1)]V(i_1;i,j)-Re[\tilde{f}(\omega_1)]_p/\omega_1 C(i,j),$$

$$Re[\tilde{V}_{out}(\omega_1;i,j)]=Re[\tilde{f}(\omega_1)]V(i_1;i,j)+Im[\tilde{f}(\omega_1)]_p/\omega_1 C(i,j)$$

$$Re[\tilde{V}_{out}(\omega_1;i,j)]=Re[\tilde{f}(\omega_1)]V(i_1;i,j)+Im[\tilde{f}(\omega_1)]_p/\omega_1 C(i,j)$$

where $\tilde{V}out(\omega_1;i,j)$ is the Fourier transform of $V_{out}(t;i,j)$, $\tilde{f}(\omega_1)$ is the Fourier transform of f(t), and C(i,j) is the capacitance of the LCD cell of the diode at the i'th row and j'th column. The definition of $V_{th}^+(i,j)$ and $V(i_1;i,j)$ are shown in FIG. 8*c*, and $V(i_1;i,j)$ is a good approximation of $V_{th}^+(i,j)$ if $i_1$ is small enough. By performing above measurement again with a different frequency $\omega_2$, $V(i_1;i,j)$ can be obtained:

$$V(i_1, i, j) = \frac{\omega_1 \operatorname{Re}[\tilde{V}_{out}(\omega_1; i, j)] - \omega_2 \operatorname{Re}[\tilde{V}_{out}(\omega_2; i, j)]}{\omega_1 \operatorname{Re}[\tilde{f}(\omega_1)] - \omega_2 \operatorname{Re}[\tilde{f}(\omega_2)]}$$

If $(i_1;i,j)$ is used to represent $V_{th}^+(i,j)$ approximately, the smaller the $i_1$ the better. Another way to improve the accuracy in determining $V_{th}^+(i,j)$ is to measure $V(i_2;i,j)$ at a different driver current $i_2$, and use linear approximation to determine V*(i,j), $$V^*(i, j) = \frac{i_2 V(i_1; i, j) - i_1 V(i_2, i, j)}{i_2 - i_1}$$

As shown in FIG. 8*c*, V*(i,j) is a good approximation of $V_{th}^+(i,j)$. One can improve further the accuracy in determining $V_{th}^+(i,j)$ by using parabolic approximation in which $V(i_1;i,j)$, $V(i_2;i,j)$ and $V(i_3;i,j)$ are measured. One can even use higher order polynomial approximation by measuring more than three points on the current-voltage characteristic curve. One can also use multiple points on the current-voltage characteristic curve in combination with a device model for the non-linear diode to determine the threshold voltage.

Figure 9:
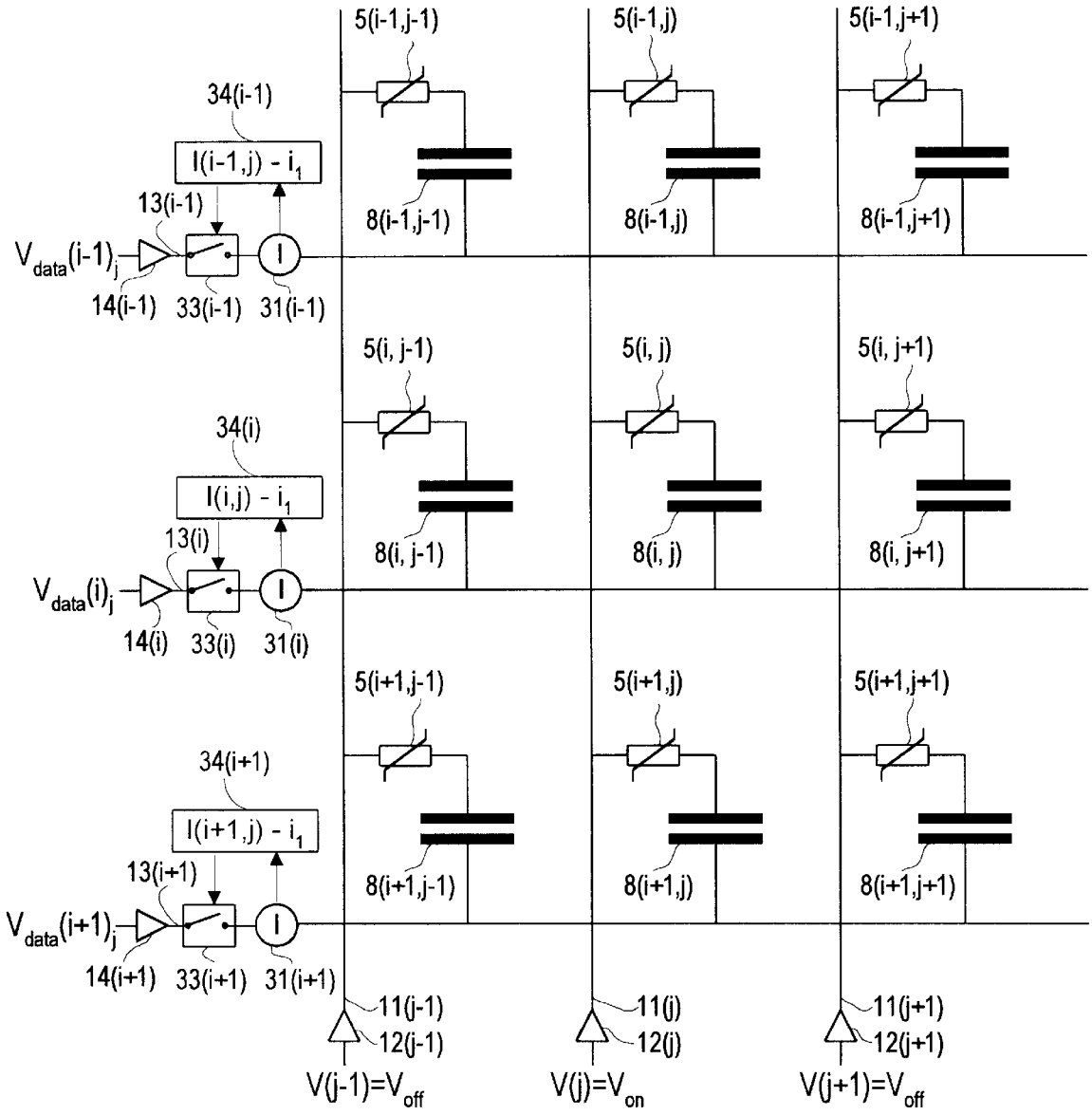
FIG. 9 shows the modified driver electronics that use $V(i_1;i,j)$ to determine the correct voltage applied to the LCD cell at i'th row and j'th column.

By modifying the driver electronics, it is possible to use $V(i_1;i,j)$ to characterize and calibrate the non-linear diode at pixel (i,j). FIG. 9 shows the modified driver electronics. In FIG. 9, the voltage on the driving line for the j'th column is set to a negative voltage $-V_{on}$ to select the LCD cells in the j'th column, and the row driving electronics are used to set the voltages on each LCD cells in the j'th column. As shown in the figure, the driving current in each row, say, the i'th row, is measured with a current detector 31(*i*), and the measured driving current i(i,j) is compared with a threshold current $i_1$ by using a comparator 34(*i*). The output of the comparator 34(*i*) is used to control a switch 33(*i*); and when the driving current is equal to or smaller than the threshold current $i_1$, the driving voltage source 14(*i*) will be disconnected. Using this driving electronics, the voltage applied to the LCD cell at pixel (i,j) is given by $V(i,j)=V_{data}^+(i)_j+V_{on}-V(i_1;i,j)$. Thus, one can store measured voltage $V(i_1;i,j)$ in calibration memory 70, and using $V(i_1;i,j)$ to calculate the correct driving voltage $V_{data}^+(i)_j$. Here the correct driving voltage $V_{data}^+(i)_j$ can be stored in video memory 80. If the LCD is driving alternatively with positive and negative voltage, then, two voltages $V(i_1;i,j)$ and $V(-i'_1;i,j)$ (defined in FIG. 8*c*) will need to be stored in calibration memory 70 for pixel (i,j), and two driving voltages $V_{data}^+(i)_j$ and $V_{data}^-(i)_j$ need to be calculated and stored in video memory 80 for pixel (i,j), where $V_{data}^+(i)_j=V_{target}(i,j)+V(i_1;i,j)-V_{on}$ and $V_{data}^-(i)_j=V_{target}(i,j)-V(-i'_1;i,j)+V'_{on}$.

Figure 10A:
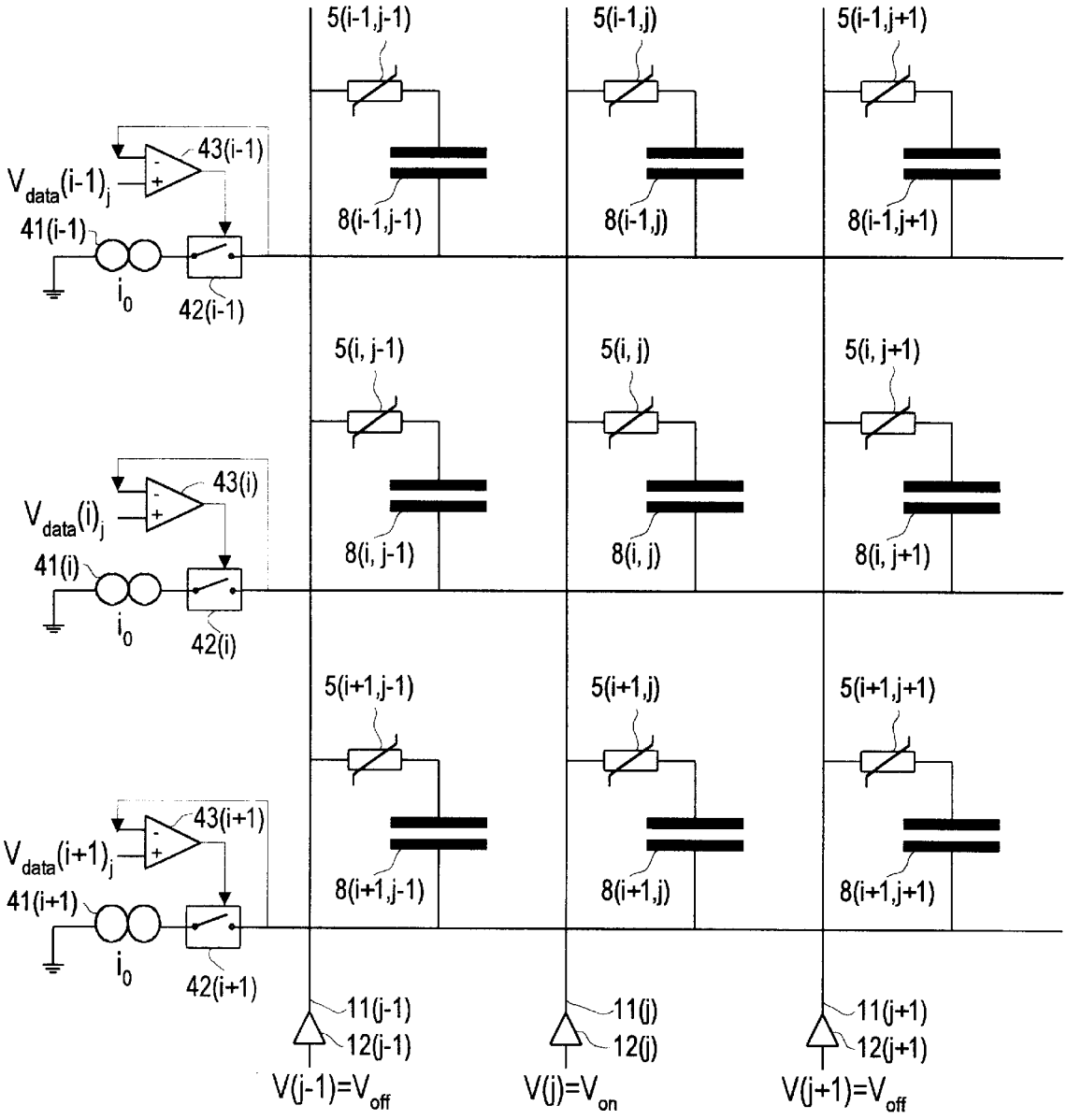
FIG. 10*a* shows the modified driver electronics that use a current source $i_0$ to charge each LCD cell and use $V(i_0;i,j)$ to determine the correct voltage applied to the LCD cell at i'th row and j'th column.
Figure 10B:
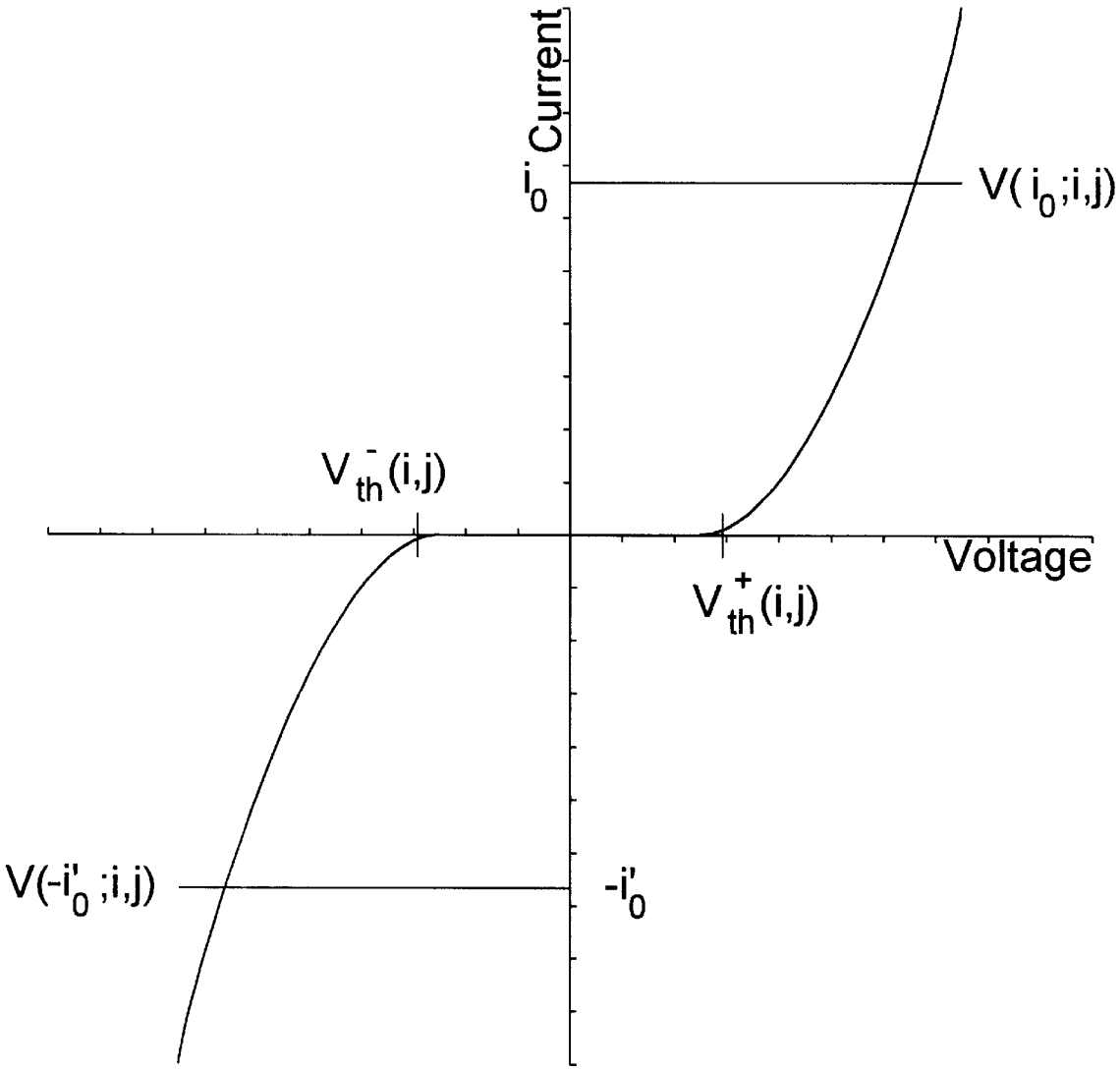
FIG. 10*b* shows the definition of $V(i_0;i,j)$.

By modifying the driver electronics, it is also possible to use $V(i_0;i,j)$ in a different manner. The modified driver electronics is shown in FIG. 10*a*. In FIG. 10*a*, each row driving line, say, the i'th row is driven by a constant current source 41(*i*) with a current output $i_0$. As shown in FIG. 10*b*, $i_0$ is relatively large and $V(i_o;i,j)$ can be significantly larger than the threshold voltage $V_{th}^+(i,j)$. The voltage $V(i_0;i,j)$ can be measured the same way as previously described and a larger $i_0$ only makes it easier for the previously described method to be performed. In FIG. 10*a*, the voltage on the row driving line, say, the i'th row, is measured by a voltage comparator 43(*i*), and the measured voltage (which is equal to $V(i,j)+V(i_0;i,j)-V_{on}$) is compared with a reference voltage $V_{data}^+(i)_j$; the output of the voltage comparator 43(*i*) is used to control a switch 42(*i*), and the current source will be turned off if the voltage on the row driving line is equal to or larger than the reference voltage. In real operation, $V(i_0;i,j)$ is measured and stored in calibration memory 70 for each pixel (i,j). For a target voltage $V_{target}(i,j)$ to be applied to LCD cell at pixel (i,j), the driving voltage $V_{data}^+(i)_j=V_{target}(i,j)+V(i_0;i,j)-V_{on}$ is then calculated based on the voltage $V(i_0;i,j)$ fetched from calibration memory 70, and the data-voltage $V_{data}^+(i)_j$ is then stored in video memory 80. When the target voltage V(i,j) is to be written to the LCD cell at pixel (i,j), data-voltage $V_{data}^+(i)_j$ is fetched from video memory 80 and applied to voltage comparator 43(*i*), and after switch 42(*i*) is turned off the voltage on the LCD cell at pixel (i,j) will be equal to the desired voltage $V_{target}(i,j)$, which is independent of the current-voltage characteristics of the switching diode at pixel (i,j). Once again, for practical operations, it is preferred to apply the positive voltage $V_{target}(i,j)$ and negative voltage $-V_{target}(i,j)$ alternatively to the LCD cell at pixel (i,j). In this case, again, two voltages $V(i_0;i,j)$ and $V(-i'_0;i,j)$ (defined in FIG. 10*b*) will need to be measured and stored in calibration memory 70 for pixel (i,j), and two driving voltages $V_{data}^+(i)_j$ and $V_{data}^-(i)_j$ need to be calculated and stored in video 80 for pixel (i,j), where $V_{data}^+(i)_j=V_{target}(i,j)+V(i_0;i,j)-V_{on}$ and $V_{data}^{-(i)}{}_j=V_{target}(i,j)-V(-i'_0;i,j)+V'_{on}$.

This last described method of storing in the calibration memory the two voltages $V(i_0;i,j)$ and $V(-i'_0;i,j)$ and using these two voltages to calculate the correct data-voltage voltage is the most, preferred method for the type of LCD embodiment in FIG. 1*a*.

Figure 11A:
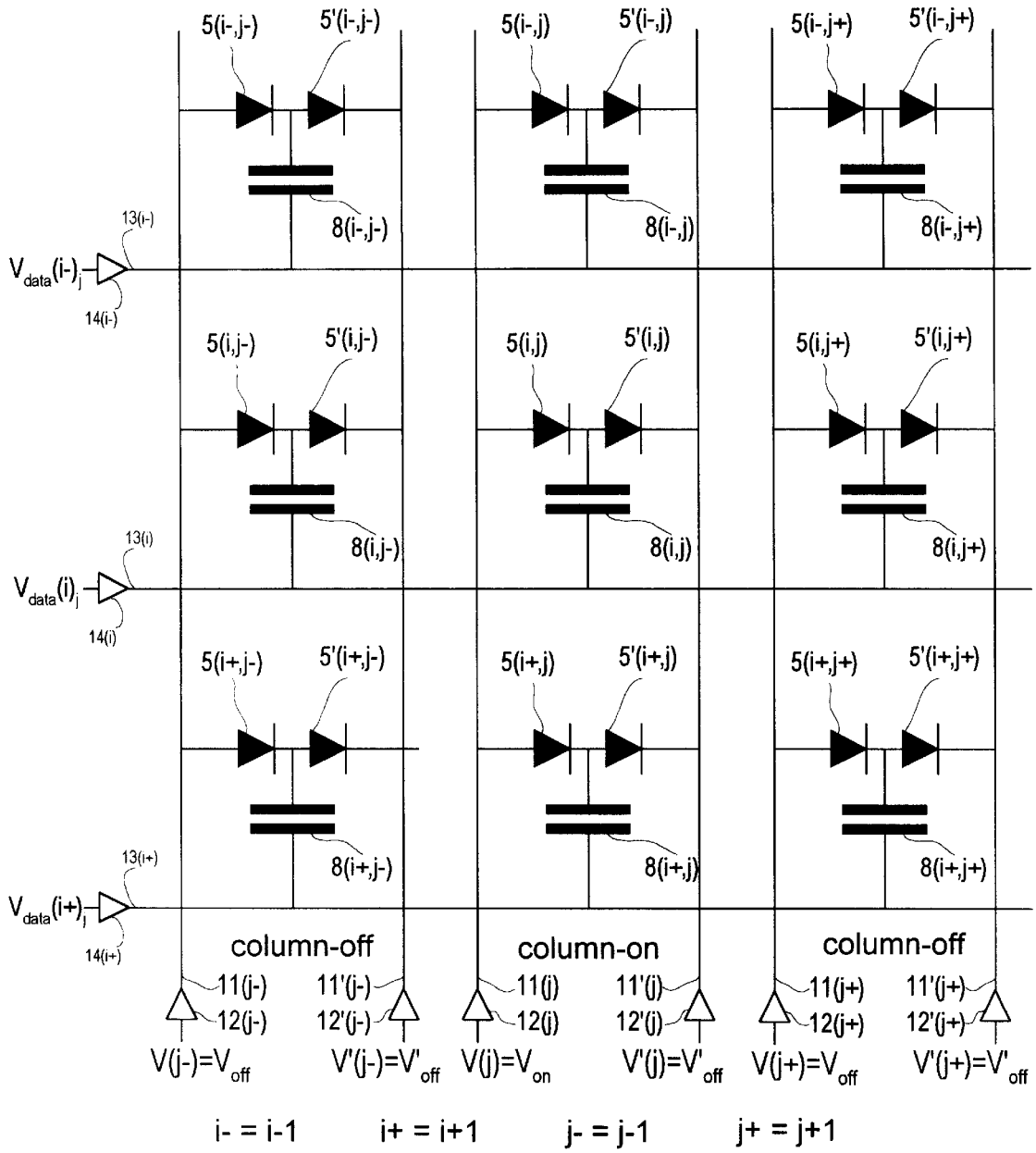
FIG. 11*a* shows an arrangement that use one diode to charge a LCD cell to a positive voltage and use another diode to charge a LCD to a negative voltage.

All the above described methods can be applied to other kinds of arrangement using two-terminal devices, such as the arrangement shown in FIG. 11*a*, which was originally described by Yaniv in 1986. One can measure and store in calibration memory 70 the threshold voltages $V_{th}^+(i,j)$ and $V_{th}^-(i,j)$ of diode 5(*i,j*) and 5'(*i,j*) respectively. FIG. 11*b* shows the current-voltage characteristic of diode 5(*i,j*) and 5'(*i,j*) respectively. By using threshold voltages $V_{th}^+(i,j)$ and $V_{th}^-(i,j)$, the correct driver voltages for drivers 14(*i*) can be calculated, and after that, the correct driver voltages for driver 14(*i*) will be stored in video memory 80. Driver 14(*i*) will use the correct driver voltages fetched from video memory 80 to drive the corresponding LCD cells. If driver

14(*i*) is replaced with driver electronics similar to those depicted in FIG. 9—with current detector 31(*i*), comparator 34(*i*) and switch 33(*i*), then, voltages $V(i_1;i,j)$ and $V(-i'_1;i,j)$ can be measured and stored in calibration memory 70, and these voltages $V(i_1;i,j)$ and $V(-i'_1;i,j)$ can later on be used to obtain the correct driver voltages. Similarly, if the driver 14(*i*) is replaced with driver electronics similar to those depicted in FIG. 10*a*—with voltage comparator 43(*i*), current source 41(*i*), and switch 42(*i*), then, voltages $V(i_0;i,j)$ and $V(-i'_0;i,j)$ can be measured and stored in calibration memory 70, and these voltages $V(i_0;i,j)$ and $V(-i_0;i,j)$ can later on be used to obtain the correct driving voltages. For the arrangement modified from that shown in FIG. 11*a*, such as the double-diode-plus-reset-circuit proposed by Philips (Kuijk 1990), all the above described methods can still be valid with some modifications.

In the above described examples about how to improve display uniformity, some implementation use a single voltage to characterize the characteristics of a pixel, and some others use a few data points on the current-voltage curve for the same purpose. And in fact, a complete table, which lists the correct driving parameters for any particular target voltage (say, a voltage out of 256 gray levels) on the capacitor, can be used to characterize the characteristics of a pixel, and in the calibration memory, each pixel is associated with its own table. This approach requires a very large calibration memory. To save memory, one can store a partial table in the calibration memory. The partial table store the correct driving parameters for selected number of target voltages; if the driver electronics need the correct driving parameter for a target voltage which is not listed, that correct driving parameter can be provided with a microprocessor, which calculate the correct driving parameter based on the parietal table by using linear approximation, parabola approximation, or a specific device model. Similarly, a complete table, which lists the correct driving parameter for any particular light intensity (say, one out of 256 gray levels), can be used to characterize the display characteristics of a pixel, or a partial table, which lists the correct driving parameter for selected light intensities, can be used to characterize the display characteristics of a pixel. And again, for a partial table, non-listed parameters can be provided by a microprocessor which perform the calculation based on the partial table.

Figure 12:
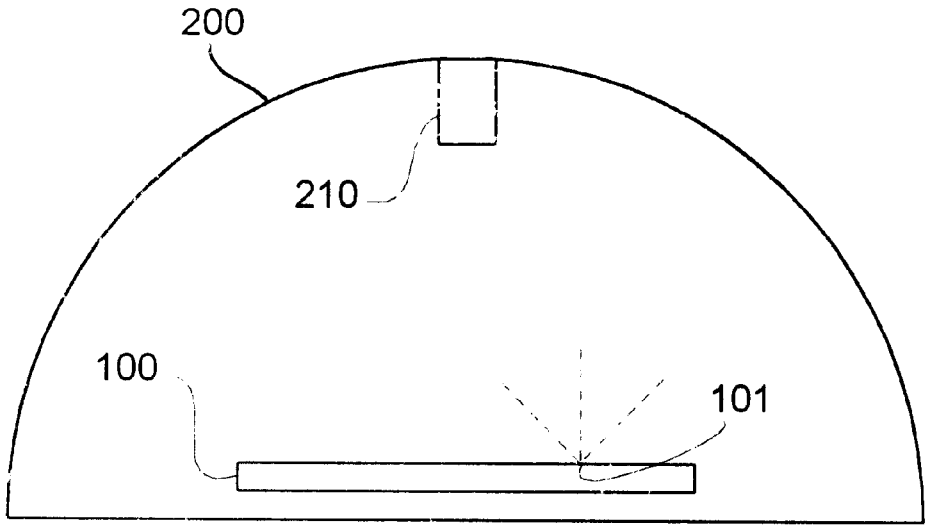
FIG. 12 shows that the display characteristics of each pixel is measured in a dark chamber.

As shown in FIG. 12, for a particular AM-LCD 100, to obtain a light-intensity versus driving-parameter table for a pixel 101, be it complete or partial, one can put AM-LCD 100 in a dark chamber 200 and use a photo detector 210 to measure the light intensities with a set of driving parameters for that pixel 101 while all the rest of pixels are completely turned off. And, one need to repeat the same procedure one pixel at a time, until the light-intensity versus driving-parameter tables of all pixels in the AM-LCD are measured. These steps of measuring display characteristics of each pixel in a AM-LCD can be performed in the factory before the AM-LCD is shipped. The measurement may need to be performed with different temperatures in the case that the display characteristics of each pixel is temperature dependent. The measured tables are stored in a permanent memory. Depend on the speed, the permanent memory can be used as the calibration memory directly, or can be used to transfer those stored tables into a separate calibration memory which usually is a faster RAM.

Once the curve of light-intensity versus driving-parameter of a particular pixel is measured, other calibration parameters can be derived from these raw data, and these derived calibration parameters can be stored in the calibration memory to characterize the display characteristics of that pixel. For example, for the embodiment of FIG. 2, rather than using circuitry of FIG. 5*a* and FIG. 5*b* to measure the reference voltage $V_{ref}(i,j)$ of pixel (i,j), it is possible to derive the reference voltage $V_{ref}(i,j)$ by conducting parameter-fittings on the curve of light-intensity versus driving-parameter, which can be measured by using the apparatus illustrated in FIG. 12. Similarly, other calibration parameters for other embodiments—such as, $V_{th}^{+}(i,j)$, $V_{th}^{-}(i,j)$, $V(i_1;i,j)$, $V(-i'_1;i,j)$, $V(i_0;i,j)$ and $V(-i'_0;i,j)$—can also be obtained by conducting parameter-fittings on the curve of light-intensity versus driving-parameter.

By storing more data points into calibration memory 70 to describe the display characteristics of each pixel, it is possible to design more advanced circuitry for each pixel element, and based on these circuitry, it is possible to design an AM-LCD with almost perfect display uniformity even by using modest quality nonlinear elements.

In all the embodiment described so far, by calibrating the display characteristics of individual pixel, it is possible to design an AM-LCD with almost perfect display uniformity, provided that diodes with reasonable quality are used. Take an example of the embodiment illustrated in FIG. 2: when a particular pixel is in charging-on mode as shown in FIG. 3*a*, the capacitor 8(*i,j*) will be charged towards a voltage $V(i,j)=V_{data}(i)-V_{ref}(i,j)$ exponentially with a time constant $R_{on}(i,j)C$, and when a particular pixel is in charging-off mode as shown in FIG. 3*b*, the capacitor 8(*i,j*) can still be charged by a leakage current $I_{leak}(i,j)=[V_{data}(i)_j-V'_{ref}(i,j)]/R_{off}(i,j)$. For good quality diodes with very large $R_{off}(i,j)$, the voltage changes across capacitor 8(*i,j*) due to the leakage currant through $R_{off}(i,j)$ can be practically neglected. If there are 1000 columns, and assume the display need to be refreshed 30 times in a second, then, when a pixel element is in charging-on mode, capacitor 8(*i,j*) need to be charged to the target voltage within a time period smaller than 1/(1000×30) of a second. If we chose the time constant $R_{on}(i,j)C$ to be ⅕ of that allocated time period, then, $R_{on}(i,j)C=1/(1000\times30\times5)$. During most of the time period T=1/30 second that a frame is refreshed, a pixel element is in charging-off mode, and actually, the time period that it is in charging-off mode is 999 times the time period that it is in charging-on mode. To make the leakage current negligible, the voltage changes due to the leakage current has to be smaller than the voltage differences between. two adjacent gray levels, which usually is less than 1/256 volt. If we chose the typical target voltage to be 3 V, and in the worst case scenario, it requires that $$[999/(1000\times30)]\times[3V/R_{off}(i,j))]/C<1/256\ V.$$

Substituting $1/C=(1000\times30\times5)\ R_{on}(i,j)$ into the above condition, we have the condition $$R_{on}(i,j)/R_{off}(i,j)<[(1/256\ V)/3V][1/999][1/5]\approx2\times10^{-7}.$$

Figure 19:
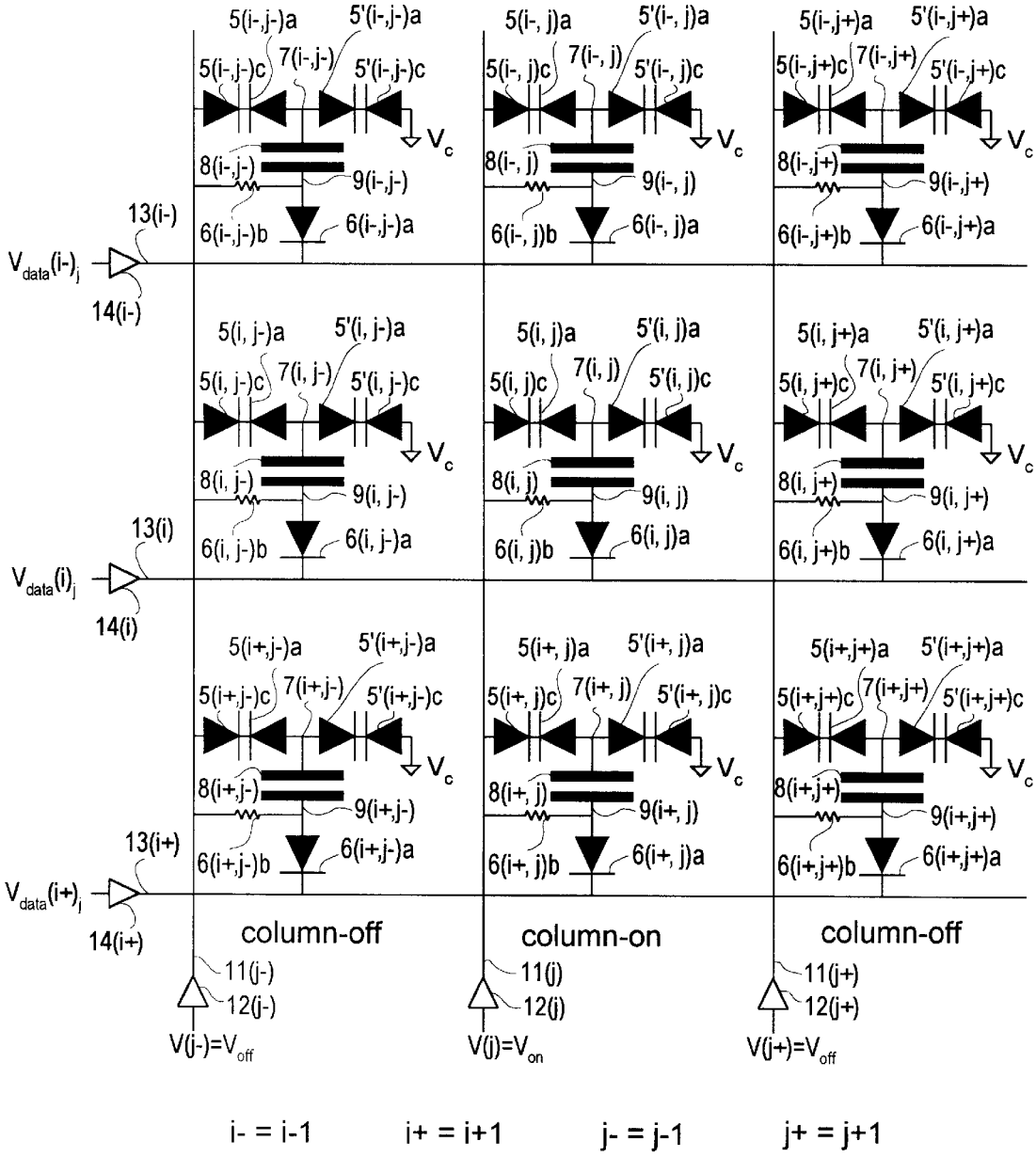
FIG. 19 shows another embodiment of AM-LCD based on two-terminal non-linear elements of modest quality.

Even though it is possible to make pn diodes and MIM diodes with $R_{on}(i,j)/R_{off}(i,j)$ smaller than $2\times10^{-7}$ by using existing technologies, the manufacture techniques used to make these low leakage diodes, nevertheless, is somewhat demanding. By using more advanced circuitry design for each pixel element in combination with more complicated calibration techniques for each pixel element, it is possible to design an AM-LCD with almost perfect display uniformity even by using modest quality diodes, and two example designs are shown in FIG. 13 and FIG. 19.

Figure 13:
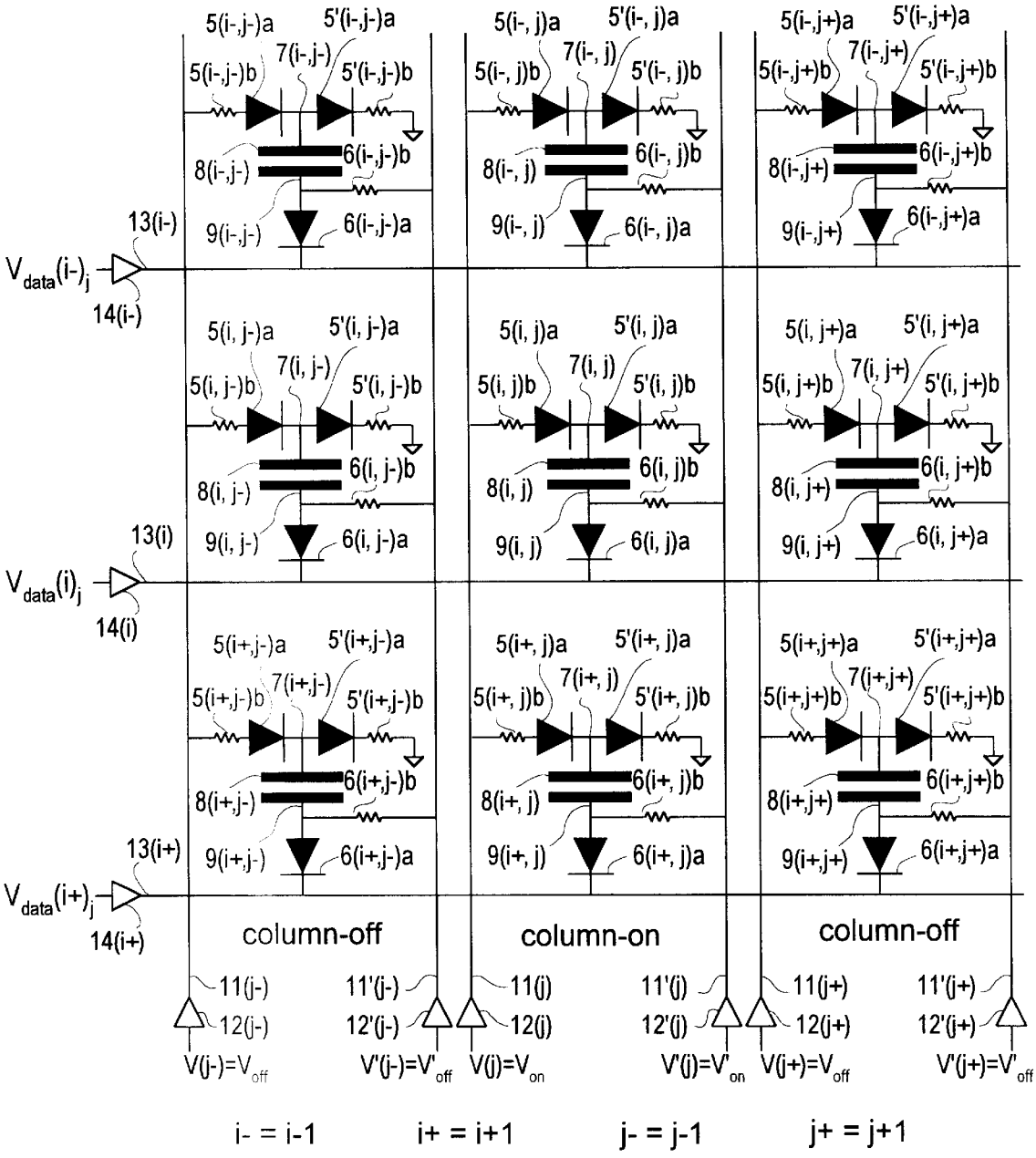
FIG. 13 shows an embodiment of AM-LCD based on two-terminal non-linear elements of modest quality.

As shown in FIG. 13, the LCD consists of an array of row driving lines 13(*i*) and two array of column driving lines 11(*j*) and 11'(*j*). The row driving lines and column driving lines form a matrix structure. The driving line for the i'th row is 13(*i*), and driving lines for the j'th column are 11(*j*) and 11'(*j*). The cross position between the driving line for the i'th row and driving lines for the j'th column defines a pixel element (i,j).

Associated with each pixel element (i,j). there is a storage capacitor 8(*i,j*) with terminal one 7(*i,j*) and terminal two 9(*i,j*), a first non-linear element consisting of a pn diode 5(*i,j*)*a* and a resistor 5(*i,j*)*b*, a second non-linear element consisting of a pn diode 5'(*i,j*)*a* and a resistor 5'(*i,j*)*b*, a third non-linear element 6(*i,j*)*a*, and a resistor 6(*i,j*)*b*. One terminal of the first non-linear element is connected to terminal one 7(*i,j*) of capacitor 8(*i,j*), and the other terminal of the first non-linear element is connected to the first column driving line 11(*j*). One terminal of the second non-linear element is also connected to terminal one 7(*i,j*) of capacitor 8(*i,j*), and the other terminal of the second non-linear element is connected to a common voltage, which can be the ground voltage. The terminal two 9(*i,j*) of capacitor 8(*i,j*) is connected to one terminal of the third non-linear element 6(*i,j*)*a*. The terminal two 9(*i,j*) of capacitor 8(*i,j*) is also connected to one terminal of resistor 6(*i,j*)*b*. The other terminal of resistor 6(*i,j*)*b* is connected to the second driving line 11'(*j*), and the other terminal of the third non-linear element 6(*i,j*)*a* is connected to the driving line 13(*i*) for the i'th row. Each column driving fine 11(*j*) is connected to a voltage driver 12(*j*), each column driving line 11(*j*) is connected to a voltage driver 12'(*j*), and each row driving Vine 13(*i*) is connected to a voltage driver 14(*i*). The purpose of the first and second non-linear elements is to effectively connect the terminal one 7(*i,j*) to the ground with low impedance when that terminal is selected with driving line 11(*j*) and 11'(*j*), and isolate that terminal to the ground with high impedance. When that terminal is not selected. The purpose of the third non-linear element is to effectively connect the terminal two 9(*i,j*) to row driving line 13(*i*) when pixel (i,j) is selected, and to effectively isolate the terminal two 9(*i,j*) from row driving line 13(*i*) when pixel (i,j) is not selected.

Any pixel element can be either in charging-on mode or charging-off mode. For all the pixel elements in a column, the two driving lines for that column controls which of the two modes will be for those pixel elements in that column. When a pixel element is in charging-on mode, the capacitor of that pixel element can be charged by the voltage on the row's driving line connected to that pixel element. When a pixel element is in charging-off mode, the voltage on the capacitor of that pixel element is maintained, and that voltage is hardly influenced by the voltage on the row's driving line connected to that pixel element.

Figure 14A:
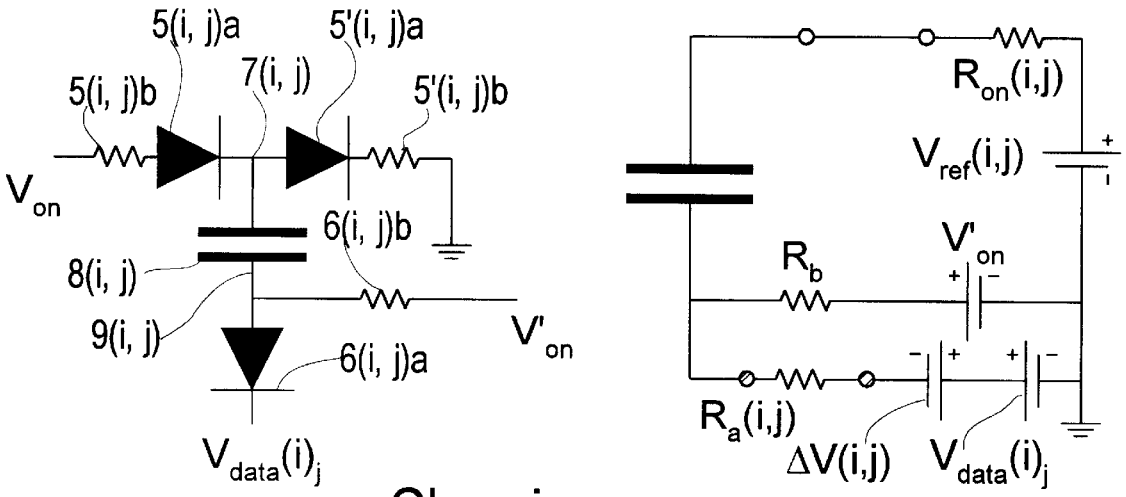
FIG. 14*a* shows the equivalent circuit of a pixel element in FIG. 13 when that pixel element is in charging-on mode.

FIG. 14*a* shows the equivalent circuit of a pixel element (i,j) when that pixel element is in charging-on mode. In FIG. 14*a* when on-voltage $V_{on}$ is applied to the first column driving line 11(*j*) to drive both the first and second non-linear elements into the conducting state, the terminal one 7(*i,j*) of the capacitor 8(*i,j*) is equivalently connecting to a reference voltage $V_{ref}(i,j)$ though a low impedance $R_{on}(i,j)$; and if at the same time another on-voltage $V'_{on}$ is applied to the second column driving line 11'(*j*) to drive the third non-linear element into the conducting state, then, by applying a data voltage $V_{data}(i)_j$ to row driving line 13(*i*), capacitor 8(*i,j*) will be charged to a voltage $V(i,j)=V_{data}(i)_j-V_{ref}(i,j)-\Delta V(i,j)$ exponential with a time constant $R_{on}(i,j)C$, where; $\Delta V(i,j)$ is the voltage drop across the third non-lineal element 6(*i,j*)*a*.

Figure 14B:
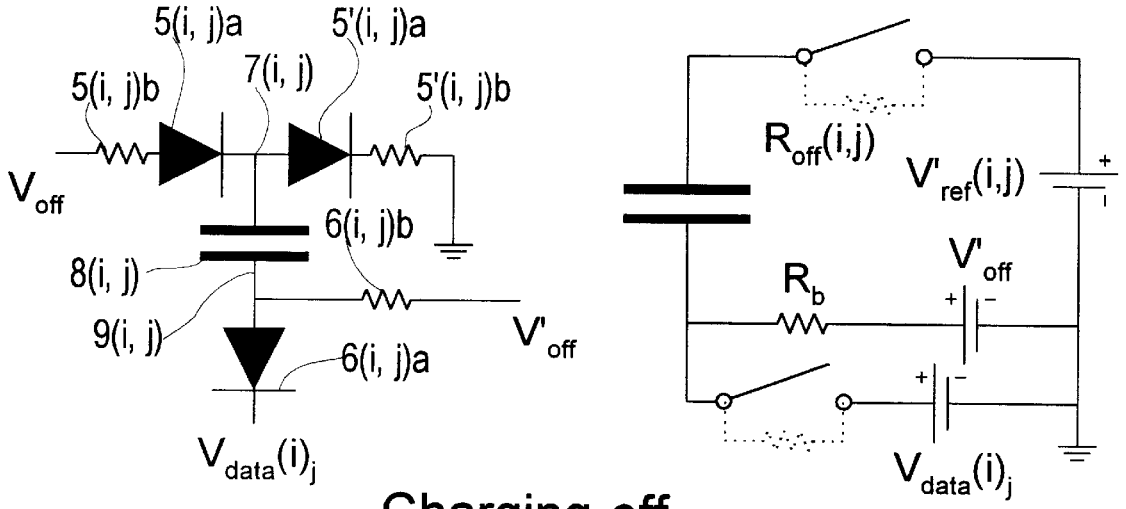
FIG. 14*b* shows the equivalent circuit of a pixel element in FIG. 13 when that pixel element is in charging-off mode.

FIG. 14*b* shows the equivalent circuit of a pixel element (i,j) when that pixel element is in charging-off mode. In FIG. 14*b*, when off-voltage $V_{off}$ is applied to the first column driving line 11(*j*) to drive both the first and second non-linear elements into the non-conducting state, the terminal one 7(*i,j*) of the capacitor 8(*i,j*) is equivalently connecting to a reference voltage $V'_{ref}(i,j)$ though a very high impedance $R_{off}(i,j)$; and if at the same time another off-voltage $V'_{off}$ is applied to the second column driving line 11'(*j*) to drive the third non-linear element into the non-conducting state to effectively isolate the terminal two 9(*i,j*) from row driving line 13(*i*), then, no mater what data voltage $V_{data}(i)$ is set on the second terminal of the third non-linear element 6(*i,j*)*a*, the voltage change across that capacitor 8(*i,j*) is still independent of data voltage $V_{data}(i)_j$. And in fact, the voltage across that capacitor 8(*i,j*) can only change very little by a very small leakage current $I_{leak}(i,j)=[V'_{off}-V'_{ref}(i,j)]/R_{off}(i,j)$, and for good quality diodes with very large $R_{off}(i,j)$, such small voltage changes across capacitor 8(*i,j*) can be practically neglected. Even if modest quality diodes are used such that the leakage current $I_{leak}(i,j)$ through $R_{off}(i,j)$ can not be neglected, small voltage changes across capacitor 8(*i,j*) are still independent of the data voltage $V_{data}(i)_j$. And since the voltage changes across capacitor 8(*i,j*) are independent of the data voltage $V_{data}(i)_j$, the display characteristics of every pixel can be easily calibrated.

To teach more effectively the sample design of FIG. 13, we will show a specific selection of the on-voltages ($V_{on}$ and $V'_{on}$) and the off-voltages ($V_{off}$ and $V'_{off}$). Assume that the common voltage that the second non-linear element connected to is chosen to be the ground voltage 0V. For the charging-on state, an on-voltages $V_{on}$ of +12V can drive both the first and second non-linear elements into the conducting states. If $V_{ref}(i,j)$ is in the range between +5V to +7V and if the voltage across the capacitor 8(*i,j*) needs to be between −3V to +3V, then, the voltage applied to the second terminal 9(*i,j*) of the capacitor 8(*i,j*) need to be in the range between +2V to +10V. If the voltage drop across the third non-linear element while in the conducting state is 0.7V, then, the data-voltage $V_{data}(i)_j$ should be in the range from +2.7V to +10.7V. The second on-voltage $V'_{on}$ of the value +12V will be able to drive the third non-linear element 6(*i,j*)*a* into the conducting state. When the third non-linear element 6(*i,j*)*a* is in the conducting state, the data-voltage $V_{data}(i)_j$ will be effectively connected to the second terminal 9(*i,j*) of capacitor 8(*i,j*), albeit though an equivalent small resistor $R_a(i,j)$ with a voltage drop $\Delta V(i,j)$. For the charging-off state, an off-voltages $V_{off}$ of −12V can drive both the first and second non-linear elements into the non-conducting states. If the second off-voltage $V'_{off}$ is selected to be −6V, then, the data-voltage $V_{data}(i)_j$ in the range from +2.7V to +10.7V can not drive the third non-linear element into the conducting state, and thus, the data-voltage $V_{data}(i)_j$ is isolated from the second terminal 9(*i,j*) of capacitor 8(*i,j*). Because the voltage across capacitor 8(*i,j*) is in the range from −3V to +3V and the voltage at the second terminal 9(*i,j*) of capacitor 8(*i,j*) is −6V, therefore, the voltage at the first terminal 7(*i,j*) of capacitor 8(*i,j*) is in the range between −9V to −3V, and this voltage can not drive the first or the second non-linear element into the conducting state.

The major advantage of the embodiment in FIG. 13 over the embodiment in FIG. 2 is that the display characteristics of pixel (i,j) in FIG. 13 only depend on the data-voltage $V_{data}(i)_j$ for the pixel (i,j), it do not depend on the data-voltages for other columns. Even in the case that the off-resistance $R_{off}(i,j)$ is only modestly large such that $\tau(i,j)=R_{off}(i,j)C(i,j)$ are comparable to or smaller than the time period T=1/30 over which one frame of imaging is displayed and the light intensity decays during the time period T, the light intensity still only depend on the data-voltage for that pixel alone. Because the data-voltage on the i'th row are applied one by one for each column, the voltage $V_i(t)$ on the driving line for the i'th row are therefor time dependent. Assume the total number of column is M, if from $t=t_0$ to $t=t_0+T/M$, data-voltage $V_{data}(i)_1$ for the first column are applied to the driving line for the i'th row, then, $$V_i(t)=V_{data}(i)_1 \text{ for } t_0 t<t_0+T/M$$

$$V_i(t)=V_{data}(i)_2 \text{ for } t_0+T/M<t<t_0+2T/M$$

$$V_i(t)=V_{data}(i)_3 \text{ for } t_0+2T/M<t<t_0+3T/M$$

$$V_i(t)=V_{data}(i)_j \text{ for } t_0+(j-1)T/M<t<t_0+(j)T/M$$

$$V_i(t)=V_{data}(i)_M \text{ for } t_0+(M-1)T/M<t<t_0+T$$

Clearly the wave form of $V_i(t)$ depend on the imaging pattern to be displayed. For the embodiment in FIG. 2, with equivalent circuit in FIG. 3*b* for charging-off mode, after capacitor 8(*i,j*) is charged to a voltage $V(i,j;t_0+T/M)$ at time $t_0+T/M$. the voltage V(i,j;t) across capacitor 8(*i,j*) at time t changes according to equation $$V(i,\ j;\ t)=e^{-t/\tau(i,j)}\int_{t_0+T/M}^{t} e^{\tau/\tau(i,j)}V_i(t)\,d\tau/\tau(i,\ j)+V(i,\ j;\ t_0+T/M).$$

If the off-resistance $R_{off}(i,j)$ is very large, the first term in the above equation can be neglected and the voltage V(i,j;t) will maintain a constant $V(i,j;t_0+T/M)$. For very large $R_{off}(i,j)$, once the voltage across capacitor 8(*i,j*) is set to the target voltage, it will remain at that target voltage. However, if $R_{off}(i,j)$ is not large enough, even if the voltage across capacitor 8(*i,j*) is set to a target voltage at the instance $t_0+T/M$, the voltage across capacitor 8(*i,j*) will change over the time period T, and making matters even worse, that voltage changes across capacitor 8(*i,j*) depend on the voltage $V_i(t)$ on the driving line for the i'th row. Even though it is still possible to calibrate each pixel to give the correct luminosity for the embodiment in FIG. 2, once time constant $\tau(i,j)$ is measured, but this calibration process need to use imaging information such as the data-voltages for all the other element in the I'th row, and calculation process can be very complicated.

For the embodiment in FIG. 13, the calibration process can be much simpler. In particular, the light intensity of pixel (i,j) do not depend on the voltage $V_i(t)$ on the driving line for the i'th row once the voltage across capacitor 8(*i,j*) is set, and as a consequence, the intensity of pixel (i,j) do not depend on the data-voltage for the other pixels in the i'th row. More specifically, the voltage V(i,j;t) across capacitor 8(*i,j*) changes according to equation $$V(i,\ j;\ t)=e^{-t/\tau(i,j)}\int_{t_0+T/M}^{t} e^{\tau/\tau(i,j)}V'_{off}\,d\tau/\tau(i,\ j)+V(i,\ j;\ t_0+T/M).$$

The perceived intensity for pixel (i,j) is the average light intensity averaged over time period T. Assume that the curve of light intensity versus capacitor voltage is L=f(V), then, perceived intensity $\overline{L}(i,j)$ is given by $$\overline{L}(i,j)=1/T\int_{t_n}^{t_0-T} f(V(i,j;t))dt=f(V(i,j;t_0+T/M);\ \tau(i,j)).$$

This curve of the perceived intensity $\overline{L}(i,j)$ versus the initial voltage $V(i,j;t_0+T/M)$ can be considered as the display characteristics of the pixel (i,j), and it can be used to calibrate pixel (i,j). But, for the embodiment in FIG. 13, with the equivalent of charging-on mode shown in FIG. 14*a*, the initial voltage $V(i,j;t_0+T/M)$ is set by the data-voltage $V_{data}(i)_j$ with additional correction terms such as the reference voltage $V_{ref}(i,j)$ and the voltage drop $\Delta V(i,j)$ across the third non-linear element 6(*i,j*)*a* with the relationship given by $V(i,j;t_0)=V_{data}(i)_j-V_{ref}(i,j)-\Delta V(i,j)$, where the voltage drop $\Delta V(i,j)$ may depend on the data-voltage $V_{data}(i)_j$. Therefore, it is much easier to use the curve of $\overline{L}(i,j)$ versus $V_{data}(i)_j$ to characterize the display characteristics of pixel (i,j) than to use the curve of $\overline{L}(i,j)$ versus $V(i,j;t_0+T/M)$.

Figure 15A:
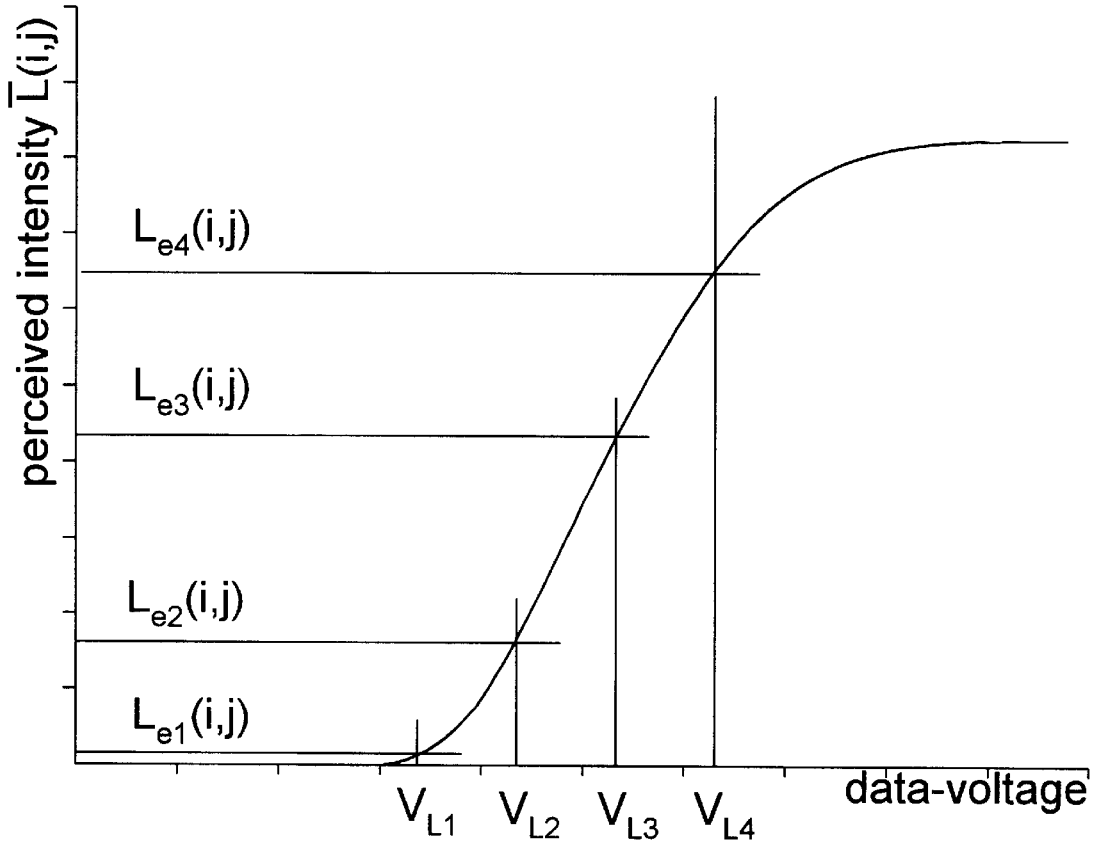
FIG. 15*a* shows that the display characteristics of a pixel is measured by measuring the light intensity of that pixel under several selected data-voltages.

The curve of $\overline{L}(i,j)$ versus $V_{data}(i)_j$ can be measured experimentally by using the measurement apparatus illustrated in FIG. 12. As shown in FIG. 12, to measure the curve of $\overline{L}(i,j)$ versus $V_{data}(i)_j$, first, one need to put AM-LCD 100 in dark chamber 200, and use photo detector 210 to measure the light intensities of pixel (i,j), with the data-voltage $V_{data}(i)_j$ equal to a set of voltage values (such as $V_{L1}$, $V_{L2}$, $V_{L3}$, . . . ), for an averaging time equal to the multiples of the frame period T (e.g. T, 2T, 3T, et. al.), while all the rest of pixels are completely turned off. As shown in FIG. 15*a*, the measured value of $\overline{L}(i,j)$ for $V_{data}(i)_j=V_{L1}$ is $L_{e1}(i,j)$, $\overline{L}(i,j)$ for $V_{data}(i)_j=V_{L2}$ is $L_{e2}(i,j)$, . . . and $\overline{L}(i,j)$ for $V_{data}(i)_j=V_{LH}$ is $L_{eH}(i,j)$, where H is the number of points on the display characteristic curve measured for each pixel. The number of points on the display characteristics need to be measured depend on the non-linearity of the display curve and the required display resolution (e.g. 4 bit or 8 bit). These measured numbers are stored in a memory for further processing. If the number of row is N and the number of column is M, then a total of N*M*H numbers are stored in the memory.

Figure 15B:
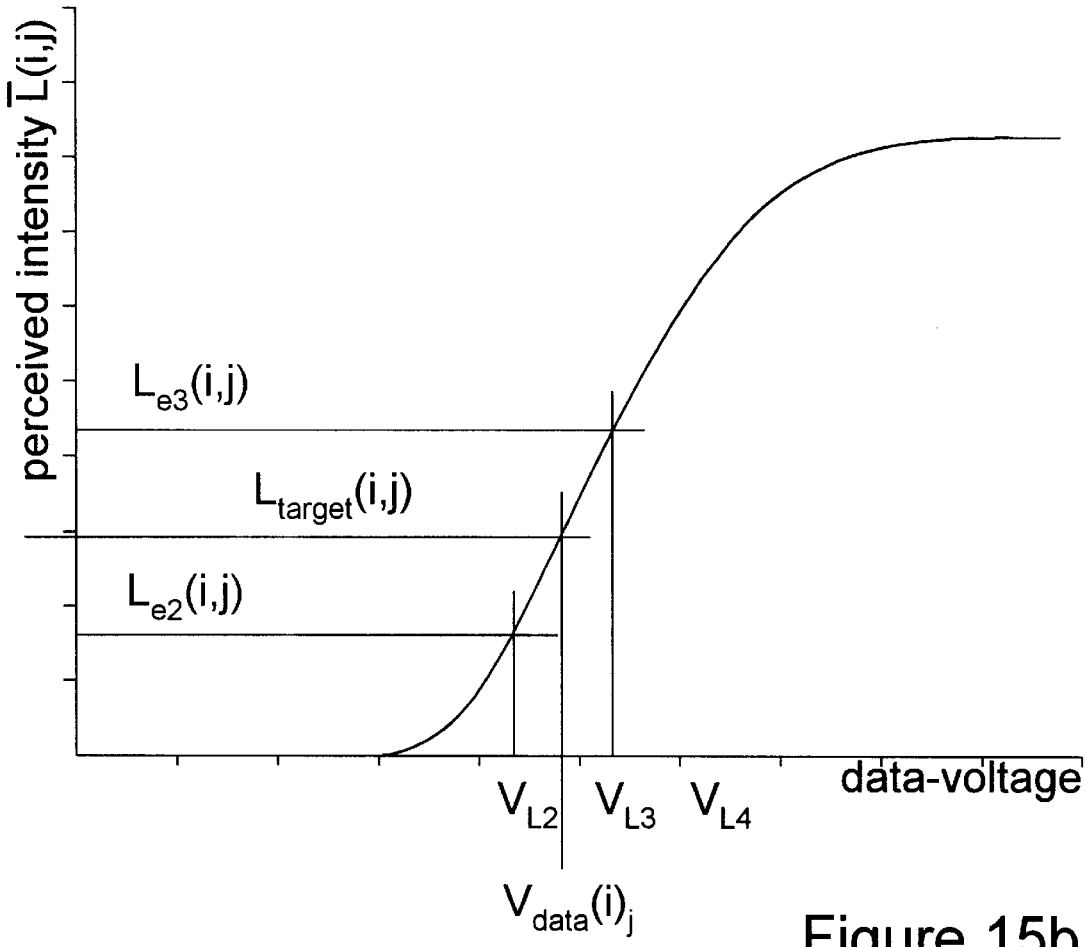
FIG. 15*b* shows one can use linear approximation and measured data points to calculate the correct data-voltage $V_{data}(i)_j$ that will provide the desired light intensity $L_{target}(i,j)$.

After the measurement of the display curves of all pixels, the correct data-voltage for any desired intensity for any pixels can be calculated. For example, for pixel (i,j) at the i'th row and the j'th column, to calculate the correct data-voltage for a desired intensity $L_{target}(i,j)$, one first compare the desired intensity $L_{target}(i,j)$ with all the measured intensity $L_{e1}(i,j)$, $L_{e2}(i,j)$, $L_{e3}(i,j)$, . . . , and $L_{eH}(i,j)$. Suppose that $L_{target}(i,j)$ happen to be between $L_{e2}(i,j)$ and $L_{e3}(i,j)$, as shown in FIG. 15*b*, then, one can simply use linear approximation to calculate the correct data-voltage $V_{data}(i)_j$, which is given by $$V_{data}(i)_j=\frac{V_{L3}[L_{target}(i,\ j)-L_{e2}(i,\ j)]+V_{L2}[L_{e3}(i,\ j)-L_{target}(i,\ j)]}{L_{e3}(i,\ j)-L_{e2}(i,\ j)}.$$

Or, to increase the accuracy in calculating $V_{data}(i)_j$, one can use parabola approximation or other higher order approximations. For polynomial approximation with order H, the correct data-voltage $V_{data}(i)_j$ is given by $$V_{data}(i)_j=\frac{[L_{e2}(i,\ j)-L_{target}(i,\ j)][L_{e3}(i,\ j)-L_{targe}(i,\ j)]\cdots[L_{eH}(i,\ j)-L_{target}(i,\ j)]}{[L_{e2}(i,\ j)-L_{e1}(i,\ j)][L_{e3}(i,\ j)-L_{e1}(i,\ j)]\cdots[L_{eH}(i,\ j)-L_{e1}(i,\ j)]}V_{L1}+$$

$$\frac{[L_{e1}(i,\ j)-L_{target}(i,\ j)][L_{e3}(i,\ j)-L_{targe}(i,\ j)]\cdots[L_{eH}(i,\ j)-L_{target}(i,\ j)]}{[L_{e1}(i,\ j)-L_{e2}(i,\ j)-L_{e2}(i,\ j)][L_{e3}(i,\ j)-L_{e2}(i,\ j)]\cdots[L_{eH}(i,\ j)-L_{e2}(i,\ j)]}V_{L2}+\ldots$$

One can even use more complicated algorithm, such as, the algorithm of using least square fit in combination with device models to calculate the correct data-voltage $V_{data}(i)_j$ that can achieve the desired intensity $L_{target}(i,j)$.

There are generally two methods of using the measured display curve to provide a perfectly uniform display. With method one, for every pixel in the display, the correct data-voltages for all gray levels are calculated; these correct data-voltages are used as calibration parameters directly and stored as complete look-up tables in a calibration memory for future use; and one will use the complete look-up table to find the correct data-voltages without the need to perform additional calculation. With method two, for every pixel in the display, calibration parameters are calculated and stored as partial look-up tables in a calibration memory for future use; and one will use the partial look-up table in combination with some additional calculation in real time to find the correct data-voltages. As for the calibration parameters, the correct data-voltages for selected number of gray levels can be calculated and used as the calibration parameters, or other model-dependent parameters can be calculated and used as the calibration parameters as well.

If there is no pixel degrading effect, the above described look-up tables need to be calculated only once, and these look-up tables can be stored in a permanent memory, such as ROM, or hard disk. If the look-up tables are stored in a slower permanent memory, say, hard disk, the look-up tables will have to be loaded into a faster RAM from the permanent memory, and use this RAM as the calibration memory.

Figure 16A:
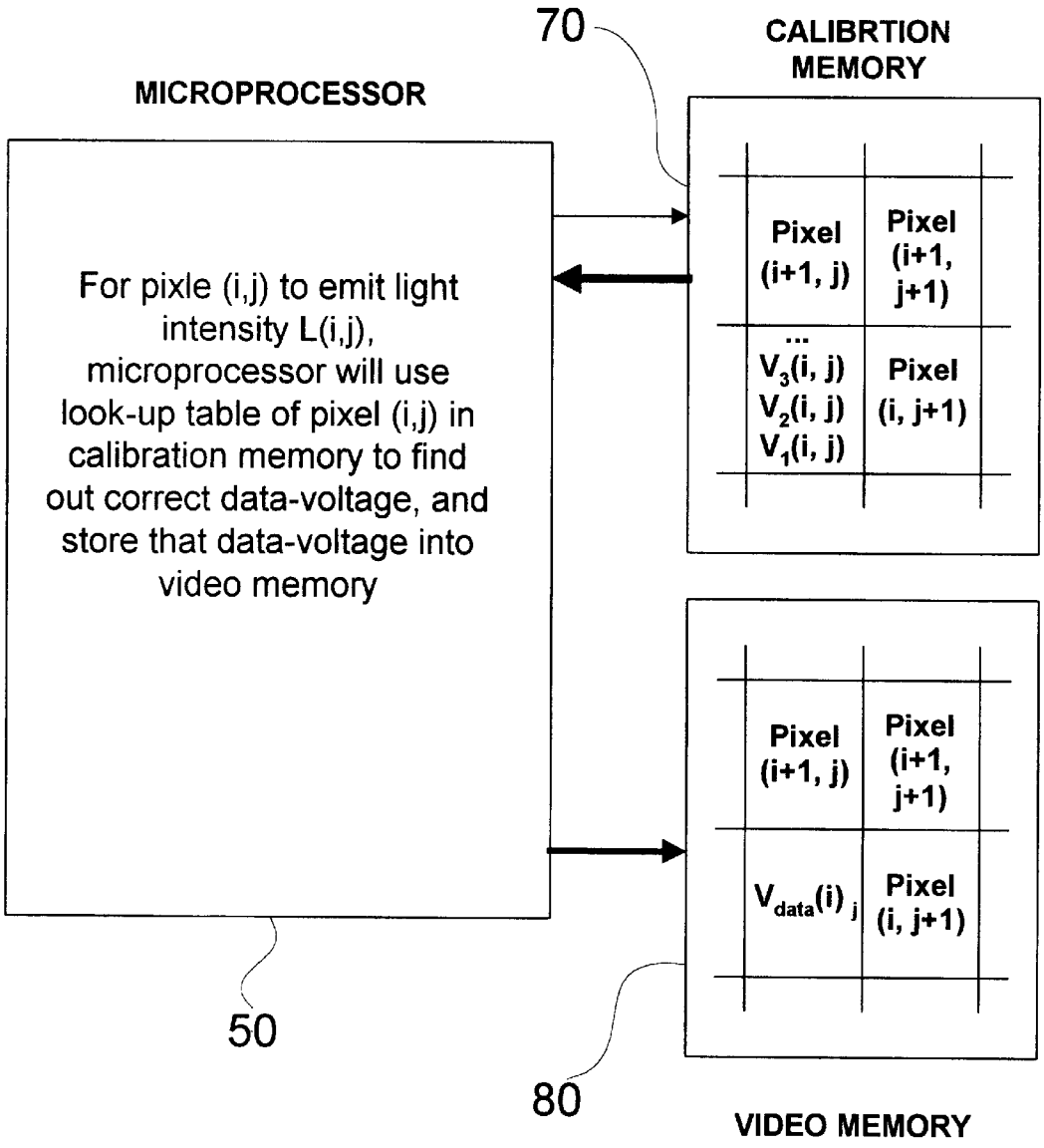
FIG. 16*a* shows that a microprocessor use the look-up table in the calibration memory to find out the correct data-voltage, and store the correct data-voltage into the video memory.
Figure 16B:
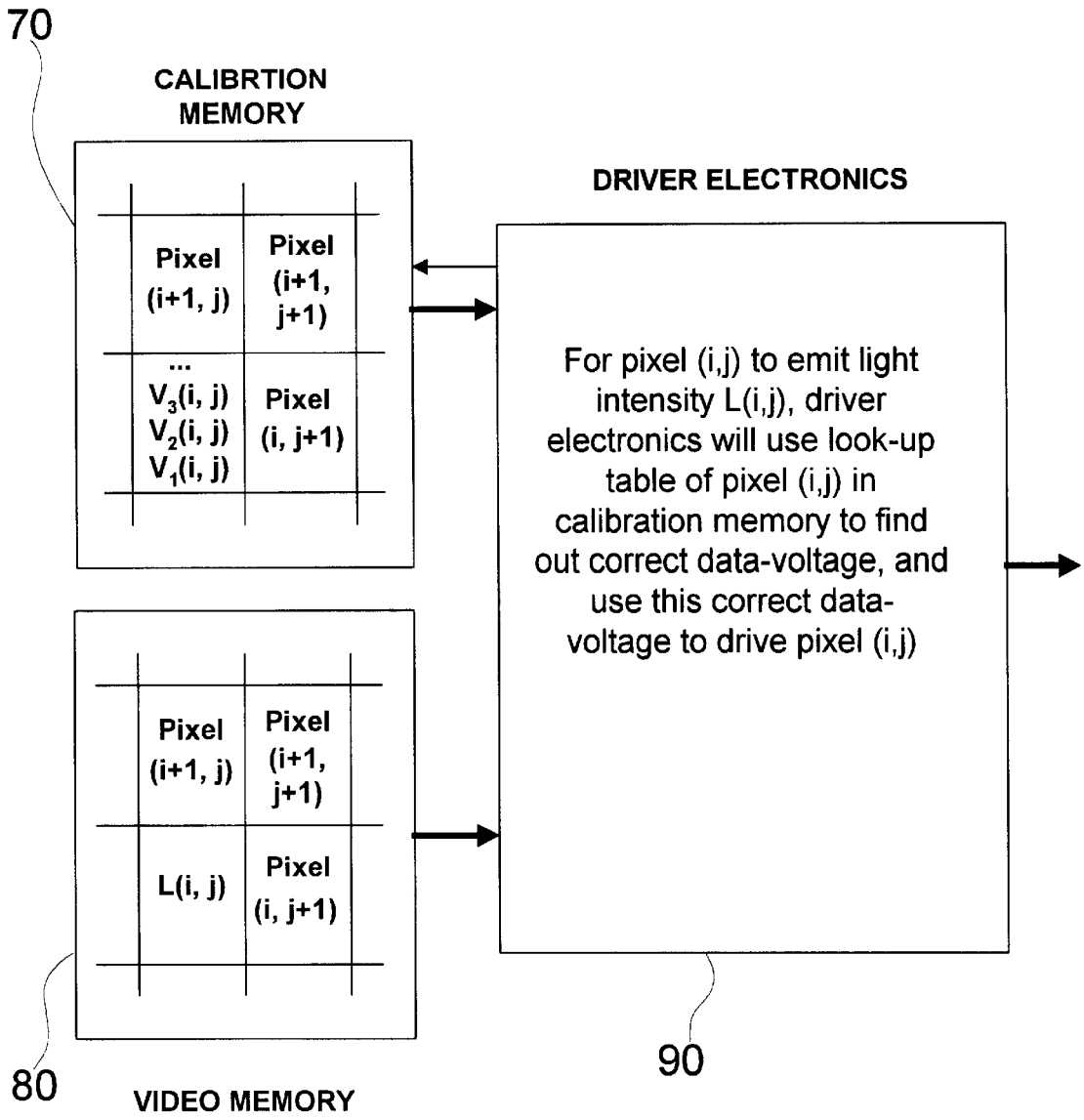
FIG. 16*b* shows that the driver electronics fetch uncompensated light intensity from the video memory and use the look-up table in the calibration memory to find out the correct data-voltage.

FIG. 16*a* shows in detail the method one mentioned above. With method one, for every pixel in the display, the correct data-voltages—$V_1(i,j)$, $V_2(i,j)$, $V_3(i,j)$, . . . , and $V_K(i,j)$, for all gray levels—with corresponding desired intensity $L_1$, $L_2$, $L_3$ . . . , and $L_K$, are calculated by using linear approximation or other previously described methods. More specifically, for 8 gray levels, 8 voltages are calculated for each pixel, and for 256 gray levels, 256 voltages are calculated. These calculated correct data-voltages are used as calibration parameters directly and stored in a calibration memory 70. With a conventional display, if a computer want a pixel to display certain intensity, it will write the intensity word (which is a byte for 8 bit gray levels) of the pixel to a location in video memory 80, and the driver electronics will use the intensity words in video memory 80 to drive the display. With present newly invented display, however, if a computer want a pixel to display certain desired intensity, it will first use the look-up table of the corresponding pixel in calibration memory 70 to find out the correct data-voltage for that desired intensity, write this correct data-voltage to video memory 80, and the driver electronics will use the correct data-voltages in video memory 80 to drive the AM-LCD. Alternatively, as shown in FIG. 16*b*, the computer can still write the uncompensated intensity word to video memory 80, but, the driver electronics itself will use the look-up tables in calibration memory 70 to find out the correct data-voltage for any gray level of any pixel, and use this correct data-voltage to drive the AM-LCD.

Above described method one of using complete look-up tables is relatively easy to implement, but, if a display has large number of pixels and each pixel has large number of gray levels, the amount of calibration memory required can be quite large. For example, for a 256-gray-level display with one million pixels, one need to store 256 million numbers. If each correct driving voltage is stored as a byte to represent the absolute number, then, 256 Megabyte calibration memory is needed. To reduce the memory requirement, one can instead store relative numbers in calibration memory 70. For example, one can store relative number $\Delta V_k(i,j)=V_k(i,j)-\overline{V}_k$ into calibration memory 70, where $\overline{V}_k=\Sigma V_k(i,j)$ is the average data-voltage for gray level k averaged over all pixels, and $1 \leqq k \leqq K$. If the variations among different pixels are small, one can use a smaller number of bit (such as 4 bit) to represent $\Delta V_k(i,j)$ even if one need 8 bit to represent $V_k(i,j)$. Another way to reduce the calibration memory requirement, which is the method two mentioned previously, is to use partial look-up tables, instead of complete look-up tables.

Figure 17A:
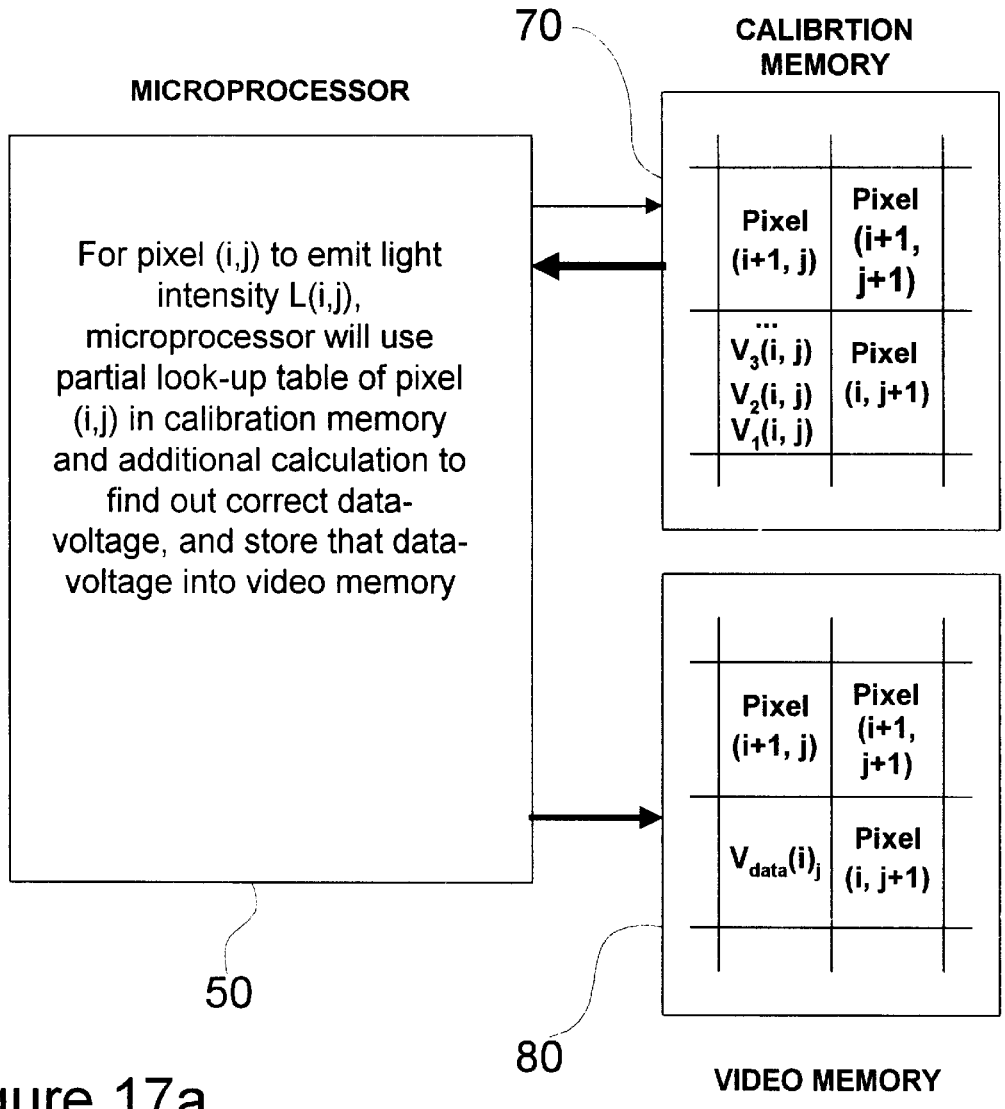
FIG. 17*a* shows that a microprocessor use the partial look-up table in the calibration memory in combination with additional calculation to find out the correct data-voltage, and store the correct data-voltage into the video memory.
Figure 17B:
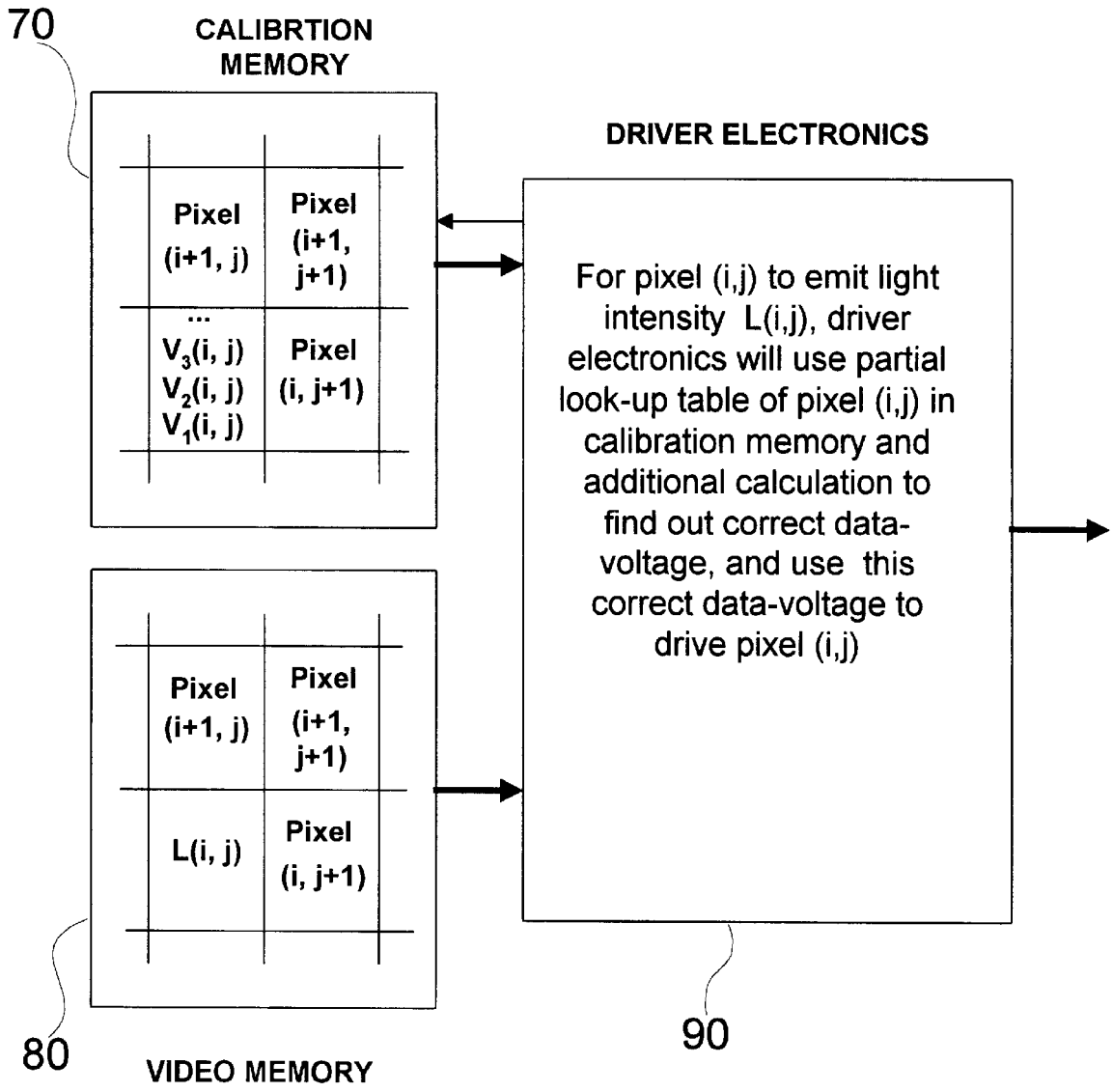
FIG. 17*b* shows that the driver electronics fetch uncompensated light intensity from the video memory and use the partial look-up table in the calibration memory in combination with additional calculation to find out the correct data-voltage.

FIGS. 17*a* and 17*b* show in detail the method two mentioned previously. With method two, for every pixel in the display, the correct data-voltages—$V_1(i,j)$, $V_2(i,j)$, $V_3(i,j)$, . . . , and $V_K(i,j)$, for selected number of gray levels—with corresponding desired intensity $L_1$, $L_2$, $L_3$ . . . , and $L_K$, are calculated and used as calibration parameters. These calibration parameters are stored as partial look-up tables in a calibration memory 70 for future use. The microprocessor or driver electronics will use the partial look-up tables in combination with some additional calculation in real time to find the correct data-voltages. Where the number of gray levels K selected are smaller than the number of total gray levels. As for the issue on how to select $L_1$, $L_2$, $L_3$ . . . , and $L_K$, it may be chosen based on the non-linearity of the display curve or just chosen for convenience, such as for a four point calibration, one simply may chose $L_1=(1/4)L_0$, $L_2=(2/4)L_0$, $L_3=(3/4)L_0$, and $L_4=L_0$, where $L_0$ is maximum intensity.

After the calibration parameters are calculated and stored as partial look-up tables in calibration memory 70, the next step is to use the partial look-up tables to calculate the correct driver voltages to provide nearly perfect display uniformity for the present disclosed AM-LCDs.

With a conventional display, if a computer want a pixel to display certain intensity, it will write the intensity word (which is a byte for 8 bit gray level) of the pixel to a location in a video memory, and the driver electronics will use the intensity words in the video memory to drive the display. With present newly invented display, however, if a computer want a pixel to display certain desired intensity, it will first fetch the related calibration parameters from the corresponding partial look-up table from calibration memory 70, as shown in FIG. 17*a*; then, use these calibration parameters along with the intensity word to calculate the correct data-voltage that can achieve the desired intensity for that pixel; then, write this correct data-voltage to video memory 80; and then, the driver electronics will use the correct data-voltages in video memory 80 to drive the AM-LCD. Alternatively, as shown in FIG. 17*b*, the computer can still write the uncompensated intensity word to video memory 80, but, the driver electronics itself will use the partial look-up table in calibration memory 70 in combination with some calculations to find out the correct data-voltage for any gray level of any pixel, and use this correct driving data-voltage to drive the AM-LCD directly. In both of the above two alternatives, some calculations are required to obtain the correct data-voltage; these calculation can be performed with a microprocessor 50, which can be the main microprocessor or preferably a dedicated display processor. In the following, several algorithms for performing these calculations are described, and for linear approximation, a specific design of display processor 50 is described.

Figure 18A:
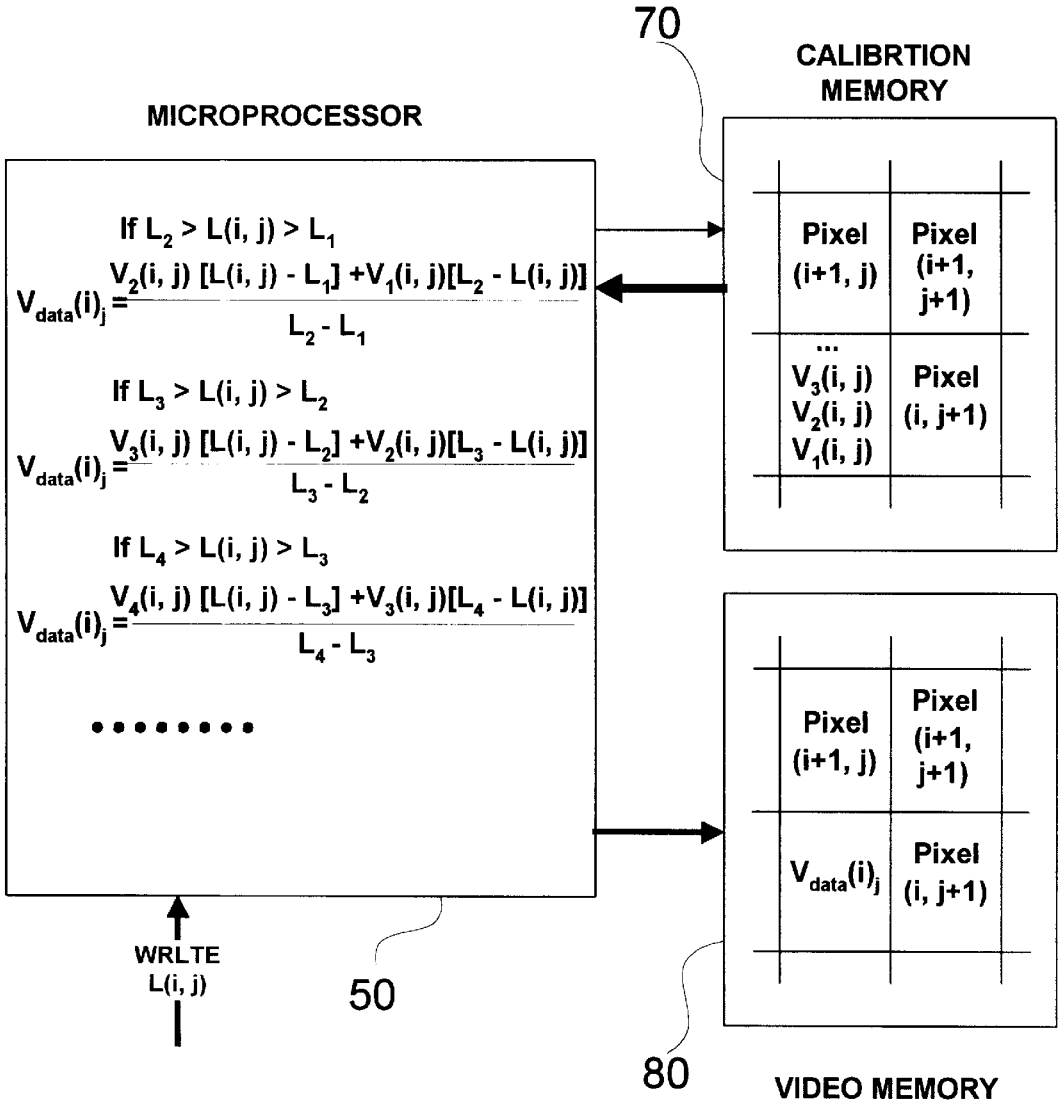
FIG. 18*a* shows that a microprocessor use the partial look-up table in the calibration memory in combination with linear approximation to calculate the correct data-voltage, and store the correct data-voltage into the video memory.
Figure 18B:
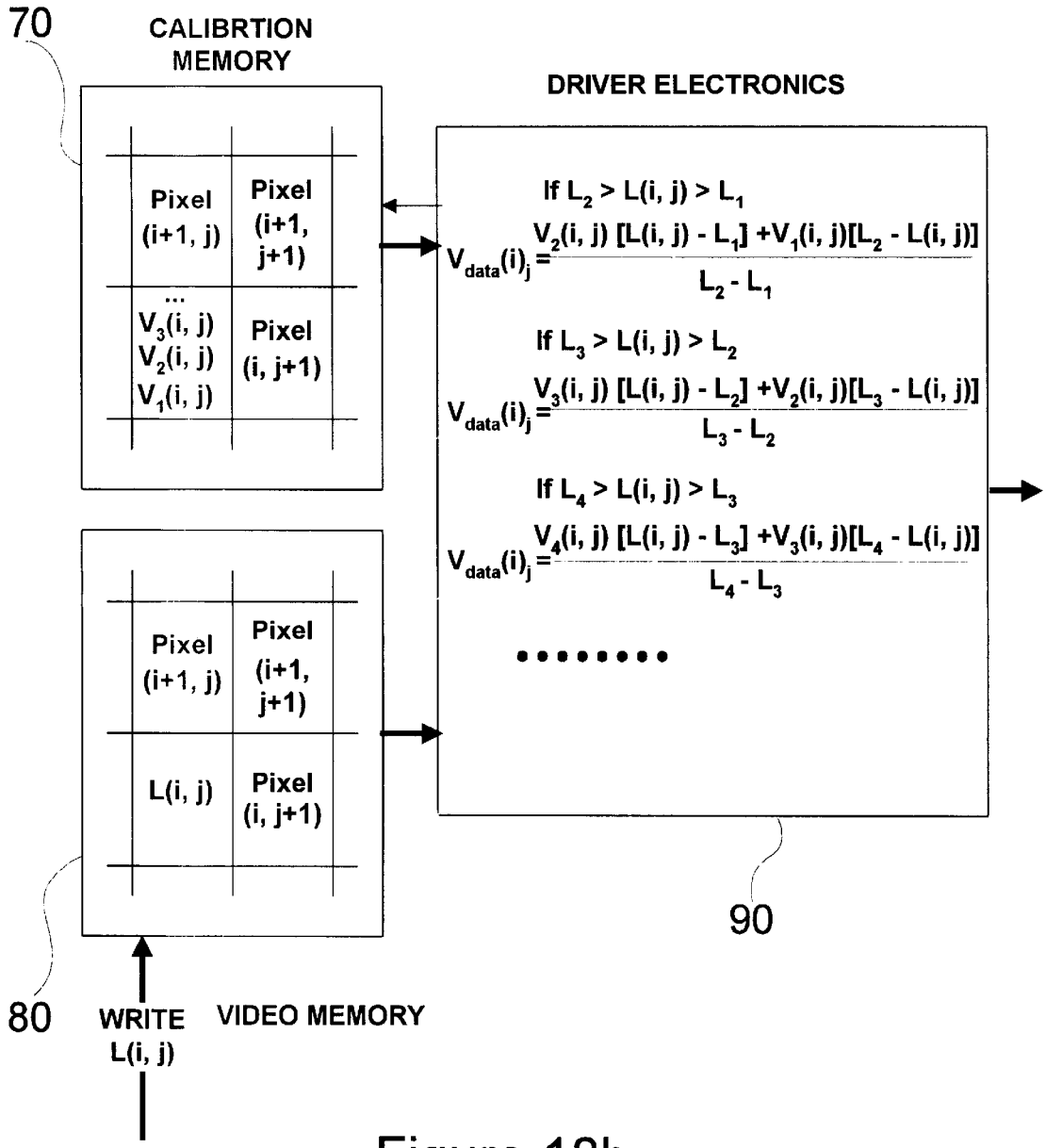
FIG. 18*b* shows that the driver electronics fetch uncompensated light intensity from the video memory and use the partial look-up table in the calibration memory in combination with linear approximation to calculate the correct data-voltage.

FIG. 18*a* illustrates a specific implementations of FIG. 17*a* based on linear approximations, and FIG. 18*b* illustrates that of FIG. 17*b*. In FIG. 18*a* or 18*b*, the microprocessor 50 or driver electronics 90 first compare the desired intensity L(i,j) with the set of intensity levels ($L_1$, $L_2$, $L_3$ . . . , and $L_K$) which have pre-calculated correct data-voltages stored in calibration memory 70, the microprocessor find the two numbers (among $L_1$, $L_2$, $L_3$ . . . , and $L_K$) which are most close to the desired intensity L(i,j); the microprocessor 50 or driver electronics 90 will then fetch the driving voltages corresponding to these two numbers from calibration memory 70 and use liner approximation to calculate the correct data-voltage $V_{data}(i)_j$ which can achieve the desired intensity L(i,j); finally, the calculated data-voltage $V_{data}(i)_j$ is stored in video memory or used by driver electronics to driver the display directly. Take an example of how $V_{data}(i)_j$ is calculated, if $L_2<L(i,j)<L_3$, then $$V_{data}(i)_j = \frac{V_3(i,j)[L(i,j)-L_2]+V_2(i,j)[L_3-L(i,j)]}{L_3-L_2}.$$

Figure 18C:
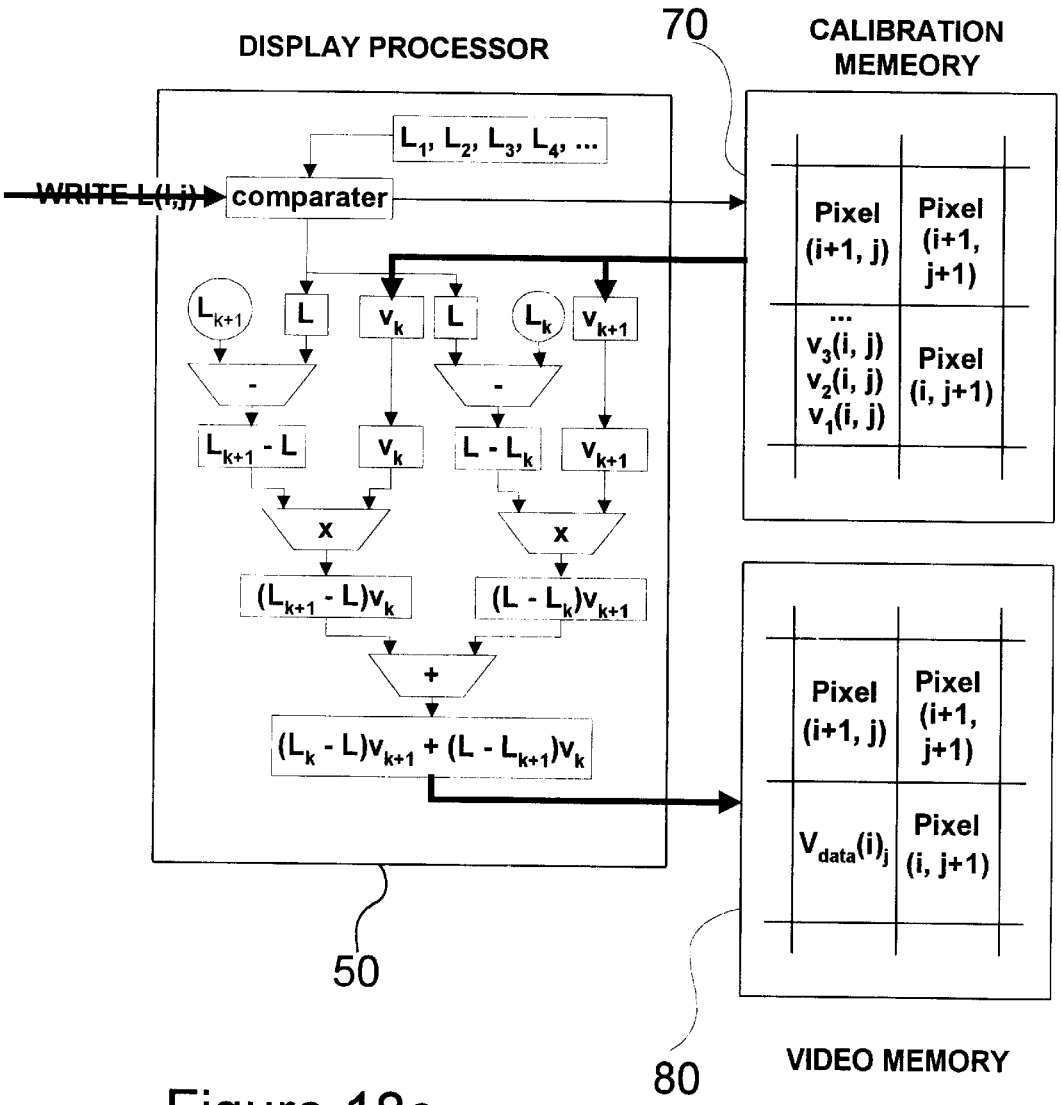
FIG. 18*c* shows a specific implementation of a display processor which uses linear approximation to calculate the correct data-voltage.

In fact, to simplify the above calculation and speed up the calculation in real time, one can chose $\Delta L=L_2-L_1=L_3-L_2=L_{K-LK-1}$, and rather than store $V_k(i,j)$ (with k=1, 2, . . . K) in calibration memory 70, one can store $v_k(i,j)=V_k(i,j)/\Delta L$ (with k=1, 2, . . . K) in calibration memory 70. The microprocessor 50 or driver electronics 90 then use $v_k(i,j)$ to calculate the correct data-voltage $V_{data}(i)_j=v_{k+1}(i,j)[L(i,j)-L_k]+v_k(i,j)[L_{k+1}L(i,j)]$, where $L_k<L(i,j)<L_{k+1}$. The microprocessor used to perform the above calculations can be the main microprocessor or a dedicated display processor. FIG. 18*c* illustrates a specific design of display processor 50 based on above linear approximation by using hardware gate elements.

To minimize the calibration memory requirement one can store a normalized variation of $v_k(i,j)$. The normalized variation $\alpha_k(i,j)$ is defined by $v_k(i,j)=\bar{v}_k[1+S\alpha_k(i,j)]$, where S is a scaling factor that is chosen based on the variations of all the $v_k(i,j)$, and $\bar{v}_k$ is the average of $v_k(i,j)$ over all pixels $$\bar{v}_k = \frac{1}{N*M}\sum_{i=1,j=1}^{N,M} v_k(i,j).$$

The average $\bar{v}_1$, $\bar{v}_2$, $\bar{v}_3$ . . . and $\bar{v}_K$, and the scaling factor S are also stored in a memory, and these numbers can be loaded into the microprocessor to perform the calculation. The design of a dedicated display processor by using the normalized variation $\alpha_k(i,j)$ is straight forward for the people skilled in the art, and will not be discussed further here.

In FIG. 18*a* or 18*b*, the microprocessor 50 or the driver electronics 90 use liner approximation to calculate the driving voltage $V_{data}(i)_j$ that can achieve the desired intensity L(i,j). In fact, one can also use polynomial approximation to calculate the driving voltage $V_{data}(i)_j$ that can achieve the desired intensity L(i,j). For example, $$V_{data}(i)_j = \frac{(L_2-L)(L_3-L)\cdots(L_K-L)}{(L_2-L_1)(L_3-L_1)\cdots(L_K-L_1)}V_1(i,j) + \frac{(L_1-L)(L_3-L)\cdots(L_K-L)}{(L_1-L_2)(L_3-L_2)\cdots(L_K-L_2)}V_2(i,j)+\ldots$$

One can even use more complicated algorithm, such as, the algorithm of using least square fit in combination with a device model to calculate the data voltage $V_{data}(i)_j$ that can achieve the desired intensity L(i,j). Of course, the more complicated the algorithm, the more it is required for the processing power of the microprocessor 50 or the driver electronics 90. One need to make a compromise between the processing power and the amount of calibration memory required. With enough calibration memory, simple linear approximation algorithm can already provide the satisfactory results.

Based on above teachings, it is clear that, for the embodiment of FIG. 13, even if diodes with modest quality are used, it is still possible to achieve almost perfect display uniformity for the AM-LCD illustrated in that figure. In fact, the above taught method of improving the display uniformity of AM-LCDs can also be applied to other kinds embodiment of AM-LCD. FIG. 19 shows a variation of the embodiment of FIG. 13 and FIG. 6*c*, and display uniformity of the AM-LCD in FIG. 19 can be improved by the same way as that of FIG. 13. Compared with the embodiment of FIG. 13, the embodiment of FIG. 10 consists of only one array of column driving lines, in contrast to two arrays in FIG. 13. In general, if the display characteristics of a pixel in an AM-LCD do not depend on the data-voltages applied to other pixels, one can always measure the display characteristics of that pixel independently, and store into a calibration memory the calibration parameters derived from the measured display characteristics (while in certain cases, the measured display characteristics can be used as the calibration parameters directly), then, one can use the calibration parameters in the calibration memory to find out the correct data-voltages, and use the correct data-voltages to drive the AM-LCD.

Figure 20A:
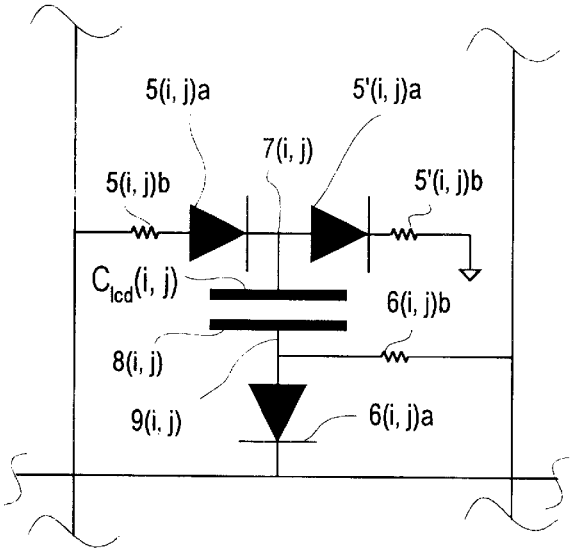
FIG. 20*a* shows that capacitor 8(*i,j*) is the intrinsic capacitor of the LCD cell.
Figure 20B:
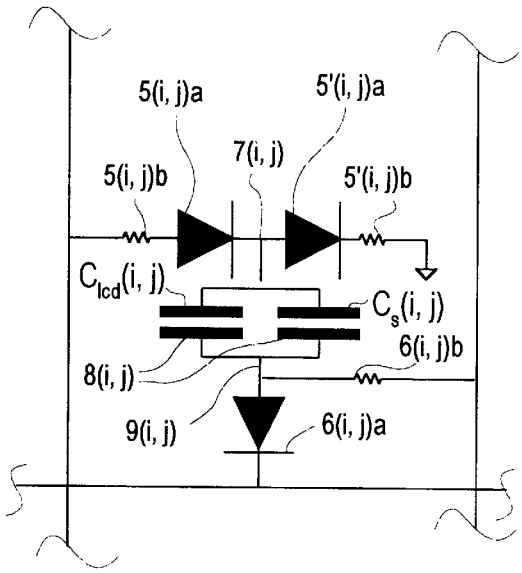
FIG. 20*b* shows that capacitor 8(*i,j*) is the intrinsic capacitor of the LCD in parallel with another storage (or shunt) capacitor.
Figure 20C:
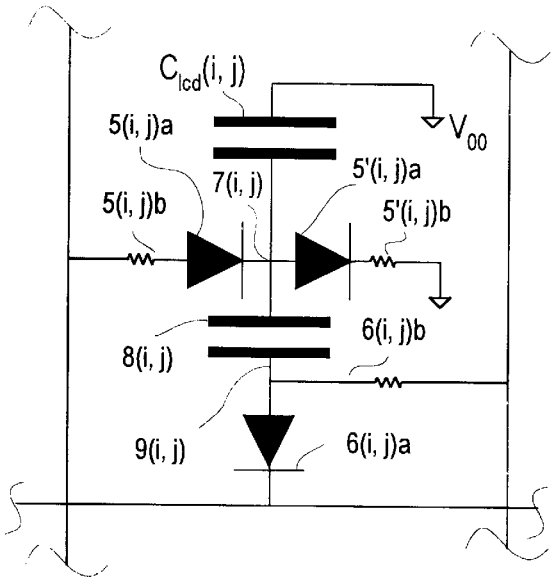
FIG. 20*c*, capacitor 8(*i,j*) is just a storage capacitor.

In addition, the capacitor 8(*i,j*) in FIG. 2, FIG. 13, and FIG. 19 can either be the intrinsic capacitor of the LCD cell at pixel (i,j) or be the intrinsic capacitor of the LCD cell at pixel (i,j) in parallel with another storage (or shunt) capacitor. Taking the embodiment of FIG. 13 as an example, FIG. 20*a* shows that capacitor 8(*i,j*) is the intrinsic capacitor of the LCD cell $C_{lcd}(i,j)$, and FIG. 20*b* shows that capacitor 8(*i,j*) is the intrinsic capacitor of the LCD $C_{lcd}(i,j)$ in parallel with another storage (or shunt) capacitor $C_s(i,j)$. In fact, as shown in FIG. 20*c*, capacitor 8(*i,j*) can just be a storage capacitor $C_s(i,j)$, and terminal 7(*i,j*) is connected the LCD cell $C_{lcd}(i,j)$ that has the other terminal connected to a common voltage $V_{00}$; in this case, the voltage on terminal 7(*i,j*) is used to control the LCD cell, and when the voltage on terminal 7(*i,j*) is maintained, the voltage across the LCD cell $C_{lcd}(i,j)$ is also maintained.

The forgoing description of selected embodiments and applications has been presented for purpose of illustration. It is not intended to be exhaustive or to limit the invention to the precise form described, and obviously many modifications and variations are possible in the light of the above teaching. The embodiments and applications described above was chosen in order to explain most clearly the principles of the invention and its practical application thereby to enable others in the art to utilize most effectively the invention in various embodiments and with various modifications as are suited to the particular use contemplated. Accordingly, the scope of the invention should be determined not by the embodiments illustrated, but by the appended claims and their legal equivalents.

I claim:

1. A method for creating a video data signal compensated for the non-uniformity of an LCD having a matrix of pixels, comprising the steps of:

measuring the display characteristics of each pixel, having an LCD cell, in the matrix of pixels;

deriving at lest one calibration parameter for each pixel in the matrix of pixels from the measured display characteristics of the corresponding pixel;

storing into a calibration memory at least one calibration parameter for each pixel in the matrix of pixels;

obtaining the compensated video word for each pixel in the matrix of pixels by using the calibration parameter for the corresponding pixel fetched from the calibration memory;

storing into a video memory having a matrix of memory-cells the compensated video word for each pixel in the matrix of pixels;

creating the compensated video data signal by fetching the compensated video word for each pixel from the video memory; and wherein each pixel including (a) a capacitor having a first terminal and a second terminal, (b) a first non-linear element having a first terminal connecting to the first terminal of said capacitor, (c) a second non-linear element having a first terminal connecting to the first terminal of said capacitor, (d) a third non-linear element having a first terminal connecting to the second terminal of said capacitor, and (e) a resistive element having a first terminal connecting to the second terminal of said capacitor.

2. A method of claim 1 wherein said step of deriving further comprises the step of determining the calibration parameters of each pixel based on a device model by using the measured display characteristics of the corresponding pixel as the row data; and where said step of obtaining further comprises the step of calculating the correct driving parameters by using a device model as the algorithm and by using the calibration parameters of the corresponding pixel from the calibration memory as the raw data.

3. A method of claim 1 wherein the video memory is a video RAM.

4. A method of claim 1 wherein the video memory is a VRAM.

5. An active matrix LCD with improved display uniformity, comprising:

an array of row driving lines;

a first array of column driving lines being perpendicular to said array of row driving lines;

a second array of column driving lines being in parallel with said first array of column driving lines;

a matrix of pixel elements wherein a pixel element comprising, (a) a capacitor having a first terminal and a second terminal, (b) a first non-linear element having a first terminal connecting to the first terminal of said capacitor and having a second terminal connecting to a column driving line in said first array of column driving lines, (c) a second non-linear element having a first terminal connecting to the first terminal of said capacitor, and having a second terminal connecting to a common voltage, (d) a third non-linear element having a first terminal connecting to the second terminal of said capacitor and having a second terminal connecting to a row driving line in said array of row driving lines, (e) a resistive element having a first terminal connecting to the second terminal of said capacitor and having a second terminal connecting to a column driving line in said second array of column driving lines;

a calibration memory having at least one calibration parameter for said pixel element stored therein;

electronic circuitry for obtaining the correct driving parameters for said pixel element by using the calibration parameter for said pixel element fetched from said calibration memory;

electronic circuitry for driving said pixel element with the correct driving parameters for said pixel element;

a video memory having the compensated video word for said pixel element stored therein; and electronic circuitry for converting the compensated video word into the correct driving parameter for said pixel element.

6. The active matrix LCD of claim 5 wherein the video memory is a video RAM.

7. The active matrix LCD of claim 5 wherein the video memory is a VRAM.

8. An active matrix LCD comprising:

an array of row driving lines;

a first array of column driving lines being perpendicular to said array of row driving lines;

a second array of column driving lines being in parallel with said first array of column driving lines; and a matrix of pixel elements wherein a pixel element comprising, (a) a capacitor having a first terminal and a second terminal, (b) a first non-linear element having a first terminal connecting to the first terminal of said capacitor and having a second terminal connecting to a column driving line in said first array of column driving lines, (c) a second non-linear element having a first terminal connecting to the first terminal of said capacitor, and having a second terminal connecting to a common voltage, (d) a third non-linear element having a first terminal connecting to the second terminal of said capacitor and having a second terminal connecting to a row driving line in said array of row driving lines, and (e) a resistive element having a first terminal connecting to the second terminal of said capacitor and having a second terminal connecting to a column driving line in said second array of column driving lines.

9. An active matrix LCD of claim 8 wherein said first non-linear element, said second non-linear element and said third non-linear element are selected from a group consisting of metal-insulator-metal diode, pn diode, diode complex comprising a metal-insulator-metal diode and a resistor, diode complex comprising a pn diode and a resistor, avalanche diode complex comprising two thin film pn diodes connecting inversely to each other in series, and any combination thereof.

10. An active matrix LCD of claim 8 further comprising:

a calibration memory having at least one calibration parameter for each pixel element in said matrix of pixel elements stored therein.

11. An active matrix LCD of claim 10 wherein the calibration parameter for each pixel element being the correct data-voltages for a gray levels of that pixel element; and said calibration memory having the correct data-voltages for all gray levels of each pixel element stored therein as a complete lookup table.

12. An active matrix LCD of claim 10 wherein the calibration parameter for each pixel element being the correct data-voltages for a gray levels of that pixel element; and said calibration memory having the correct data-voltages for selected gray levels of each pixel element stored therein as a partial lookup table.

13. An active matrix LCD of claim 10 wherein the calibration parameter for each pixel element being a set of fitting parameters for the display characteristics of the corresponding pixel element based on a device model.

14. An active matrix LCD of claim 10 further comprising:

electronic circuitry for determining the calibration parameter for each pixel element in said matrix of pixel elements.

15. An active matrix LCD of claim 10 further comprising:

electronic circuitry for calculating the correct driving parameter for each pixel element by fetching the calibration parameter for the corresponding pixel element from said calibration memory.

16. An active matrix LCD of claim 15 further comprising:

a video memory having the compensated video word for each pixel element stored therein, where the compensated video word for each pixel element being derived from the correct driving parameter for the corresponding pixel.

17. An active matrix LCD of claim 16 wherein the calibration parameter for each pixel element being the correct data-voltages for a gray levels of that pixel element; and said calibration memory having the correct data-voltages for all gray levels of each pixel element stored therein as a complete lookup table.

18. An active matrix LCD of claim 16 wherein the calibration parameter for each pixel element being the correct data-voltage for a gray levels of that pixel element; and said calibration memory having the correct data-voltages for selected gray levels of each pixel element stored therein as a partial lookup table.

19. An active matrix LCD of claim 16 wherein the calibration parameter for each pixel element being a set of fitting parameters for the display characteristics of the corresponding pixel element based on a device model.

* * * * *